US008603257B2

(12) United States Patent
Burt et al.

(10) Patent No.: US 8,603,257 B2
(45) Date of Patent: Dec. 10, 2013

(54) AUTOMATIC TOILET BOWL TREATMENT DEVICE

(75) Inventors: Diane Joyce Burt, Montvale, NJ (US); Wu Jin, Hull (GB); Christopher King, Hampton, NJ (US); Alexander W Mayes, Montvale, NJ (US); Pawel Rudzinski, Montvale, NJ (US); Jacobus Simon Petrus Van Diepen, Weinheim (DE)

(73) Assignee: Reckitt Benckiser LLC, Parsippany, NJ (US)

( * ) Notice: Subject to any disclaimer, the term of this patent is extended or adjusted under 35 U.S.C. 154(b) by 552 days.

(21) Appl. No.: 12/447,034

(22) PCT Filed: Sep. 11, 2008

(86) PCT No.: PCT/GB2008/003086

§ 371 (c)(1),
(2), (4) Date: Jan. 13, 2010

(87) PCT Pub. No.: WO2009/034330

PCT Pub. Date: Mar. 19, 2009

(65) Prior Publication Data

US 2012/0266920 A1 Oct. 25, 2012

(30) Foreign Application Priority Data

Sep. 14, 2007 (GB) ..... 0717950.0
Dec. 13, 2007 (GB) ..... 0724291.0

(51) Int. Cl.

| | |
|---|---|
| ***B08B 9/04*** | (2006.01) |
| ***B08B 7/04*** | (2006.01) |
| ***B08B 3/00*** | (2006.01) |
| ***E03D 9/02*** | (2006.01) |

(52) U.S. Cl.
USPC ..... 134/24; 134/18; 134/34; 4/223; 4/222; 4/231

(58) Field of Classification Search
USPC ..... 134/34, 18, 42; 4/222, 223, 229
See application file for complete search history.

(56) References Cited

U.S. PATENT DOCUMENTS

| | | | | |
|---|---|---|---|---|
| 2,760,209 | A | | 8/1956 | Ewing |
| 3,178,070 | A | | 4/1965 | Leland |
| 3,999,226 | A | * | 12/1976 | Wolf ..... 4/225.1 |
| 4,670,916 | A | * | 6/1987 | Bloom ..... 4/231 |
| 5,862,532 | A | | 1/1999 | Cain |

(Continued)

FOREIGN PATENT DOCUMENTS

WO 2007075819 A 7/2007

*Primary Examiner* — Eric Golightly
*Assistant Examiner* — Arlyn I Rivera-Cordero
(74) *Attorney, Agent, or Firm* — Norris McLaughlin & Marcus PA

(57) ABSTRACT

An automatic toilet bowl treatment device, wherein said device comprises: a fluid reservoir, a pump means, a hanger means, and a fluid spray means wherein the entire device is configured so that it can be suspended from, preferably wholly suspended from, a part of a toilet bowl and in particular, a part of the toilet bowl rim. The device is used for the automatic treatment of a lavatory appliance, preferably a toilet bowl and especially preferably the interior surfaces of a toilet bowl which process comprises operating the device to provide a quantity of a treatment composition at periodic intervals to one or more interior surfaces of the lavatory appliance, and preferably to one or more of the interior surfaces of a toilet bowl.

18 Claims, 36 Drawing Sheets

(56) References Cited

U.S. PATENT DOCUMENTS

| | | | | |
|---|---|---|---|---|
| 6,029,286 | A | 2/2000 | Funk | |
| 6,993,795 | B2 * | 2/2006 | Prineppi | 4/227.1 |
| 8,099,800 | B2 * | 1/2012 | Sawalski et al. | 4/223 |
| 2004/0050959 | A1 * | 3/2004 | Mazooji et al. | 239/263.1 |
| 2004/0068782 | A1 * | 4/2004 | Butter-Jentsch et al. | 4/231 |
| 2007/0136937 | A1 * | 6/2007 | Sawalski et al. | 4/223 |
| 2007/0186335 | A1 | 8/2007 | Alexander | |
| 2009/0044322 | A1 * | 2/2009 | Nunez et al. | 4/223 |

* cited by examiner

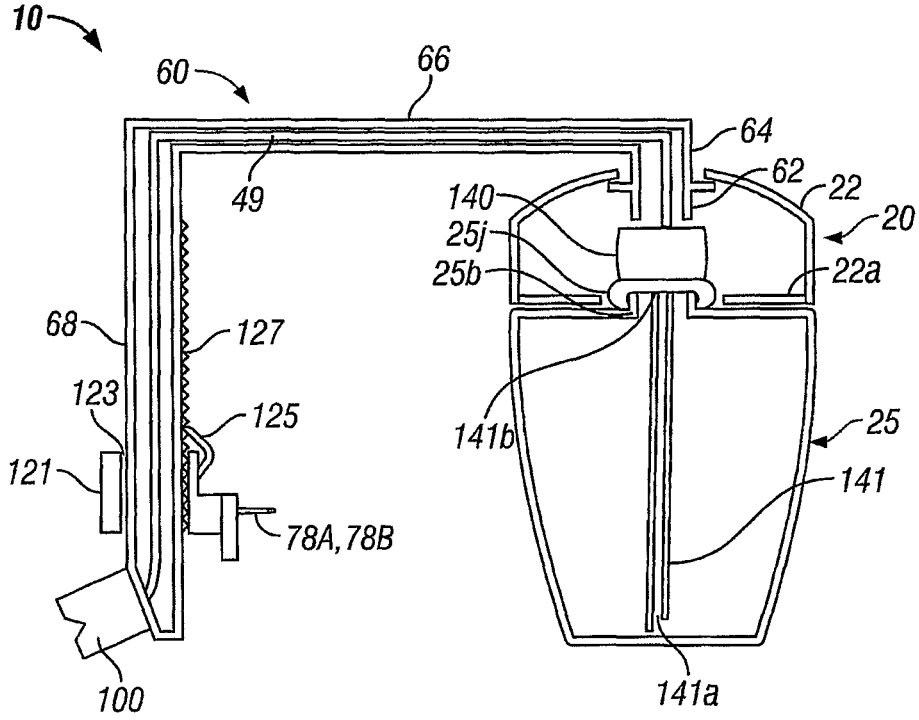
FIG. 26A1
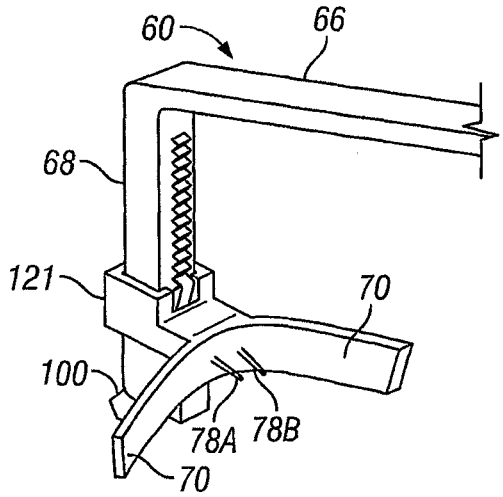
FIG. 26A2

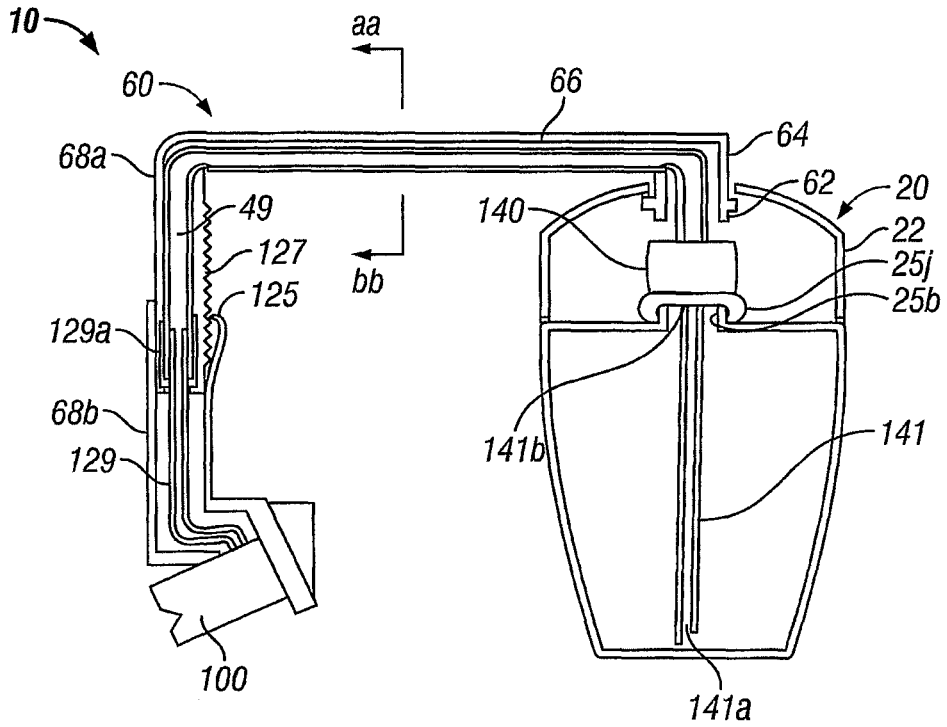
FIG. 26B1
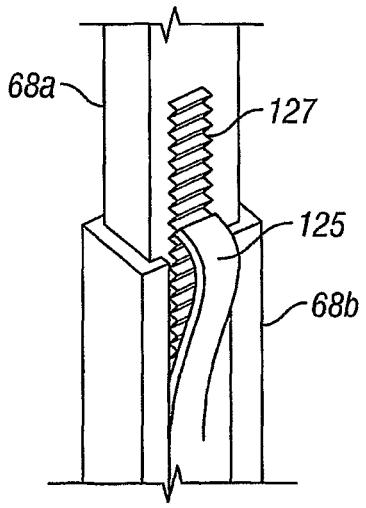
FIG. 26B2
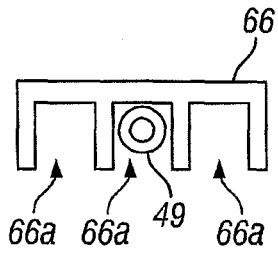
FIG. 26B3

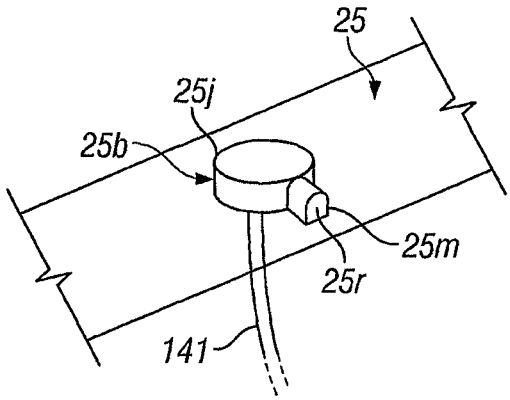
FIG. 27A1
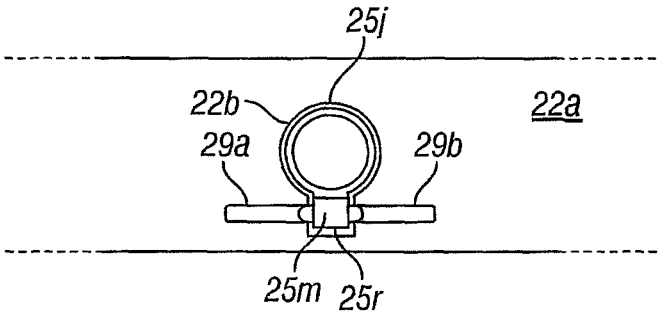
FIG. 27A2
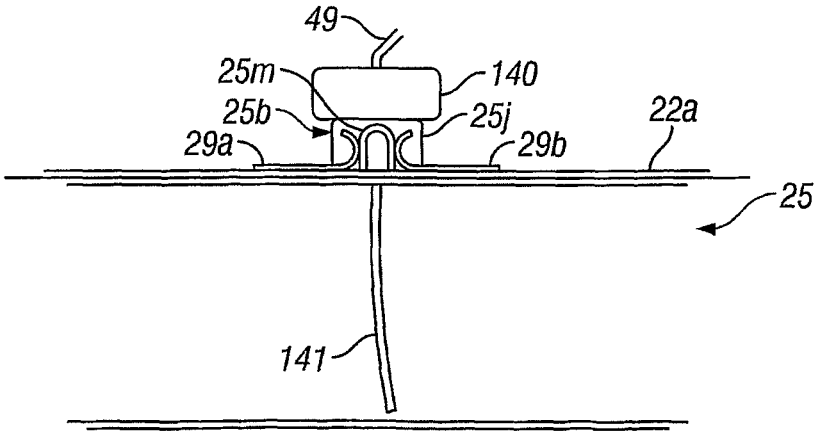
FIG. 27A3

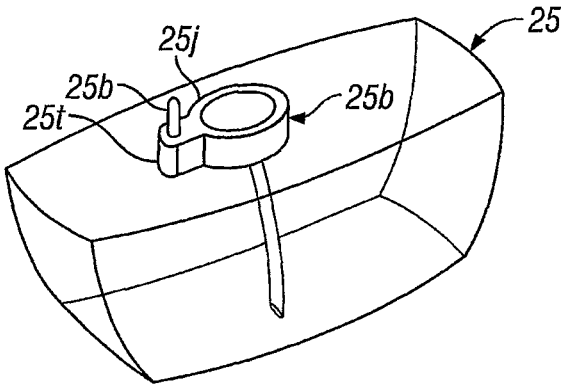
FIG. 27B1
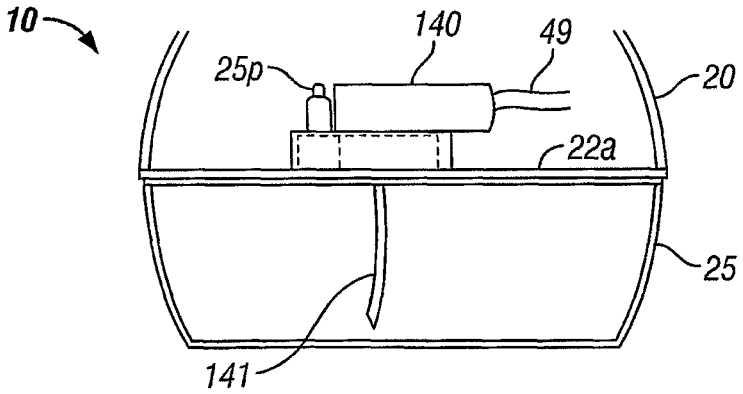
FIG. 27B2
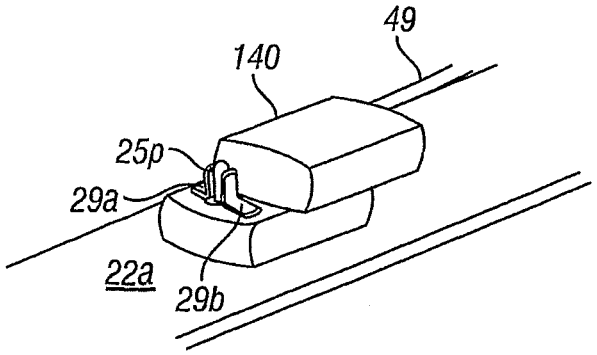
FIG. 27B3

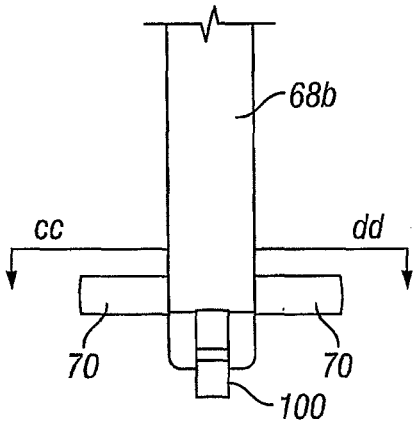
FIG. 27B4
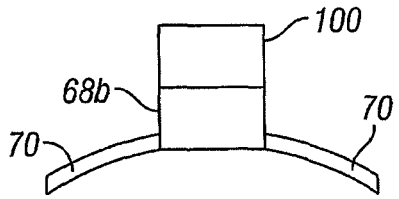
FIG. 27B5
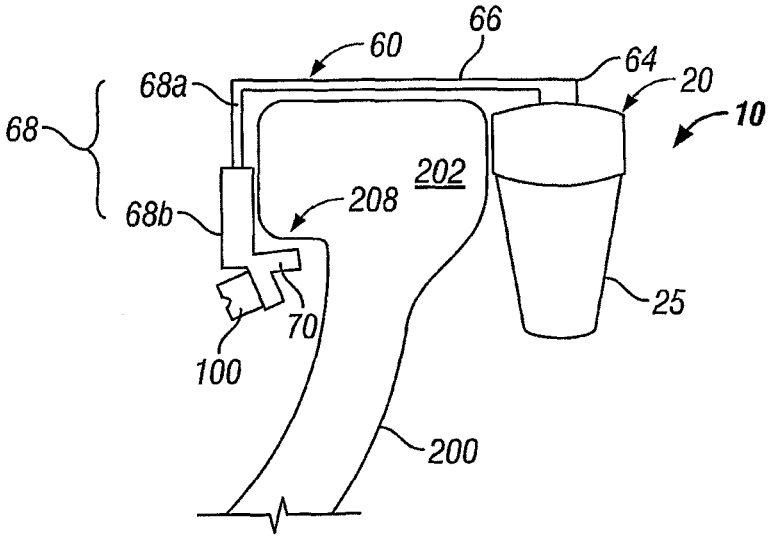
FIG. 27B6

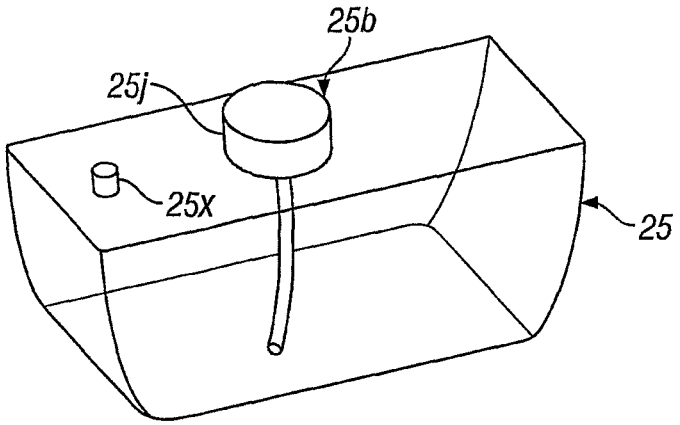
FIG. 27C1
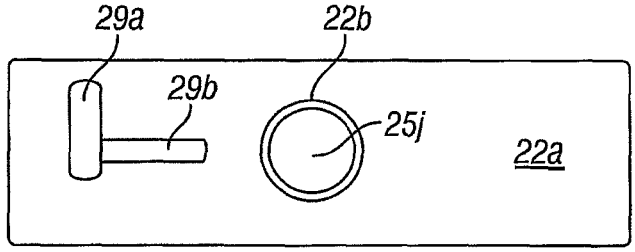
FIG. 27C2
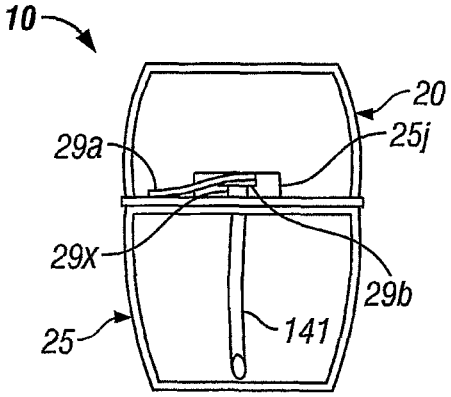
FIG. 27C4
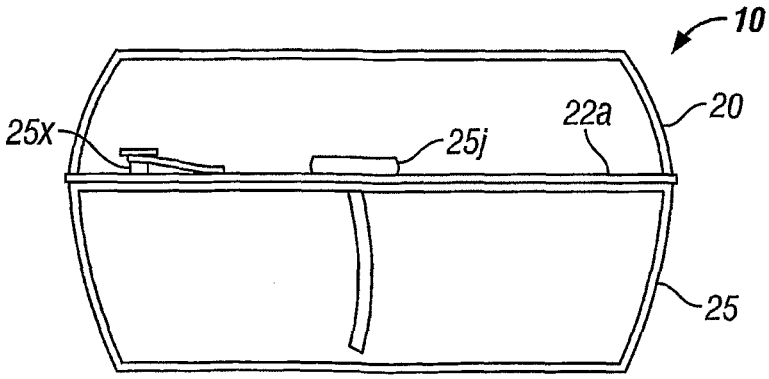
FIG. 27C3

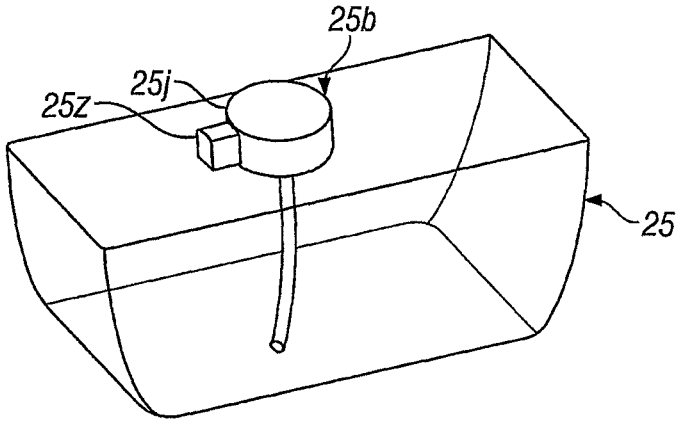
FIG. 27D1
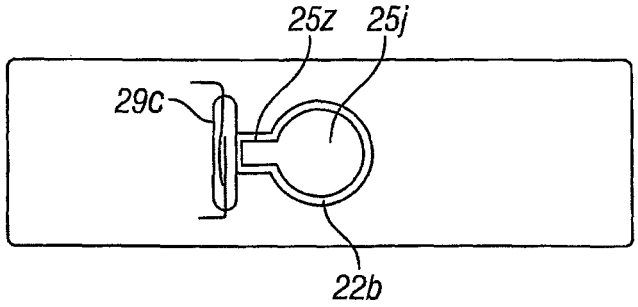
FIG. 27D2

AUTOMATIC TOILET BOWL TREATMENT DEVICE

This is an application filed under 35 USC 371 of PCT/GB2008/003086.

The present invention relates to an automatic toilet bowl treatment device. More specifically, the present invention relates to an automatic device for the treatment of a toilet bowl wherein said device provides a quantity of a liquid treatment composition directly to the interior surfaces out of the toilet bowl. Preferably, the treatment composition is a cleaning and/or disinfecting composition which is dispensed automatically either at periodic intervals and/or can be dispensed on-demand by the manual user intervention of a user from the device. The automatic toilet bowl treatment device is advantageously used supply the treatment composition in order to clean the inner surface of the toilet bowl preferably by automatically dispensing a quantity of the treatment composition to the inner curved surface of the toilet bowl below the rim thereof, and optionally, below the water line of the sump (outlet) of the toilet bowl. In preferred embodiments, the automatic toilet bowl treatment device is configured so that it can be suspended wholly from a part of the toilet bowl rim.

In the developed world, toilets and toilet bowls are ubiquitous. While they provide an important sanitary convenience to persons using them, they also require maintenance. Apart from the maintenance of the mechanical operation of the toilet bowl, toilets also require periodic cleaning in order to ensure their cleanliness, and hygienic condition. Frequently a cleaning operation is performed by human action or human intervention. In the most common cleaning operation a human periodically provides a quantity of a treatment composition, such as from a bottle or other dispenser, by manually dispensing said the treatment composition to the interior and exterior surfaces of a toilet bowl. Usually, such an operation is accompanied by manual agitation, e.g., scrubbing or wiping, usually by the use of a toilet brush which can be used to both spread in the treatment composition to surface it is including inclined surfaces of the toilet bowl as well as to the portions of the toilet bowl underneath the interior of the toilet bowl rim wherein hard water stains are known to form. Alternately, a cleaning operation can be performed by providing a lavatory treatment device in the form of a cleansing block which can be supplied either to the supply tank or supply cistern of the toilet bowl within which treatment chemicals provided as part of the cleaning block are dispersed in order to form a liquid treatment composition which then comes into contact with the inner surfaces of the toilet bowl during the flush cycle. Still alternately, a cleaning operation can be performed by providing a lavatory treatment device in the form of a cleansing block which is provided as part of a device which is intended to be suspended from the rim of a toilet bowl and in the path of water being flushed into the toilet bowl. The water contacting the cleansing block forms a treatment composition which is then dispensed onto the sidewalls and into the interior of the toilet bowl.

While such operations are known to be effective, they are nonetheless limited by the fact that they always require intervention by a human. Namely, a human is required to clean the toilet bowl using a liquid and a brush (or wiping article), or alternately a human may be required to flush the toilet bowl apparatus in order to provide flush water into the toilet bowl which contains a treatment composition. While such operations are normally satisfactory where a toilet bowl apparatus is used with some frequency, nonetheless when a toilet bowl apparatus is used infrequently or, wherein intervals between cleaning operations are relatively great, it would be desirable to provide a means for automatic treatment of a toilet bowl which does not require human intervention. Additionally, it would be advantageous to provide an apparatus or device which provides at regular intervals a quantity of a treatment composition to parts of a toilet bowl, particularly to the interior surfaces of the toilet bowl without requiring human intervention.

Known to the art are certain devices which perform certain of these functions. For example, there is a known to the art the device disclosed in US 20070136937 A1 to Sawalski. Therein is disclosed the toilet bowl cleaning and/or deodorizing device which includes a container for a chemical, a spray nozzle through which the chemical can be sprayed laterally around a perimeter of the nozzle, a conduit in fluid communication with the container and spray nozzle, fluid delivery means for delivering chemical from the container through the conduit and to the spray nozzle, and means for attaching the spray nozzle near a rim of the toilet bowl. In this device, it is recited at the spray nozzle can operate such that he treatment chemicals applied to the entire circumference of the inner surface of the toilet bowl. While such a device provides certain advantages, nonetheless and this is very evident from a review of the figures and the description therein, the devices provided are rather bulky and require the separation of the said device into at least two component parts, which component parts are required to be separately installed, a first part on the toilet rim, and the second part on a different part of the toilet bowl apparatus or at a position near to but detached from the toilet bowl apparatus. Such renders the device unwieldy, and detracts from its use especially in a consumer household. In a consumer household, it is often desired to provide lavatory treatment devices, particularly toilet bowl treatment devices, which are unobtrusive yet effective.

Thus, it is clear that there is a real and urgent need in the relevant art for further improvements to toilet bowl treatment devices.

In a first aspect of the invention, the present applicants provide an improved automatic toilet bowl treatment device, wherein said device includes a fluid reservoir, a pump means, a hanger means, and a fluid spray means wherein the entire device is configured so that it can be suspended from, preferably wholly from, or otherwise affixed to, preferably wholly affixed to, a part of a toilet bowl and in particular, a part of the toilet bowl rim.

In a second aspect of the invention, there is provided in improved automatic toilet bowl treatment device according to the first aspect of the invention wherein the fluid reservoir is a refillable fluid reservoir.

In a third aspect of the invention, there is provided an improved automatic toilet bowl treatment device according to the first aspect of the invention wherein the fluid reservoir is a fluid reservoir refill cartridge.

In a fourth aspect of the invention, there is provided an improved automatic toilet bowl treatment device according to any of the prior aspects of the invention wherein the fluid reservoir is a plurality of fluid reservoirs.

In a fifth aspect of the invention, there is provided in improved automatic toilet bowl treatment device according to the third and fourth aspect of the invention, or in the fluid reservoir is a fluid reservoir refill cartridge comprising a plurality reservoirs adapted to contain two (or more) fluids or liquids.

In a sixth aspect of the invention, there is provided an improved automatic toilet bowl treatment device according to any prior aspects of the invention, wherein the device further includes an air treatment means.

In a seventh aspect of the invention there is provided a fluid reservoir refill cartridge adapted to be installed in the improved automatic toilet bowl treatment device, which fluid reservoir refill cartridge includes a power source.

In an eighth aspect of the invention there is provided a fluid reservoir refill cartridge adapted to be installed in the improved automatic toilet bowl treatment device, which fluid reservoir refill cartridge includes elements which form part of an anti-counterfeit detection means, and wherein the said device also includes a complementary part(s) of the anti-counterfeit detection means.

According to an ninth aspect of the invention, there is provided a process for the automatic treatment of a lavatory appliance, preferably a toilet bowl and especially preferably the interior surfaces of a toilet bowl which process comprises the steps of: installing an improved automatic toilet bowl treatment device according to any aspect of the invention as described herein, and operating the same to provide a quantity of a treatment composition at periodic intervals to one or more interior surfaces of the lavatory appliance, and preferably to one or more of the interior surfaces of a toilet bowl.

These and other aspects of the invention will be described in further detail, particularly with reference to one or more of the following figures which describe certain preferred embodiments of the invention.

FIG. 1A depicts a perspective view of an embodiment of an improved automatic toilet bowl device of the invention.

FIGS. 1B, 1C respectively depict a top view, and a side-cross sectional view of the device of FIG. 1A.

Figure 1A:
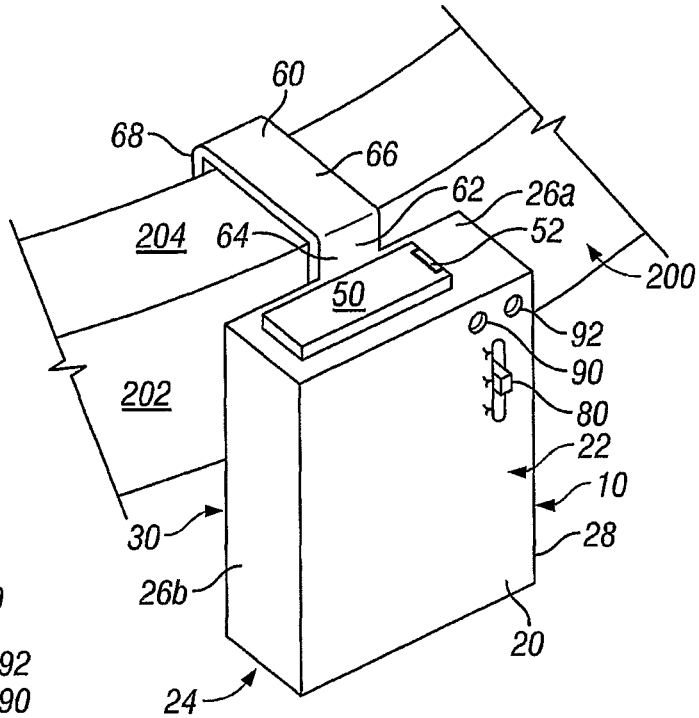
Figure 1B:
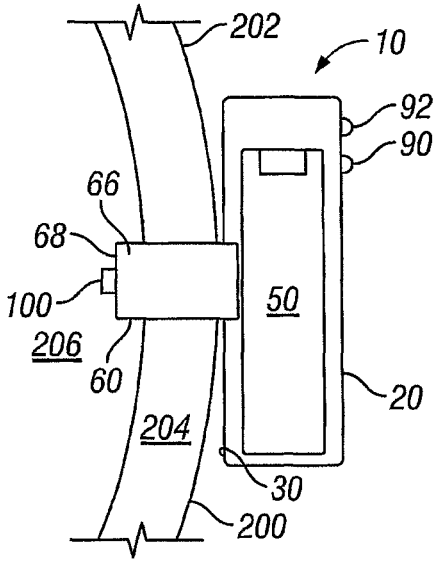
Figure 1C:
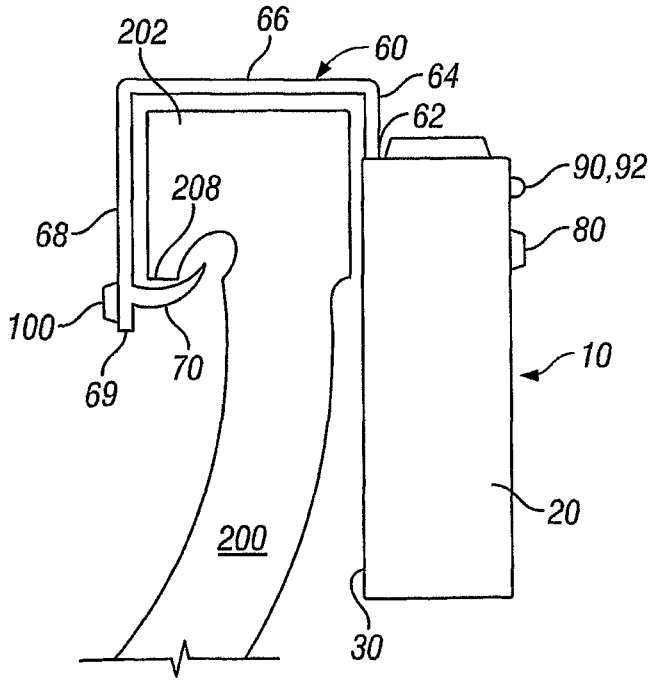
Figure 2:
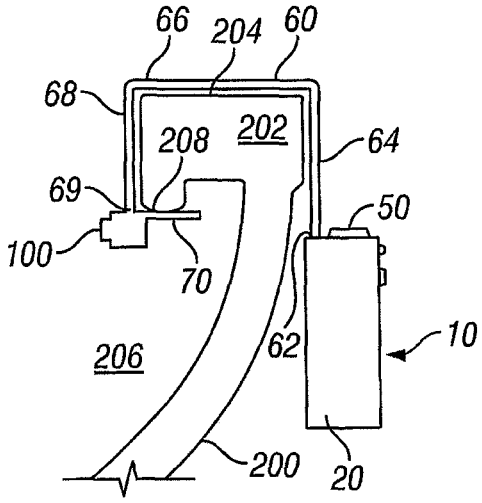
FIG. 2 illustrates a partial, cross-sectional view of a further embodiment of a device of the invention.

FIGS. 26A1 and 26A2 are shown a further embodiment of an improved automatic toilet bowl device of the invention.

Figure 3:
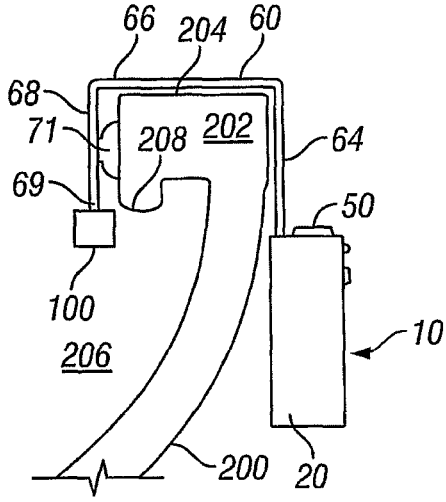
FIG. 3 shows a further partial cross-sectional view of a further embodiment of a device of the invention.

FIGS. 26B1 illustrates a further alternative embodiment of an improved automatic toilet bowl device of the invention, and FIGS. 26B2 and 26B3 depict details of elements of the device shown on FIG. 26B1.

FIGS. 27A1, 27A2, and 27A3 illustrate an embodiment of a refill cartridge.

FIGS. 27B1, 27B2 and 27B3 show a further embodiment of a refill cartridge.

Figure 4:
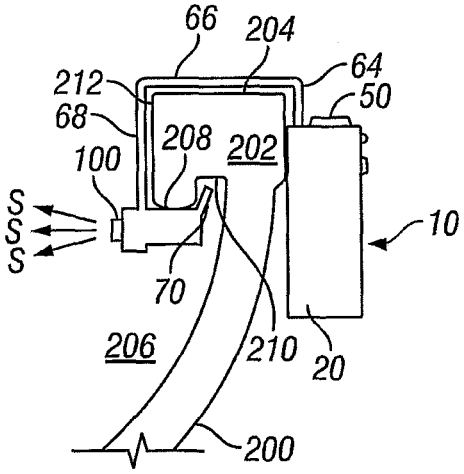
FIG. 4 depicts a still further partial cross-sectional view of a further embodiment of a device of the invention.
Figure 5:
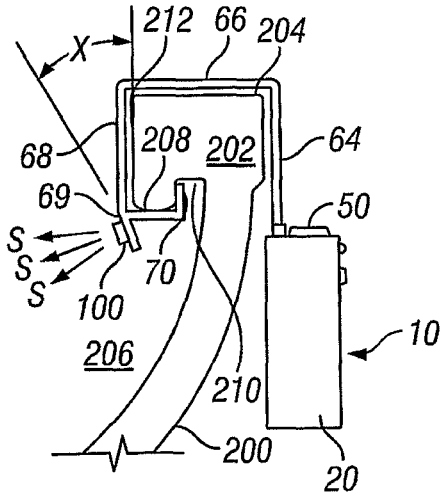
FIG. 5 depicts a yet further partial cross-sectional view of a further embodiment of a device of the invention.

FIGS. 27B4 and 27B5 illustrate parts of hanger means.

Figure 6:
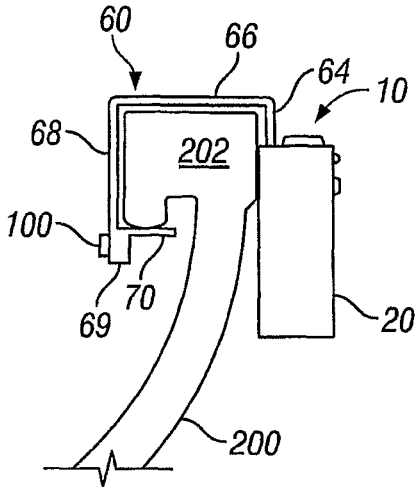
FIGS. 6 and 7 depicts two views of a further embodiment of an improved automatic toilet bowl device of the invention.

FIGS. 27B6 depicts a view of an embodiment of an improved automatic toilet bowl device mounted on part of a toilet bowl.

FIGS. 27C1, 27C2, 27C3 and 27C4 depict a further embodiment of a refill cartridge.

FIGS. 27D1 and 27D2 show a yet further embodiment of a refill cartridge.

Figure 28:
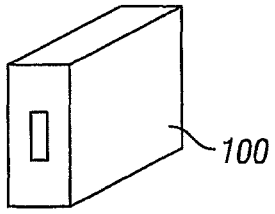

FIG. 28 shows an embodiment of a fluid spray means.

Figure 29:
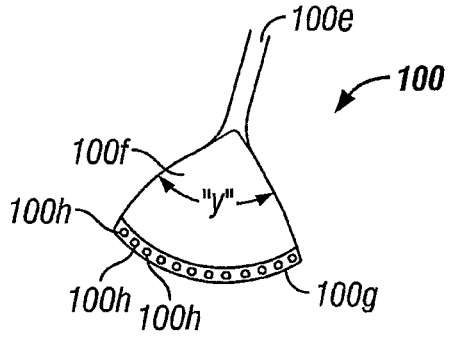

FIG. 29 depicts an alternate embodiment of a fluid spray means.

Figure 30:
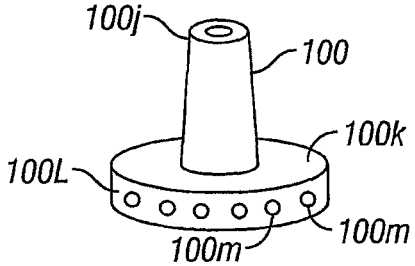

FIG. 30 shows a yet further embodiment of a fluid spray means.

Figure 31A:
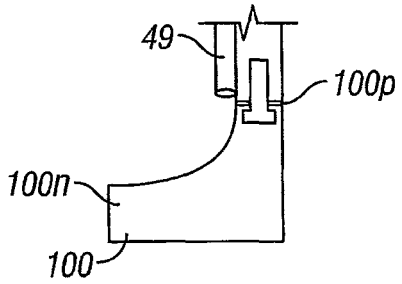
Figure 31B:
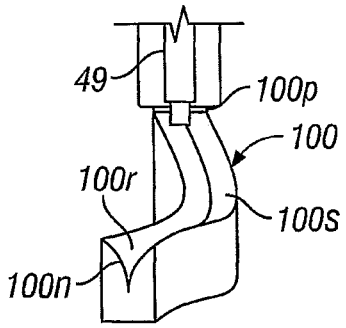

FIGS. 31A and 31B illustrate a further embodiment of a fluid spray means.

Figure 32A:
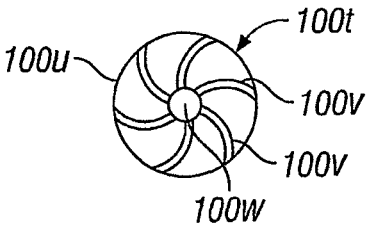
Figure 32B:
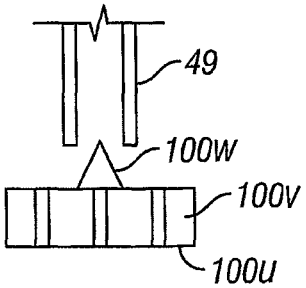
Figure 32C:
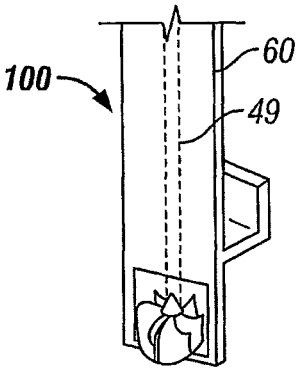

FIGS. 32A, 32B and 32C show an alternate embodiment of a fluid spray means.

Figure 33:
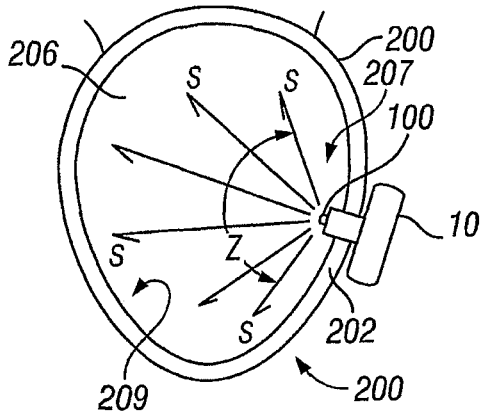

FIG. 33 depicts a top, plan view of a toilet bowl having mounted on a part of a rim thereof an embodiment of an improved automatic toilet bowl device of the invention, and an illustration of a spray pattern.

Figure 34:
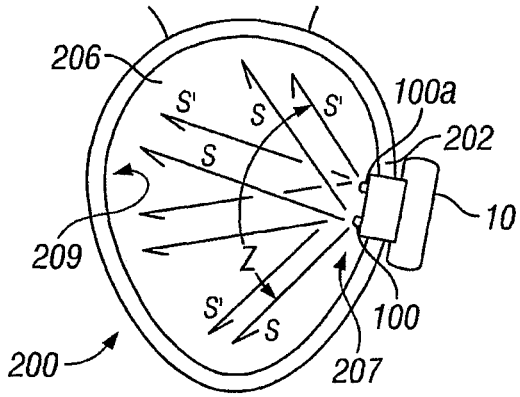

FIG. 34 depicts a further, top, plan view of a toilet bowl having mounted on a part of a rim thereof an embodiment of an improved automatic toilet bowl device of the invention having two spray means, and an illustration of a spray pattern.

Figure 35:
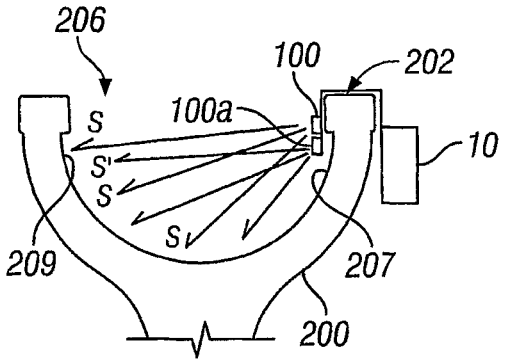

FIG. 35 illustrates a cross-sectional view of a further embodiment of an improved automatic toilet bowl device of the invention mounted on a rim of a toilet bowl.

Figure 36A:
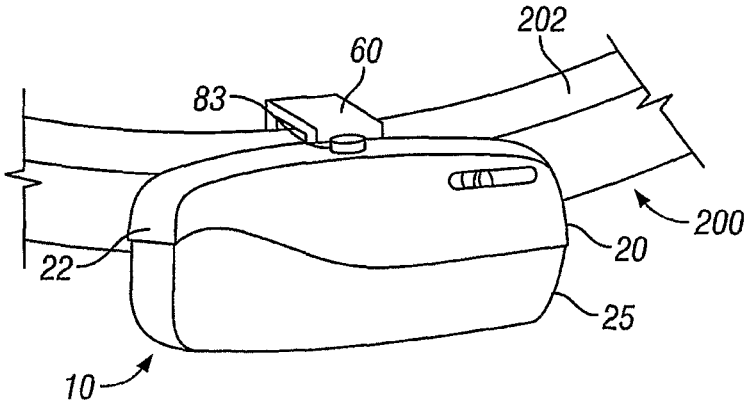
Figure 36B:
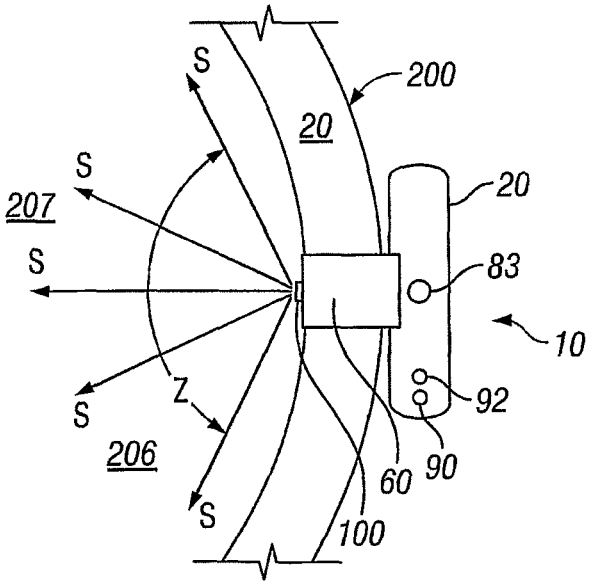

FIGS. 36A and 36B show two further views of a further embodiment of an improved automatic toilet bowl device of the invention, mounted on a section of the rim of a toilet bowl.

Figure 37:
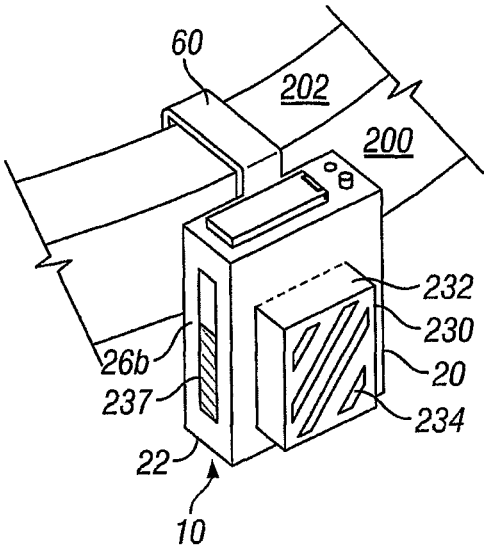

FIG. 37 illustrates an embodiment of an improved automatic toilet bowl device of the invention which further comprises a reservoir comprising a quantity of an air treatment composition.

Figure 38:
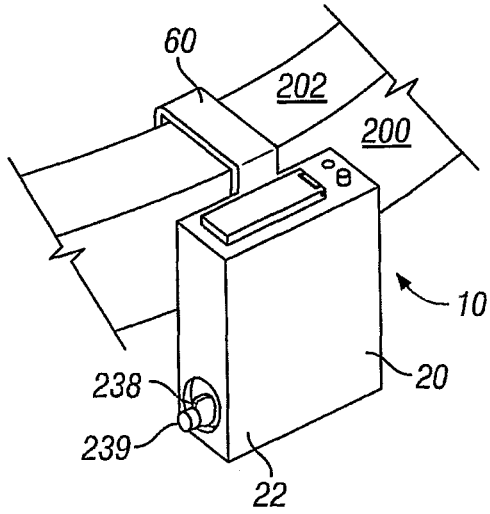

FIG. 38 depicts a further embodiment of an improved automatic toilet bowl device of the invention which further includes a pressurized aerosol canister containing a quantity of an air treatment composition.

Figure 39A:
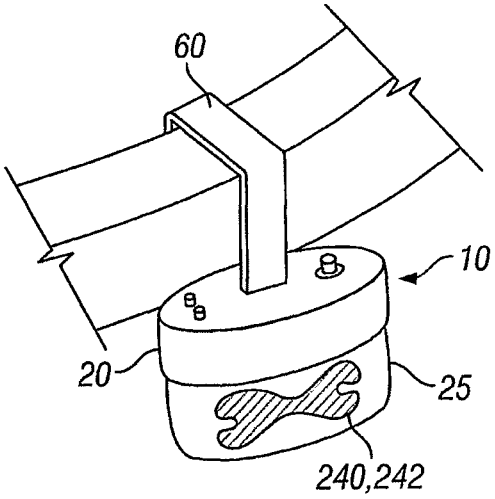
Figure 39B:
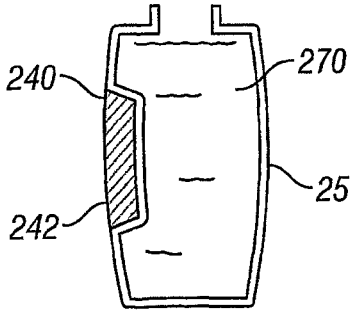

FIGS. 39A and 39B show in two views, an improved automatic toilet bowl device of the invention which includes a refill cartridge which incorporates a quantity of an air treatment composition in the form of a gel.

Figure 40A:
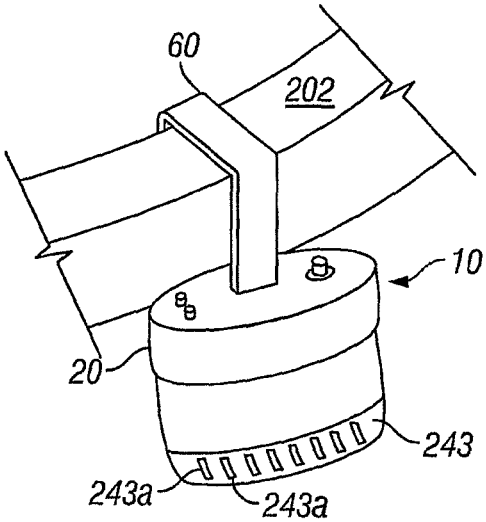
Figure 40B:
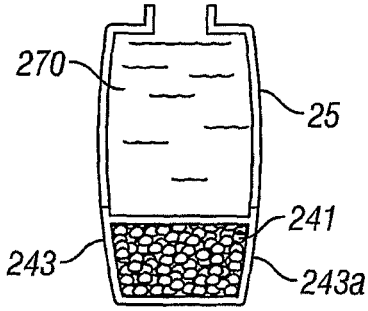

FIGS. 40A and 40B depict in two views, an improved automatic toilet bowl device of the invention which includes a refill cartridge which incorporates a quantity of an air treatment composition in the form of a particulate material.

Figure 41B:
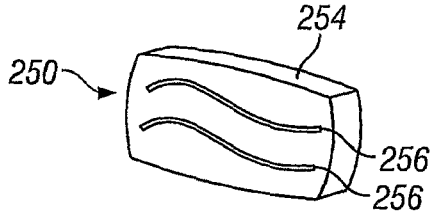
Figure 41A:
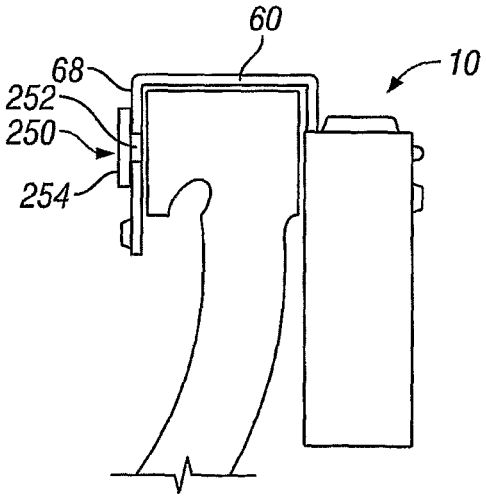

FIGS. 41A, 41B an 41C depict in various views, an improved automatic toilet bowl device of the invention which includes a "passive" air treatment means.

Figure 42A:
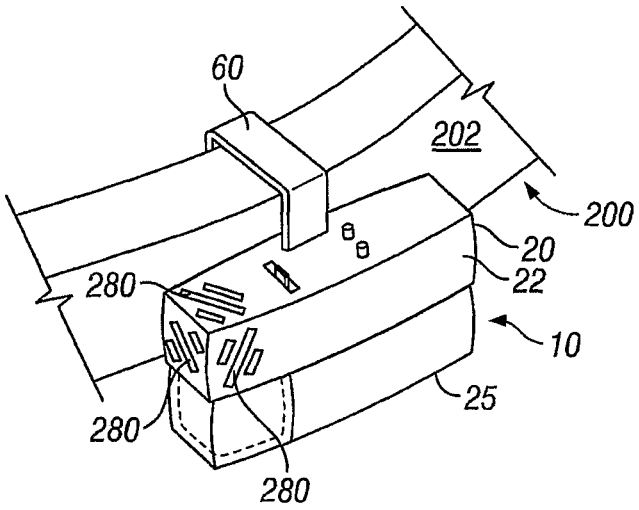
Figure 42B:
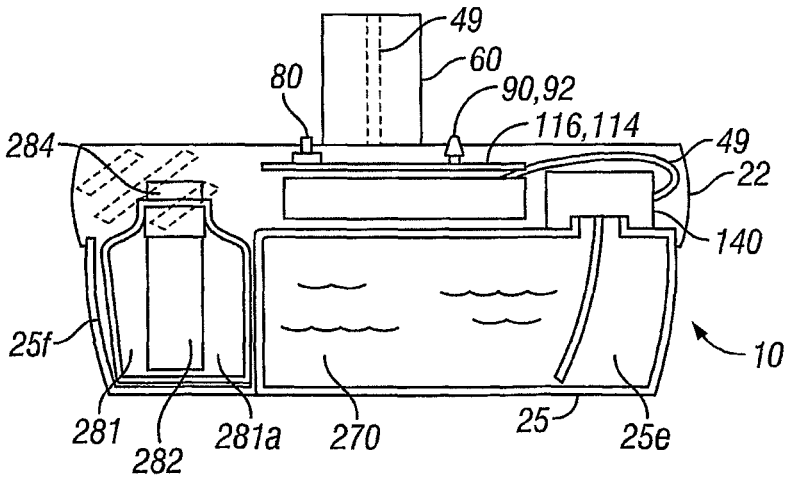

FIGS. 42A and 42B illustrate in various views a device of the invention which includes a further "passive" air treatment means.

Figure 43:
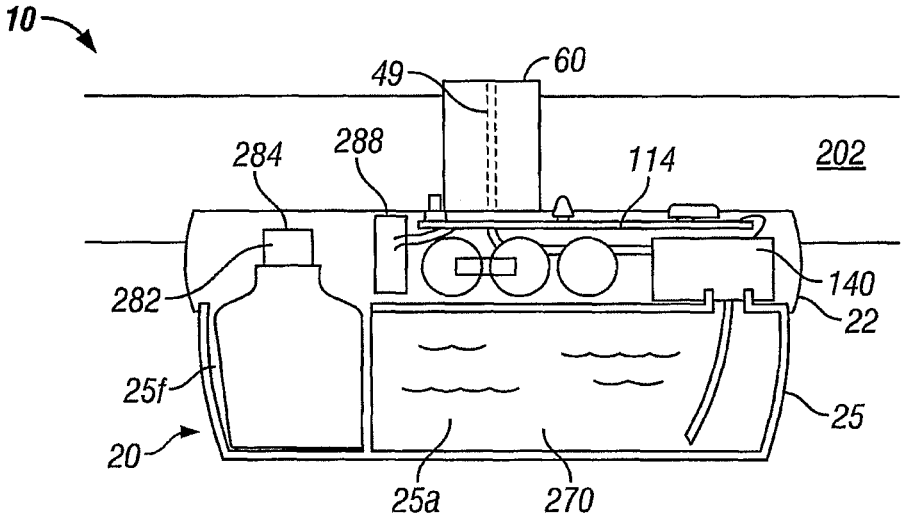

FIG. 43 shows an improved automatic toilet bowl device of the invention which includes an "active/passive" air treatment means.

Figure 44:
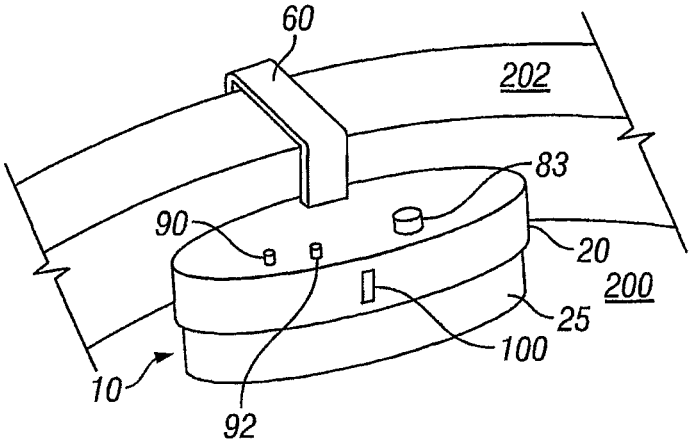

FIG. 44 shows an embodiment of an automatic toilet bowl device of the invention which includes a body mounted within the interior of a toilet bowl.

Figure 45:
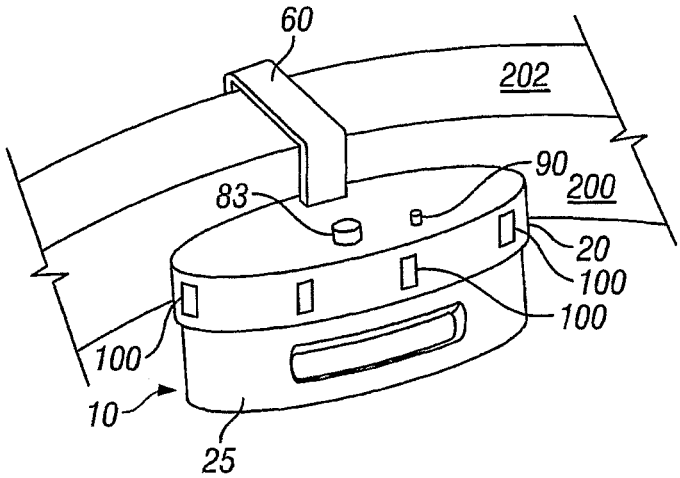

FIG. 45 depicts an embodiment of an automatic toilet bowl device of the invention having a plurality of fluid spray means which includes a body mounted within the interior of a toilet bowl.

Figure 46:
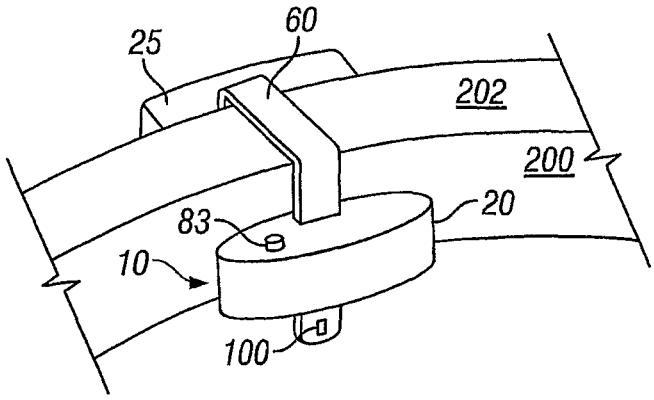

FIG. 46 illustrates a further embodiment of a an automatic toilet bowl device of the invention.

Figure 47A:
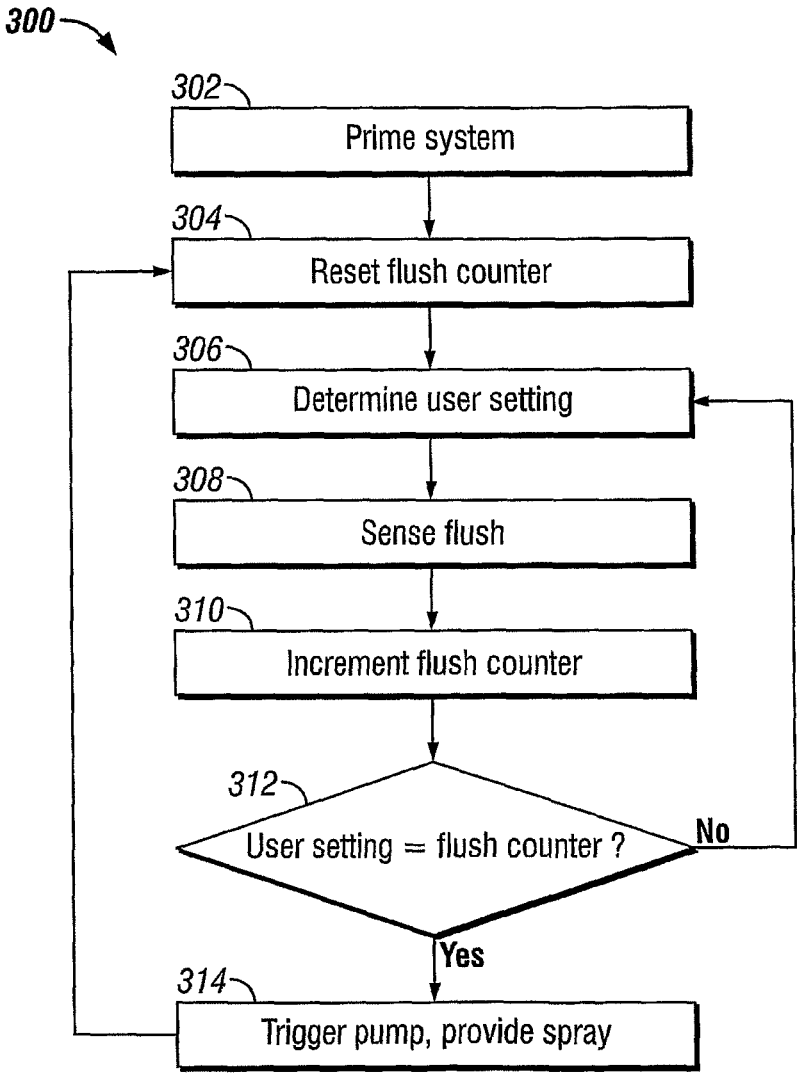
Figure 47B:
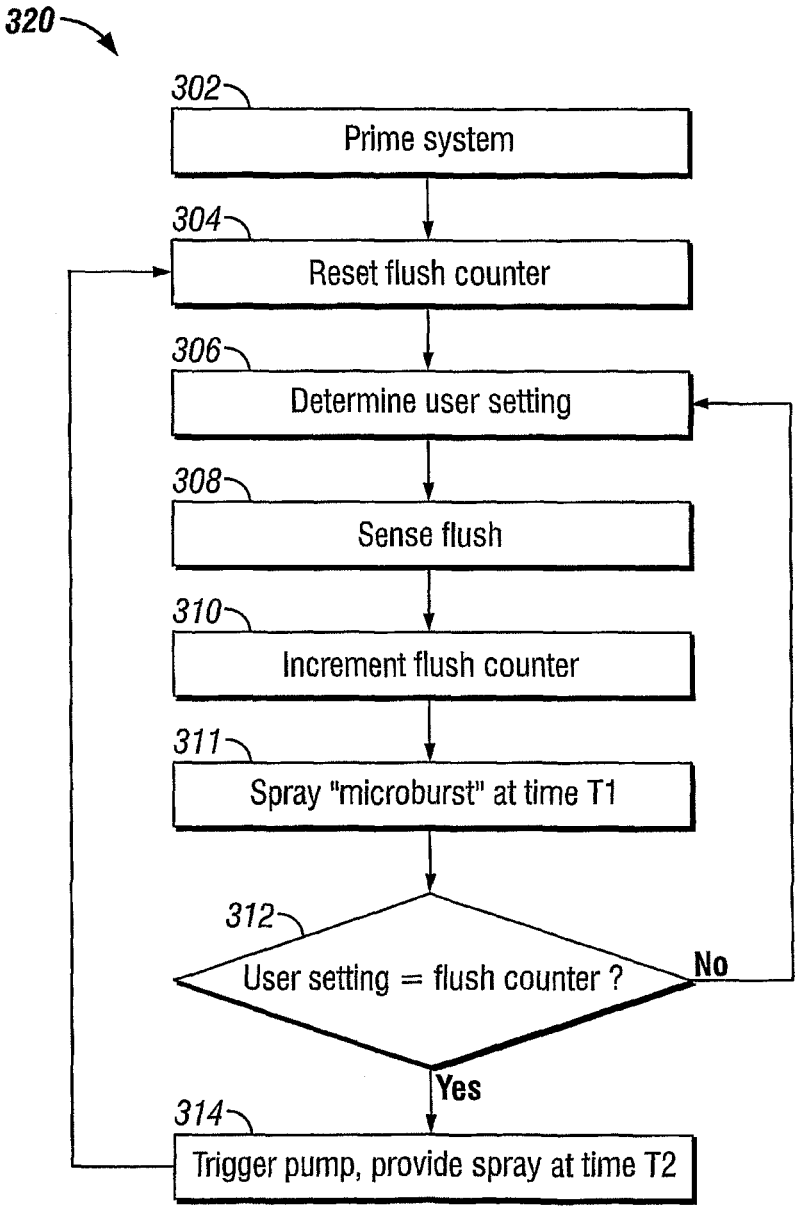

FIGS. 47A and 47B show two examples of a series of process steps useful for controlling the operation of the improved automatic toilet bowl device of the invention.

Figure 47C:
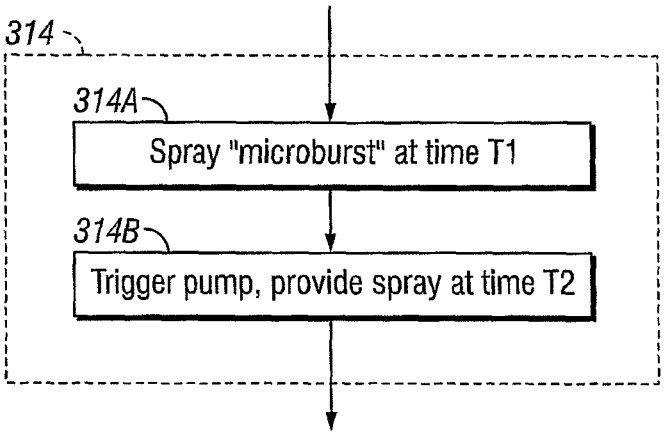

FIG. 47C depicts a further series of process steps useful for controlling the operation of the improved automatic toilet bowl device of the invention.

Generally speaking, in one broad aspect, the present invention provides an improved automatic toilet bowl treatment device, wherein said device comprises: at least one fluid reservoir, a pump means adapted to supply a quantity of fluid contained within the at least one fluid reservoir to a fluid spray means, and a hanger means such that the entire said device may be suspended from a part of a lavatory appliance, and preferably wherein the lavatory appliance is a toilet bowl In certain embodiments the fluid spray means is suspended at or near one end of the hanger means and desirably depends therefrom and is within the interior of a lavatory appliance while the at least one fluid reservoir, a pump means are positioned outside of the lavatory appliance. In certain further embodiments the at least one fluid reservoir, the pump means adapted to supply a quantity of fluid contained within the at least one fluid reservoir to a fluid spray means, and said fluid spray means are suspended within the interior of a lavatory appliance, such as within the interior of toilet bowl, and depend from a hanger means which is affixed from or suspended from a part of a lavatory appliance, preferably a part of a toilet bowl rim.

In particularly preferred embodiments, the entire automatic toilet bowl treatment device is configured so that it can be suspended from, or otherwise affixed to a part of a lavatory appliance, preferably a toilet bowl and in particular, a part of the toilet bowl rim. In certain preferred embodiments, the improved automatic toilet bowl treatment device is generally unobtrusive, and provides for two modes of operation; a first mode of operation which is wholly automatic whereby a quantity of fluid contained from the at least one fluid reservoir is automatically dispensed under certain conditions to the interior surface of the lavatory appliance, and preferably to at least a part of the inner sidewall of a toilet bowl, and, as the second mode of operation, the supply of a quantity of the fluid contained from the at least one fluid reservoir in response to human intervention. In another preferred embodiment, the improved automatic toilet bowl treatment device is generally unobtrusive and provides for a single mode of operation which is fully automatic, whereby a quantity of fluid contained within the least one fluid reservoir is automatically dispensed under certain conditions to the interior surface of the lavatory appliance, and preferably to at least part of the inner sidewall of a toilet bowl.

Advantageously, the at least one fluid reservoir, and the pump means adapted to supply a quantity of fluid contained within the at least one fluid reservoir, is contained within a body part. The body part conveniently contains the pump means as well as the at least one fluid reservoir. The body part may also conveniently contains a controller means, which may be control circuitry used to control the operation of the improved automatic toilet bowl treatment device. Further additionally, the body part may also conveniently contain the power source which may be used to operate the improved automatic toilet bowl treatment device. In certain embodiments, the body part contains within its confines the at least one fluid reservoir which forms a permanent part of the body part whereas, in other embodiments, the body part may be removably coupled to a fluid reservoir refill cartridge in order to define the body part. In the case of the former, there is provided a configuration whereby a user may provide, as may be needed or desired, a further quantity of a fluid or of a liquid treatment composition from a storage vessel or container, such as a bottle, and thus periodically replenish the supply of the fluid treatment composition which is dispensed by the improved automatic toilet bowl treatment device. In the case of the latter, there is provided a device whereby a user may provide a fluid reservoir refill cartridge containing a quantity of a fluid or of a liquid treatment composition such as when a prior fluid reservoir refill cartridge has been at least partially or substantially drained of its contents. The body part may also contain control circuitry, such as logic controllers, semiconductors, timers, and the like as well as further components such as switches, sensors, fans or blowers, sound emitting devices, and the like which may be used to control one or more on the operative characteristics of the automatic toilet bowl treatment device. Frequently, such control circuitry can be provided as part of a module or part of a circuit board which can be configured in order to fit within the physical confines of the body part. A power source is also conveniently supplied as part of the body part. In one aspect, the power supply provided is one or more batteries, such as one or more single use batteries or rechargeable batteries, which can be included in the body part and can be either permanently installed, or may be removable and replaceable within the body part. In a further aspect, the power supply provided is one or more photovoltaic cells. In a still further aspect, the power supply provided is a combination of one or more batteries, and/or one or more photovoltaic panels. In a yet further aspect, the power supply provided is a combination of one or more batteries and/or one or more photovoltaic panels which are used to generate a charge which is stored in one or more capacitors, the discharge of such capacitors which is used to supply power to the pump means. In a still further aspect, the power supply is provided as part of the fluid reservoir refill cartridge which is adapted to be installed in the automatic toilet bowl treatment device. This last aspect provides a very convenient means whereby a user can simultaneously replenish the supply of a fluid or of a liquid treatment composition, as well as simultaneously provide a fresh power source to the device.

Advantageously, the hanger means comprises a proximal end which is connected to the body, and a distal and from which the fluid spray means depends. While the fluid spray means can depend from part of the hanger means, but preferably, depends from, or is otherwise affixed to, or still otherwise forms a part of the hanger means and it is positioned preferably distally beyond the midpoint as measured between the proximal end of the hanger means which is affixed to is adjacent to the body part, and is the opposite distal thereof. More preferably, the fluid spray means depends from, or is otherwise affixed to, or still otherwise forms a part of the hanger means and is positioned at or adjacent to the distal end of the hanger means. Hanger means may be rigid and self-supporting, but preferably the hanger means includes a least one section which is flexible. In certain preferred embodiments, a majority of the hanger means is non-self-supporting and is flexible. It still further preferred embodiments, at least a part of the hanger means includes conformable elements, such as a flexible but bendable rod, wire, sheet or other element which can be manually deformed or otherwise configured to assume a particular three-dimensional shape. In other preferred embodiments, the hanger means is essentially rigid, and is preformed and includes a bend which can be used to define a region between the band and the body of the device which region can it be placed atop the rim of a lavatory appliance such as a toilet bowl, and a second region at the opposite side of the bend which extends downwardly as angled with respect to said former region, and from whose distal end the fluid spray means depends. It still further preferred embodiments, the overall length of the hanger means can be adjusted, such as by the inclusion of a telescoping portion of the hanger means. In yet further preferred embodiments, the hanger means includes a stabilizer means which depends from the hanger means and which can be used to provide improved placement and retention of the hanger means, and therefore the inventive device with respect to a lavatory appliance, and in particular the rim of a toilet bowl. The fluid spray means which depends from a part of the hanger means is advantageously an element or a device which at one end or part thereof receives a fluid and at the other end, expels the fluid in the form of a spray. Preferably, the fluid spray means provides a patterned spray that is to say, any spray which has an angular spread or angular width which is at least 30° of arc, preferably at least 45° of arc as measured from the point of the spray exiting the fluid spray means. In certain embodiments, the fluid spray means comprises moving parts. In still further embodiments, the fluid spray means comprises a fluid oscillator. The hanger means preferably also includes a fluid conduit which provides a path for supplying the treatment composition from the body part to the fluid spray means. Advantageously, the fluid conduit is a flexible element and may be separate from the hanger means, or may be affixed thereto or may run adjacently thereto or adjoining thereto but, in certain further preferred embodiments the fluid conduit is an integral part of the hanger means. A plurality of fluid conduits may be present in the device. The hanger means may include one or more fluid conduits.

The pump means of the inventive device may be any pump which may effectively transfer a quantity of the treatment composition from the at least one fluid reservoir, to the spray means either directly or indirectly. While the pump means may be non-electrically powered and may be manually or pneumatically operable, preferably the pump means is electrically operated, viz, an electrically driven pump. By way of non-limiting example such an electrically operated pump may be a gear pump, an impeller pump, a positive displacement pump, a rotary pump, a piston pump, a screw pump, a peristaltic pump, a diaphragm pump, or any other pump which may be incorporated into the improved automatic toilet bowl treatment device.

Optionally but in certain embodiments, preferably, the improved automatic toilet bowl treatment device further includes an air treatment means. Such an air treatment means deliver a quantity of an air treatment composition or an air treatment constituent to the ambient environment within which the lavatory appliance bearing the device of the invention, preferably the toilet bowl, is located. It is to be understood that the air treatment means may provide either a primary air treatment composition in the case wherein the treatment composition supplied from the fluid reservoir includes no air treatment constituents, or that the air treatment means may provide an ancillary air treatment composition in the case where the treatment composition supplied from the fluid reservoir includes an air treatment constituent. Such air treatment constituents may be any fragrance or perfume composition, may be any odor treatment, odor masking or odor neutralizing composition, may be an insecticidal composition, or may be any air sterilizing compositions, or may be mixtures of any of the foregoing. For example, it is clearly contemplated that various combinations of air treatment constituents can be provided from the improved automatic toilet bowl treatment device according to the invention such as: providing one or more air treatment constituents to the treatment composition supplied from the fluid reservoir or fluid reservoirs whereby said air treatment constituents or dispensed from the fluid spray means and primarily into the interior of the lavatory appliance, preferably into the interior of a toilet bowl, while simultaneously providing one or more different air treatment constituents in a further air treatment means, wherein said different air treatment constituents are dispensed directly to the ambient environment within which the lavatory appliance is located. Such an arrangement is particularly desirable in situations where it may be desired to provide a discernible "boost" of a fragrance or a perfume to the interior of a toilet bowl concurrent with the dispensing of a quantity of the treatment composition, which is dispensed at periodic intervals or on-demand, while providing on a more continuous basis the delivery of a further air treatment composition it to the ambient environment within which the lavatory appliance. The further air treatment composition dispensed to the ambient environment may be the same as, or may be different than the fragrance or perfume supplied with the treatment composition dispensed to the interior of the toilet bowl.

While the delivery of a fragrance or perfume represent examples of air treatment constituents which may be delivered by the air treatment means, such are not limiting examples and further exemplary useful air treatment constituents include one or more of one or more constituents selected from: perfumes, fragrances, odor masking constituents, odor counteracting constituents, odor neutralizing constituents, air sanitizing/disinfecting constituents (such as one or more glycols, and in particular triethylene glycol) insecticides, or pesticides.

The improved automatic toilet bowl treatment device according to the invention can be operated according to in the number of a varying modes. Advantageously, the improved automatic toilet bowl treatment device includes a least a first automatic mode which provides for automatic dispensing of the liquid treatment composition from the body part to a lavatory appliance. This first automatic mode causes the dispensing of the liquid treatment composition according to preestablished conditions. Such conditions may be a time interval which may be periodic. In its simplest mode of operation, the automatic mode is one whereby a controlled uniform quantity of the liquid treatment composition is dispensed at uniform time intervals on a periodic basis. For example, according to one such automatic mode, a quantity, e.g., from 0.5-5 ml. of a liquid treatment composition is dispensed from the improved automatic toilet bowl treatment device to the interior of a lavatory appliance, viz., the interior of a toilet bowl at certain repeated time periods, e.g. 30 minutes to 24 hours. Inc. according to further possible mode of operation, the automatic mode is one whereby a controlled uniform quantity of the liquid treatment composition is dispensed responsive to a signal input, or in the signal input may be the detection of any flushing the operation of the toilet bowl. For example, according to such an automatic mode, a quantity of the liquid treatment composition is dispensed from the improved device of the invention to the interior of the lavatory appliance, preferably to the interior of the toilet bowl at a time period relative to the flushing the operation, which can be in any time intervals such as concurrently there with, or at some time interval following the initiation of how more the conclusion of the flush cycle. Advantageously, in order to provide a quantity of the liquid treatment composition to the interior sidewalls on the toilet bowl, according to such an automatic mode a quantity of the liquid treatment composition is dispensed at lease several seconds following the initiation of the flush cycle, but his preferably dispensed at a time interval of between 5-120 seconds following the initiation of the flush cycle, and preferably at a time interval of between 15-120 seconds following the initiation of the flush cycle. In this manner, the quantity of the liquid treatment composition dispensed is advantageously and effectively deposited upon the sidewalls onto the interior of the toilet bowl and a not too quickly washed away by the flush water. According to a still further automatic mode, a quantity of a liquid treatment composition is dispensed from the improved automatic toilet bowl treatment device to the interior of a lavatory appliance in response to a signal input. Such a signal input can be for example, a significant change in light intensity, such as might be occasioned by the turning on or turning off of a bathroom light in which case, the improved device can be programmed to once dispense a quantity of the liquid treatment composition either immediately subsequent to, or after a brief time delay, such as a delay of from 1-120 seconds after the light is turned off. A further signal input can be, for example, a switch such as a momentary contact switch or a pushbutton switch which, when activated by a user, initiates either the immediate dispensing, or the delayed dispensing of a quantity of the liquid treatment composition from the device. Such may for example be a desired mode of operation wherein a user on lavatory appliance may choose to have dispensed a quantity of the liquid treatment composition after the toilet has been used. A signal input may also cause a pause or delay in the programmed dispensing of a quantity of the liquid treatment composition from the device such as, when the device is supplied with a sensor which detects the near proximity of a human user such as via a heat sensor, an infrared sensor, or a passive infrared sensor. One or more such sensors which detect the near proximity of a human user so that the dispensing of the liquid treatment composition is delayed until a specific sensor condition, such as the departure of the human user from the proximity of the lavatory appliance, is determined. In this manner, the use of such a sensor to cause a pause or delay in the programmed dispensing is advantageous in order to avoid undesirable or untimely spraying of the liquid treatment composition so avoid contact of the same with the human user. A still further form of a sensor would be an audible sensor, wherein the ambient sound level of the improved automatic toilet bowl treatment device is determined it on a continuous basis, or on a periodic basis. In the case of a continuous basis, a sensor provided with the device samples the ambient sound level and may cause the dispensing of a quantity of the liquid treatment composition in response to a particular sound event, i.e., the sound of the flushing toilet. In the case of a periodic basis, a sensor provided with the device samples the ambient sound level and may cause the dispensing of a quantity of the liquid treatment composition in response to a predetermined length of time wherein no change in the ambient sound level, viz. a further sound event, has been determined by the device according to the invention, where it is presumed that no human user has entered or exited the near proximity on the lavatory appliance. In any case, the dispensing of the liquid treatment composition can be an immediate response to the sound event, or can be delayed to a point in time after the sound event.

The improved automatic toilet bowl is according to the invention can also optionally be supplied with one or more further indicator means which provide a user discernible signal responsive to certain events or responsive to certain conditions in the said device. Without limitation, such indicator means may be visually discernible or audibly discernible. For example, one or more indicator means, such as lights, or preferably low-voltage light emitting diodes (LEDs) can be provided and can be programmed to operate responsive to certain conditions. For example, the one more indicator means can provide an indicator of the status of the dispensing of the liquid treatment composition; the status of the level of liquid or fluid in the fluid reservoir or refill cartridge, an audible sound source can be provided to provide an audible sound or signal, which can be as simple "beep", or can be a song, tune, or melody to indicate the particular status of the device. For example, again such a status could be the lack of a sufficient amount of liquid or fluid in the fluid reservoir or refill cartridge, or an indicator of the status of the dispensing of the liquid treatment composition. For example, it may be advantageous to provide both a visible signal indicator means such as one or more lights, concurrent with an audible sound immediately prior to, or during the dispensing of the liquid treatment composition so that a human user who may be in the proximity on the device may either choose to leave the proximity, (such as by simply standing up,) or lower the toilet lid if so desired so do minimize the risk of any overspray of the liquid treatment composition about to be dispensed, or being dispensed by the device to the interior on the toilet bowl.

These aspects and still further aspects of features of the improved devices according to the invention are described with reference to the following figures which provide both representative, as well as certain preferred embodiments of the present invention. It is to be clearly understood that while certain elements and aspects of the invention may be described with reference to a particular embodiment according to a particular figure, such as not to be understood as limiting but only representational and do that, such elements and aspects can be interchanged and used in a different embodiments according to the invention especially as may be disclosed amongst the different figures. Also, wherever possible in the figures, like numerals refer to like or similar elements albeit in different embodiments.

FIG. 1A discloses in a perspective view an embodiment of an improved automatic toilet bowl device 10 according to the invention which shown to be suspended from a section of a toilet bowl rim 202 of a toilet bowl 200. The device 10 comprises a body 20 depending from a hanger means 60 which is engaged upon a section of the toilet bowl rim 202, and thereby suspending the body 20. With respect to the body 20, the body 20 includes a housing 22 having a bottom 24, and opposite thereto a top face 26*a*, a front sidewall 26, and left sidewall 26*b*, a right sidewall 28, and a rear sidewall 30; the aforesaid define an interior volume within the body 20. As visible from the figure, the hanger means 60 has a proximal end 62 which is affixed to a part of the body 20, a first hanger segment 64 which extends from the body 20 and continues to a second hanger segment 66, which second segment lies atop of or alternately extends generally parallel to the top surface 204 of the toilet bowl rim 202, which segment extends to a third hanger segment 68 which extends beyond the margin of the top surface 204 of the toilet rim 202 and extends downwardly towards the interior of the toilet bowl. While not visible in this figure, it is understood that proximate to the distal end 69 of the hanger means 60 is present the fluid spray means 100. Also visible as elements on the body 20 are a switch 80, here depicted as a sliding-type switch which can be moved through several positions which establish different states of the switch, as well as a pair of a visual indicator means here a first LED 90 and a second LED 92. The body 20 also includes atop its top face 26*a* a refill door 50 which is affixed at one thereof by a door hinge 52. They refill door 50 provides access from the exterior and ambient environment to the interior of the body 20. Preferably, the refill door 50 provides a sealable opening through which a quantity of a liquid treatment composition can be supplied from a storage vessel or bottle and into the interior of the device 20 according to the invention. The need to refill the device 10 with a quantity of a liquid treatment composition can be indicated by the device 10, for example by one or both of the visual indicator means 90, 92 or by means of an audible signal which may be emitted from the device 10 when refilling is required or by simple inspection of device 10 by a human consumer or user.

FIG. 1B presents in a top, plan view the device 10 illustrated on FIG. 1A, illustrating the relationship of the device 10 with the part of the rim 202 of the toilet bowl 200. As is seen from that figure, it is clearly to be understood that the entire device 10 according to the present embodiment of the invention as depicted is suspended from the rim 202 of the toilet bowl 200. As is further visible on the figure, the third hanger segment 66 is mostly positioned within the interior of the toilet bowl 206 of the toilet 200 and extends downwardly towards the interior of the toilet bowl 206, where, at or near the distal end 69 thereof is located the fluid spray means 100.

With reference now to FIG. 1C, which shows a side cross-sectional view of the toilet bowl and the device 10 of the invention suspended from a portion of the rim 202, therein is visible the respective relationship of the hanger means 60, the fluid spray means 100, the body 10 and the toilet bowl 200. As is visible thereon, the body 20 of the device 10 is suspended by the hanger means 60 and hangs downwardly from the toilet bowl rim 202 and on the exterior thereof, while the fluid spray means 100 is contained within the interior of the toilet bowl 206 and is directed inwardly with respect to the toilet bowl, that is to say in a direction away from the body 20 of the device 10. Furthermore, as is visible from FIG. 1C, a hanger means 60 further includes in this embodiment a rearwardly directed hook 70, which extends from the third hanger segment 66 in the direction of the body 20, wherein the hook 70 is near or adjacent to the distal and 68 the hanger means 60. The relationship of the hook 70 is such that it is desirably dimensioned such that it can extend rearwardly from the hanger means 60 just beneath the bottom interior bottom margin 208 of the toilet bowl rim 202. Ideally, the hook 70 rests against, abuts, or otherwise at least partially comes into contact with the bottom interior bottom margin 208 of the toilet bowl rim 202 and in certain embodiments, can bear at least part of the weight of the body 20 of the device 10 being suspended from the toilet bowl rim 202. Such is particularly applicable wherein the hanger means 60 is flexible, or is at least partially formed of a flexible material. However, in the embodiment illustrated in FIGS. 1A, 1B, and 1C it is to be understood that the hanger means 60 is formed of a generally rigid material and is only sufficiently partially flexible to permit for the mounting of the hanger means 60 of the device 10 onto a part of the toilet bowl 200.

FIG. 2 depicts a partial cross-sectional view of a further device 10 according to the invention. In this view, the device 10 includes a body part 20 which is substantially the same as depicted in prior FIGS. 1A, 1B, and 1C but comprises a different hanger means 60 and different hook 70. As can be seen from the figure, a hanger means 60 is in the form of an a flexible hanger which at its proximal end 62 is affixed to a part of the body 20 and extends upwardly and continuously through first hanger segment 64 which substantially to the exterior of the toilet bowl 200, thence to the second hanger segment 66 which spans the top surface 204 of the toilet rim 202, and thereafter continues to the third hanger segment 68 to which extends downwardly and into the interior of the toilet bowl 206, wherein from the distal end 69 depends the fluid spray means 100. In this embodiment, there is also provided a hook 70 which extends rearwardly from the hanger means 60 and forms a part of the fluid spray means 100 as is depicted. A part of the hook 70 abuts the bottom interior bottom margin 208 of the toilet bowl rim 202 and in this embodiment, it is to be understood that ads at the hanger means 60 is made of a flexible material, that a part of the weight of the body 20 is suspended from the contact point between the hook 70 and the bottom interior bottom margin 208 of the toilet bowl rim 202. In this manner, the hook 70 provides two simultaneous functions; a first function being a supporting stop or anchor for supporting at least part of the mass or weight of the body part 20 of the device 10, and the second function being and automatic alignment function whereby the relative placement of the fluid spray means 100 with respect to the toilet bowl rim 202, and especially with respect to the bottom interior bottom margin 208 of the toilet bowl rim 202 can be easily and automatically established by the suitable configuration of the relative size and placement of the hook 70 with the relative size, placement, and direction of the outlet of the fluid spray means 100. In this manner then, particularly when a hanger means 60 is at least partially flexible and conformable to the contour and dimensions of the toilet bowl rim 202, a form of the device 10 of the invention can be provided whereby the device 10 can be nearly universally accommodating to the various contours of toilet bowl rims as found on toilet bowls around the world. Namely, it is to be understood that the more critical relationship is the appropriate positioning of the fluid spray means 100 and its outlet with respect to the interior of the toilet bowl 206 upon which the device 10 of the invention is mounted, and such can then be generally reliably and automatically established—without significant user intervention—by providing a fluid spray means 100 and/or a hanger means 60 and/or a hook 70 whereby the relationship between the fluid spray means 100 and both the angle and the direction of its fluid outlets is established to be generally horizontal, or at least partially directed to downwardly towards the interior 206 of the toilet bowl 200. The fact that the weight or mass of the body 20 can be relied upon as a means for tensioning the hanger means 60 especially when the hanger means 60 is at least partially flexible, but especially preferably when it is substantially flexible along its length, provides a reasonable degree of certainty that the initial placement of the fluid spray means 100 and its outlets will not be disturbed and, ideally the configuration of the hanger means 60 and/or hook 70 (when present) can be established to ensure the proper placement of the fluid spray means 100 so that the sprayed liquid treatment composition being delivered therethrough is directed at least partially laterally towards the sidewall on the interior 206 of the toilet bowl 200 such that desirably, a major quantity on the liquid treatment composition being dispensed via the fluid spray means 100 impinges on the sidewall and/or the fluid into the sump (drain, outlet) of the toilet bowl 200.

With respect now to FIG. 3, the figure depicts a further partial cross-sectional view of a further embodiment of a device 10 according to the invention. In this view, the device 10 includes a body part 20 which is substantially the same as depicted in prior FIGS. 1A, 1B, and 1C but comprises a different hanger means 60, and which omits a hook 70. As can be seen from the figure, the hanger means 60 is in the form of an a flexible hanger which at its proximal end 62 is affixed to a part of the body 20 and extends upwardly and continuously through first hanger segment 64 which it is a substantially to the exterior of the toilet bowl 200, thence to the second hanger segment 66 which spans the top surface 204 of the toilet rim 202, and thereafter continues to the third hanger segment 68 to which extends downwardly and into the interior of the toilet bowl 206, wherein from the distal end 69 depends the fluid spray means 100. In this embodiment, a hook 70 is omitted and there is no contact point between the fluid spray means 100 and the toilet bowl rim 202. Rather, it is seen that while the hanger means 60 may be formed of a flexible material, intermediate the toilet bowl rim 202 and a part of the hanger means 60, namely between the third hanger segment 60 feet and the toilet bowl rim 202 is depicted an embodiment of the hanger attachment means 71, here a suction cup which is used to removably affix the device 10 to the toilet bowl 200 at a portion on the rim 202 thereof. This embodiment illustrates that the device 10 may be suspended a part of a toilet bowl 200 and wherein, and hanger means 60 and/or a hook 70 (when present) provides the primary means for positioning the device 10 and the fluid spray means 100 with respect to the toilet bowl 200 and its interior 206. Whereas in this depicted embodiment the hanger attachment means 71 is provided by a suction cup, is to be understood that any other suitable removable attachment means, or device, or material can be used. Coming into consideration include physical fastening elements such as clips, wires, screws, brackets and the like; as well as chemical fastening means such as adhesives which may be positioned intermediate parts of the hanger means 60 and a part of the toilet bowl 200, or holders or hangers which are removably affixed by an adhesive to part of a toilet bowl 200 and in particular to a part of the toilet bowl rim 202 which may engage a part of the device 10 of the present invention.

With regard now to FIG. 4, therein is illustrated in a partial cross-sectional view of a further device 10 according to the invention. In this view, the device 10 includes a body part 20 which is substantially the same as depicted in prior FIGS. 1A, 1B, and 1C but comprises a different hanger means 60 and hook 70 which is integrated with the fluid spray means 100. As can be seen from the figure, a hanger means 60 is in the form of an a flexible hanger which at its proximal end 62 is affixed to a part of the body 20 and extends upwardly and continuously through first hanger segment 64 which it is a substantially to the exterior of the toilet bowl 200, thence to the second hanger segment 66 which spans the top surface 204 of the toilet rim 202, and thereafter continues to the third hanger segment 68 which extends downwardly and into the interior 206 of the toilet bowl 206, wherein from the distal end 69 of the hanger means 60 depends the fluid spray means 100. In this embodiment, a hook 70 which is integrated with the fluid spray means 100 extends rearwardly from the hanger fluid spray means 100 and extends upwardly and into the toilet bowl rim channel 210, and wherein a part of the hanger fluid spray means 100 abuts the interior bottom margin 208 of the toilet bowl rim 202. As is visible, at least a part of the hook 70 extends upwardly beyond the interior margin 208 of the toilet bowl rim 202 and into the interior of the toilet bowl rim channel 210. As is further visible in FIG. 4, emanating from the outlet of the fluid spray means 100 is represented a pattern of directional spray lines "s" which are indicated to represent the direction of the flow of the liquid treatment composition and being dispensed from the device 10. As is visible from that figure, the direction of the dispensed liquid treatment composition is outward from the orifice of the fluid spray means 100 and primarily into the interior of the interior 206 of the toilet bowl 200.

Turning now to FIG. 5, there is illustrated in a partial cross-sectional view of a further device 10 according to the invention. In this view, the device 10 includes a body part 20 which is substantially the same as depicted in prior FIGS. 1A, 1B, and 1C but comprises a different hanger means 60 and hook 70 integrated therewith. As can be seen from the figure, a hanger means 60 is in the form of an a flexible hanger which at its proximal end 62 is affixed to a part of the body 20 and extends upwardly and continuously through first hanger segment 64 which it is a substantially to the exterior of the toilet bowl 200, thence to the second hanger segment 66 which spans the top surface 204 of the toilet rim 202, and thereafter continues to the third hanger segment 68 which extends downwardly and into the interior 206 of the toilet bowl 206, wherein from the distal end 69 of the hanger means 60 depends the fluid spray means 100. In this embodiment, a hook 70 which is integrated with the hanger means 60 extends rearwardly and a part of which extends upwardly and into the toilet bowl rim channel 210. Thus, as is visible, at least a part of the hook 70 extends upwardly beyond the interior margin 208 of the toilet bowl rim 202 and into the interior of the toilet bowl rim channel 210. As is further visible in FIG. 5, the distal end 69 of the hanger means 60 is a segment of the hanger means 60 which is however angled by an angle "x" with respect to the third hanger segment 68, such that the direction of the exit orifice of the fluid spray means 100 is downwardly directed into the interior 206 of the toilet bowl 200. As is visible from the figure, there are also provided representational spray lines "s" representing the direction of the sprayed liquid treatment composition emanating from the fluid spray means 100 which, due to the angled relationship of the distal end 69 of the hanger means 60 with respect to the third hanger segment 60, as well as with respect to the face of the inner toilet rim sidewall 212 indicate the direction of the flow of the liquid treatment composition being dispensed from the device 10. As is visible from that figure, the direction of the dispensed liquid treatment composition is outward from the orifice of the fluid spray means 100 and primarily laterally and downwardly into the interior of the interior 206 of the toilet bowl 200.

Figure 7:
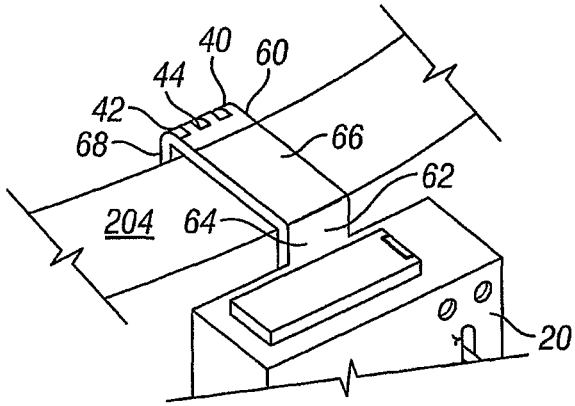

FIGS. 6 and 7 depict two views of a further embodiment of a further device 10 according to the invention. In this view, the device 10 includes a body part 20 which is substantially the same as depicted in prior FIGS. 1A, 1B, and 1C but comprises a different hanger means 60 and hook 70 integrated therewith. As can be seen from these figures, the hanger means 60 is formed from two jointed, articulated portions, a first portion comprising the proximal and 62 of the hanger means 60, the first hanger segment 64 and the second hanger segment 66, which terminates in a first part 40 of a hinge type joint, which is connected by the second part 42 of a hinge type joint from which extends the third hanger segment 68, at the distal end 69 thereof is located the fluid spray means 100, and extending rearwardly from a portion there of a hook 70. In this embodiment, the portions of the hanger means 60 may be formed of a rigid material, or only slightly flexible material, as the primary flexibility out of the hanger means 60 is to be understood to reside primarily from the action of the hinge type joint 40, 42. As part of the hinge type joint 40, 42 there is optionally but preferably, as shown, provided a spring 44 which is configured so to urge the third hanger segment 68 towards the first hanger segment 64. Such provides a degree of compression between portions of the hanger means 60, and in particular between the first hanger segment 64 and the spaced apart, third hanger segment 68 between which a portion of the rim 202 of the toilet while 200 may be grasped.

Figure 8:
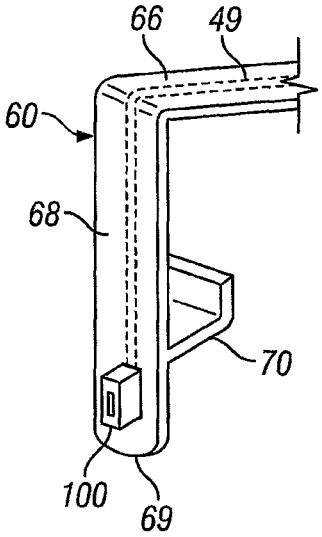
FIG. 8 illustrates in a perspective view a portion of an embodiment of a hanger means.

Turning now to FIG. 8 there is depicted in a perspective view a portion of a representational hanger means 60. The purpose of this illustration is to point out that in preferred embodiments of the invention, the hanger means 60 also includes a fluid conduit 49 which provides a path for supplying the treatment composition from the body part of the device of the invention to the fluid spray means 100. Advantageously, the fluid conduit is a flexible element and may be separate from the hanger means and merely affixed or run adjoining thereto but, in certain further preferred embodiments as is illustrated in FIG. 8, the fluid conduit 49 is integrally formed with the hanger means 60. While in the embodiment of FIG. 8 a hanger means 60 having a single fluid conduit 49 is illustrated, such as the understood as being provided by means of illustration and not by means of limitation. And more particularly, hanger means 60 may include, or have associated therewith, two or more fluid conduits. It is also to be understood that the prior discussion of the representations of devices 10 in the prior figures, as well as in certain of the following figures, presumes the presence of a fluid conduit 49 either integrally formed with the hanger means 60 or otherwise associated therewith.

Figure 9:
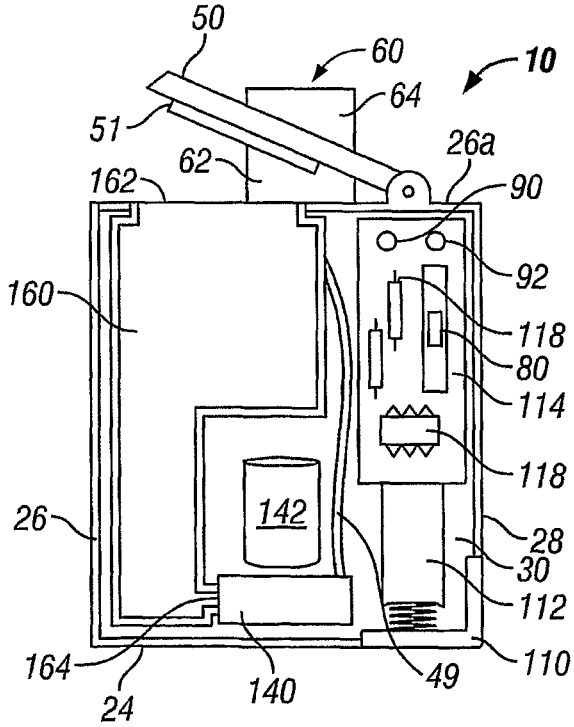
FIG. 9 shows a cross-sectional view of the interior of the the improved automatic toilet bowl device of FIG. 1A.

With respect now to FIG. 9, there is depicted in cross-sectional view a representational interior of the device 10 according to prior FIG. 1A. As is visible therefrom, the body 20 includes a housing 22 having a bottom 24, and opposite thereto a top face 26*a*, and left sidewall 26*b*, a right sidewall 28, and a rear sidewall 30; the aforesaid define an interior volume within the body 20. As visible from the figure, the hanger means 60 has a proximal end 62 which is affixed to a part of the body 20, a first hanger segment 64 which extends from the body 20 and which continues to a second hanger segment (not shown). Forming part of the housing 22 is a movable battery cover 110 which can swung away or alternately may be replaceably removed with respect to the housing in order to provide access for a user to insert one or more batteries 112. The one or more batteries 112, may be one or more single use batteries or may be rechargeable batteries which provide a power supply to operate the a controller means 114 which is used to control circuitry used to control the operation on the improved automatic toilet bowl treatment device 10. The controller means comprises a circuit board 116 upon which are mounted one or more electronic components 118, as well as switch 80 and indicator means, LEDs 90, 92. A controller means 114 obtains its power from the one or more batteries 112, and controls the operation of the device 10, and more particularly, controls the operation of the pump 140 which is operated by an electrical motor 142 responsive to appropriate signals provided by the controller means 114. As is further visible from the figure, within the body 20 is provided a fluid reservoir 160 which is used to contain a quantity of a liquid treatment composition. The fluid reservoir 116 includes an inlet 162 which is positioned at the top face 26*a* of the housing 22, which inlet may be open or closed to the ambient environment by displacement of the refill door 50 which includes a gasket 51 which forms a liquid tight seal with the inlet 162 of the fluid reservoir 116 when the refill door 50 is in a closed position. In FIG. 9, the refill door 50 is in any "partially open" position. The fluid reservoir 116 also includes an outlet 164 through which any liquid treatment composition present in the fluid reservoir 116 passes to the pump 140. Due to the operation of the pump 140, via the controller means 114, under appropriate conditions a quantity of the liquid treatment composition is provided from the pump 140 into the fluid conduit 49, via which is transported to the fluid spray means 100.

It is to be understood that the elements of, and the arrangement of the elements depicted in FIG. 9 are merely for purposes of illustration, and are not to be understood in any way, or manner, as limiting the scope of the presently claimed invention. Other arrangements of the individual elements, as well as the inclusion of still further ancillary elements are contemplated to be useful and are intended to fall within the scope of the present invention.

Figure 10C:
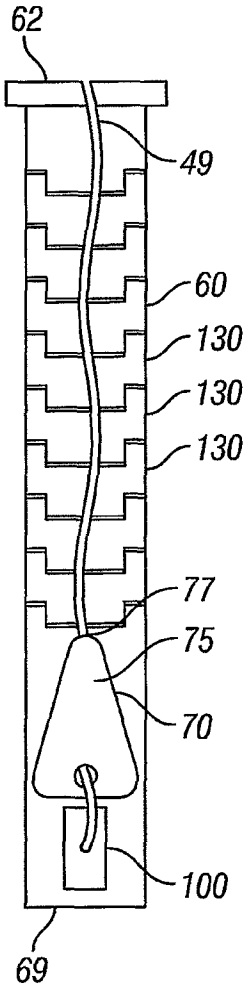
FIGS. 10A, 10B and 10C depict alternative views of an embodiment of a hanger means.
Figure 10B:
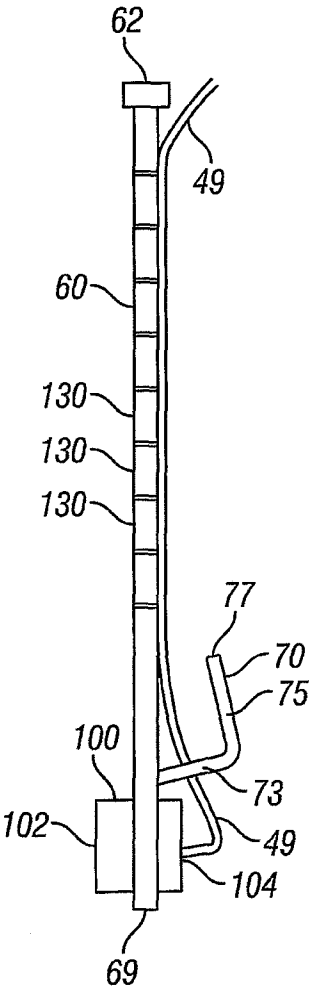
Figure 10A:
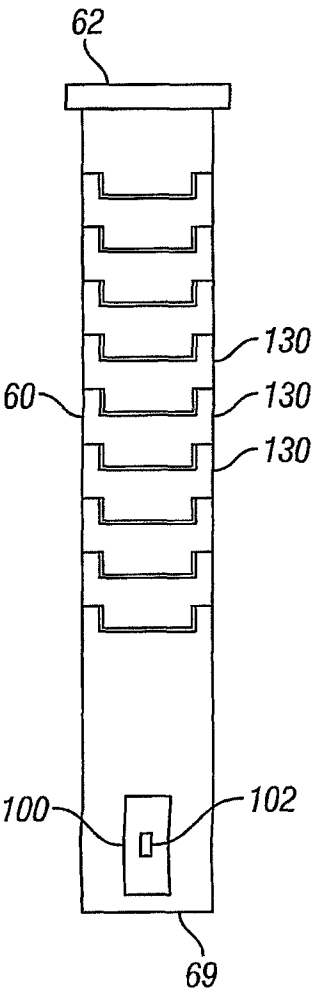

FIGS. 10A, 10B and 10C illustrate separate views of an embodiment of hanger means 60 according to certain preferred embodiments of the invention. In these figures, the hanger means 60 understood as to be in a fully extended, flat type configuration as it is further to be understood that the represented hanger means 60 are at least partially flexible. With respect first to FIG. 10A, the hanger means 60 includes a proximal end 62, and a distal end 69 adjacent to the latter of which is positioned and passing partially there through a fluid spray means 100 having an exit orifice 102. Further visible are a series of interconnected link segments 130 which allow for the rotational displacement of two adjacent links by least 45° with respect to one another, preferably by least 60°, and most preferably allow for the rotational displacement of two adjacent links by least at 90° with respect to one another. Such links are known from other articles, i.e. wristwatch bands. Thus it is to be understood that not all of the hanger means 60 need to be made up of such links, but desirably that portion of the hanger means 60 which are intended to span the top surface 204 of the toilet bowl rim 202 comprise one or more of such links. Desirably at least one third of the total length between the proximal and distal ends of the hanger means 60, yet more preferably at least one half, and still more preferably a least ⅗ of the total length between the proximal and distal ends of the hanger means 60 are comprised of two or more adjacent link segments 130. Turning now to FIG. 10B, therein is depicted a side view of the hanger means 60. As is visible from the figure, the fluid spray means 100 extends through the distal end 69 of the hanger means 60 and includes both an exit orifice 102 and an inlet 104, the latter of which is connected to the fluid conduit 49 which runs adjacent to the hanger means 60 in opposite from the front therefrom so that it is hidden from view when the device 10 is installed on a toilet bowl. It is to be understood that the fluid conduit 49 is flexible and thus may lie between portions of the hanger means 60 and portions of the toilet bowl rim 202. As is further visible from the figure, depending from, and extending rearwardly outwardly from a portion of the hanger means 60 is a hook 70 which includes a proximal end 73 which is connected to and depends from the hanger means 60, which is connected to a distal end 75 at the end of which the hook 70 terminates. The configuration of the hook 70 and ifs proximal end 73 and distal end 75 may be configured such that the distal end 75 is based apart from the hanger means 60 and thereby forms a gap or space between the distal end 75 and the distal end 69 portion of the hanger means 60. The dimensions of this gap or space may be suitably established so that said gap or space may be sufficiently wide or large enough to encompass the bottom interior bottom margin 208 of the toilet bowl rim 202. With respect now to the depiction according to FIG. 10C, therein is illustrated the rear side of the hanger means 60, the front side of which had been depicted on FIG. 10A is more clearly depicted in this figure, the distal end 75 of the hook 70 is seen as tapering to a rounded end 77.

Figure 11C:
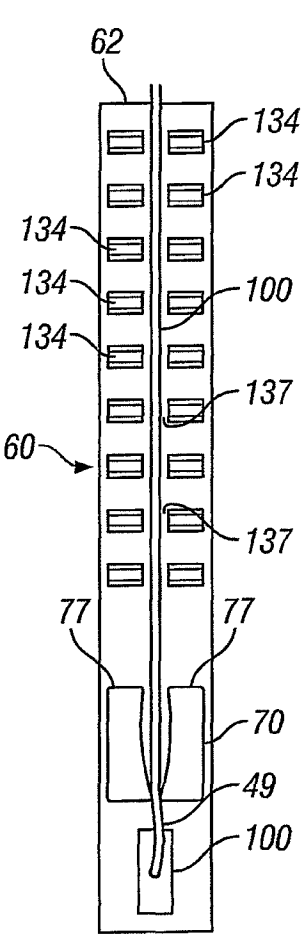
FIGS. 11A, 11B and 11C depict alternative views of an alternative embodiment of a hanger means.
Figure 11B:
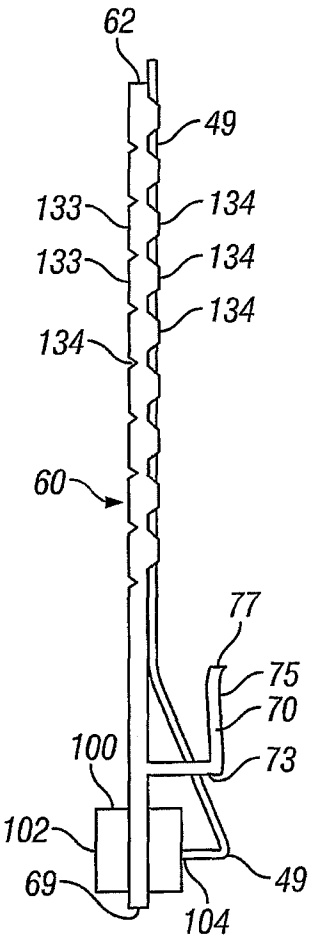
Figure 11A:
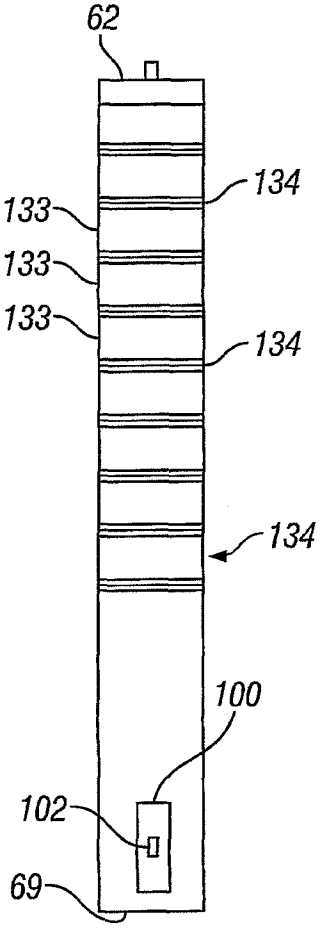

FIGS. 11A, 11B and 11C illustrate separate views of further embodiment of hanger means 60 according to certain preferred embodiments of the invention. In these figures, the hanger means 60 understood as to be shown in a fully extended, flat type configuration as it is further to be understood that the represented hanger means 60 are at least partially flexible. With respect first to FIG. 11A, the hanger means 60 includes a proximal end 62, and a distal end 69 adjacent to the latter of which is positioned and passing partially therethrough a fluid spray means 100 having an exit orifice 102. Further visible are a series of abutting segments 133 separated by flexible joints 134 which allow for the rotational displacement of two adjacent segments 133 by least 45° with respect to one another, preferably by least 60°, and most preferably allow for the rotational displacement of two adjacent segments 133 by least at 90° with respect to one another. Such segments are known from other articles, i.e. wristwatch bands, and webbed belts. Thus it is to be understood that not all of the hanger means 60 need to be made up of such segments 133, but desirably that portion of the hanger means 60 which are intended to span the top surface 204 of the toilet bowl rim 202 comprise one or more of such segments 133. Desirably at least one third of the total length between the proximal and distal ends of the hanger means 60, yet more play at least one half, and still more preferably a least ⅗ of the total length between the proximal and distal ends of the hanger means 60 are comprised of two or more adjacent segments 133. With reference now to FIG. 11B, therein is depicted a side view of the hanger means 60 of FIG. 11A. As is visible therefrom, the fluid spray means 100 extends through the distal end 69 of the hanger means 60 and includes both an exit orifice 102 and an inlet 104, the latter of which is connected to the fluid conduit 49 which runs adjacent to the hanger means 60 and opposite from the front therefrom so that it is hidden from view when the device 10 is installed on a toilet bowl. It is to be understood that the fluid conduit 49 is also flexible and thus may lie between portions of the hanger means 60 and portions of the toilet bowl rim 202. As is further visible from the figure, depending therefrom, and extending rearwardly outwardly from a portion of the hanger means 60 is a hook 70 which includes a proximal end 73 which is connected to and depends from the hanger means 60, which is connected to a distal end 75 at the end of which the hook 70 terminates. The configuration of the hook 70 and its proximal end 73 and distal end 75 may be configured such that the distal end 75 is based apart from the hanger means 60 and thereby forms a gap or space between the distal end 75 and the distal end 69 portion of the hanger means 60. The dimensions of this gap or space may be suitably established so that said gap or space may be sufficiently wide or large enough to encompass the bottom interior bottom margin 208 of the toilet bowl rim 202. With respect now to the depiction according to FIG. 11C, therein is illustrated the rear side of the hanger means 60, the front side of which had been depicted on FIG. 10A is more clearly depicted in this figure, the distal end 75 of the hook 70 is seen to split into two separate sections each terminating in a rounded end 77. As is also visible from the specific figure, the fluid conduit 49 is seen to pass along a gap 137 between adjacent pairs of riser elements 134 which extend outwardly and rearwardly from the hanger means 60. As is visible more clearly with respect to the embodiment illustrated on FIG. 11B, preferably the height or thickness dimensions of the riser elements 134 are such that the fluid conduit 49 passing therebetween is below the outwardmost thickness dimension of the riser elements 134.

Figure 11D:
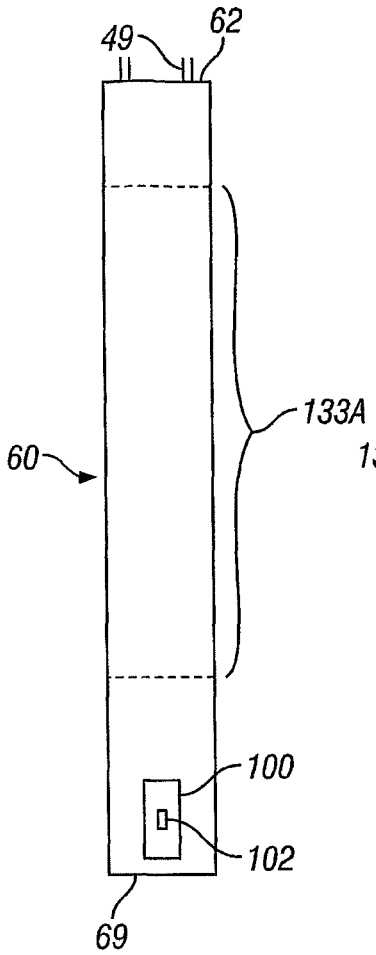
FIGS. 11D, 11E and 11F depict alternative views of a further alternative embodiment of a hanger means.
Figure 11E:
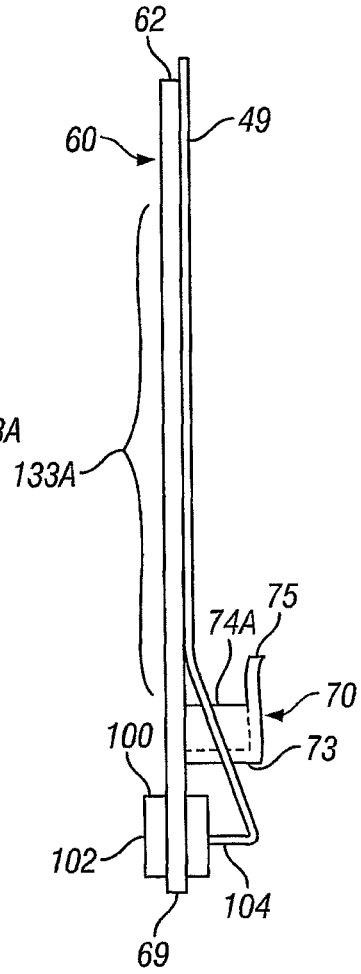
Figure 11F:
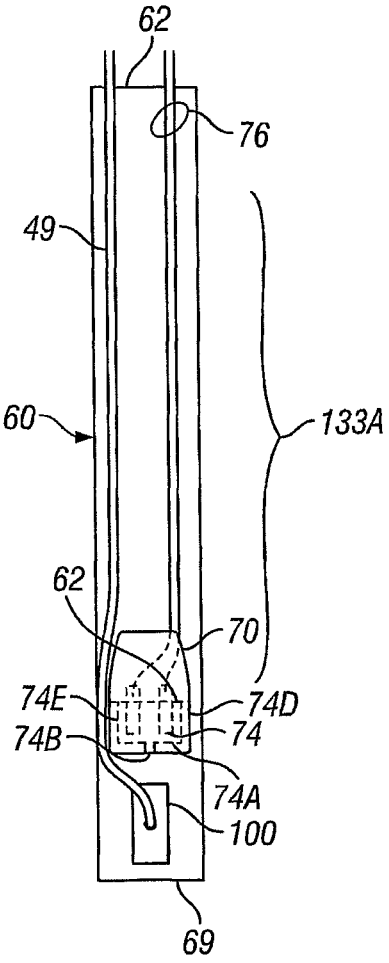

FIGS. 11D, 11E and 11F illustrate separate views of further embodiment of hanger means 60 according to certain preferred embodiments of the invention. In these figures, the hanger means 60 are to be understood as to be shown in a fully extended, flat type configuration as it is further to be understood that the represented hanger means 60 are at least partially flexible. With respect first to FIG. 11D, the hanger means 60 includes a proximal end 62, and a distal end 69 adjacent to the latter of which is positioned and passing partially therethrough a fluid spray means 100 having an exit orifice 102. Desirably that portion of the hanger means 60 which are intended to span the top surface 204 of the toilet bowl rim 202 comprise and it is to be understood that a major section of the hanger means 60 is sufficiently flexible to fulfill such a function. Desirably at least one third of the total length between the proximal and distal ends of the hanger means 60, yet more play at least one half, and still more preferably a least ⅗ of the total length between the proximal and distal ends of the hanger means 60 are comprised provides the flexible major section 133A. With reference now to FIGS. 11E and 11F therein is respectively depicted a side view and a rear view of the hanger means 60 of FIG. 11D. As is visible therefrom, the fluid spray means 100 extends through the distal end 69 of the hanger means 60 and includes both an exit orifice 102 and an inlet 104, the latter of which is connected to the fluid conduit 49 which runs adjacent to the hanger means 60 and opposite from the front therefrom so that it is hidden from view when the device 10 is installed on a toilet bowl. It is to be understood that the fluid conduit 49 is also flexible and thus may lie adjacent to or within part of the hanger means 60 and portions of the toilet bowl rim 202. As is further visible from the figure, depending therefrom, and extending rearwardly outwardly from a portion of the hanger means 60 is a hook 70 which having a proximal end 73 which is connected to and depends from the hanger means 60, which is connected to a distal end 75 at the end of which the hook 70 terminates. The configuration of the hook 70 and its proximal end 73 and distal end 75 may be configured such that the distal end 75 is based apart from the hanger means 60 and thereby forms a gap or space between the distal end 75 and the distal end 69 portion of the hanger means 60. The dimensions of this gap or space may be suitably established so that said gap or space may be sufficiently wide or large enough to encompass the bottom interior bottom margin 208 of the toilet bowl rim 202. The hook 70 further has associated therewith a flush sensing means, here in the present embodiment which includes provided as a trough or cavity 74 adapted to at least temporarily retain a quantity of flush water which enters through an open top 74A of the trough 74, and which flush water may exit via an exit orifice 74B. The flush sensing means includes at least two conducting terminals 78A, 78B which extend at least partially into the interior of the cavity 74, advantageously provided as plates, wires or pins which are metallic or semi-metallic in nature such that they may conduct an electrical signal or current, over conductors 76 to suitable controller means (not shown). In operation, when water enters into the interior of the cavity 74 it is retained therein for a brief time during which at least part of each of the conducting terminals 78A, 78B are immersed in the water. The water provides for a pathway for electrons across the terminals which may be used to sense or provide a current or circuit between the two conducting terminals 78A, 78B or a reduction in the resistance between the two conducting terminals 78A, 78B can be sensed as a condition and used by the controller means to control one or more further functions of the device of the invention and/or processes for operating the device according to the invention. After a time interval, the water may drain outwardly from cavity 74 and thereby removing water from the two conducting terminals 78A, 78B. This condition may also be sensed and used by the controller. Rate of exit of the water may be controlled in part by varying the geometry of the cavity 74, as well s controlling the size of the one or more exit orifices 74B which may be present. With specific attention to the depiction according to FIG. 11C, therein is illustrated the rear side of the hanger means 60, including "in phantom" the interior of the cavity 74, two sidewalls 74D and 74E extending upwardly from the proximal end 73 of the hook 70 and rearwardly from the hanger means 60, and the distal end 75 of the hook 70. Further visible in phantom are the two spaced-apart conducting terminals 78A, 78B herein the form of two metallic foil pads each of which is independently connected to a one of two conductors 76 which in turn extend to suitable controller means (not shown.)

Figure 11G:
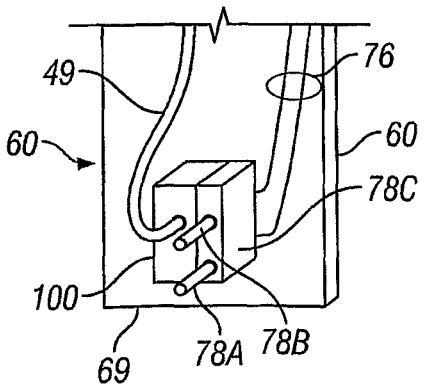
FIG. 11G depicts an embodiment of a flush sensing means.

FIG. 11G depicts an alternative embodiment of flush sensing means includes at least two conducting terminals 78A, 78B, herein the form of two extended metal or metallic pins each independently connected to conductors 76 which may conduct an electrical signal or current suitable controller means (not shown). The two conducting terminals 78A, 78B are positioned with respect to the hanger means 60 such that when the device of the invention is suspended on a lavatory appliance, during a flush cycle, flush water comes into simultaneous contact with both of the conducting terminals 78A, 78B. Such contact with water provides for a pathway for electrons across the conducting terminals 78A, 78B and may be used to sense or provide a current or circuit between the two conducting terminals 78A, 78B or a reduction in the resistance between the two conducting terminals 78A, 78B can be sensed as a condition and used by the controller means to control one or more further functions of the device of the invention and/or processes for operating the device according to the invention. An advantage of the embodiment illustrated on FIG. 11G is that the use of the two conducting terminals 78A, 78B, herein the form of two extended metal or metallic pins positioned in the path of flush water does not require the use of a trough or cavity 74 and permits for various different configurations of hooks 70 which may be configured to accommodate different geometries of lavatory appliances. Conveniently, as shown, least two conducting terminals 78A, 78B extend from a block 78C which may be adjacent to, abutting or indeed may be integrally formed with the fluid spray means 100. The embodiment of the flush sensing means as depicted on FIG. 11G may be advantageously used with any embodiment of the hanger means 60 and of the device according to the invention, and is not limited to the embodiment of the hanger means 60.

Figure 12D:
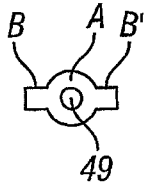
FIGS. 12A, 12B, 12C, 12D and 12E illustrate in separate views a further embodiment of a hanger means and/or part thereof.
Figure 12E:
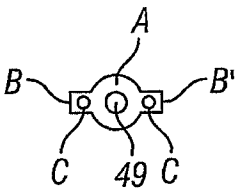
Figure 12C:
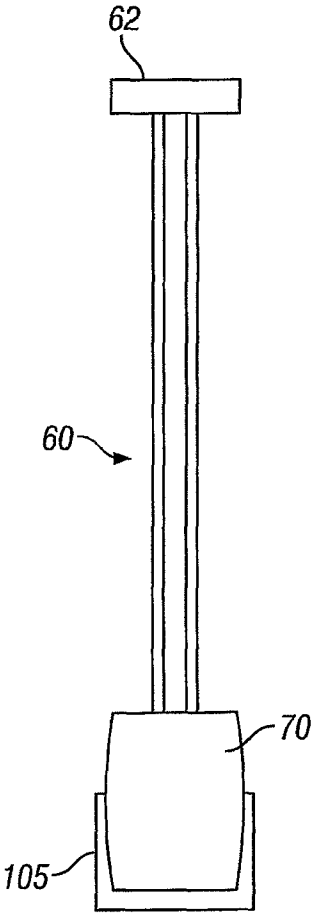
Figure 12B:
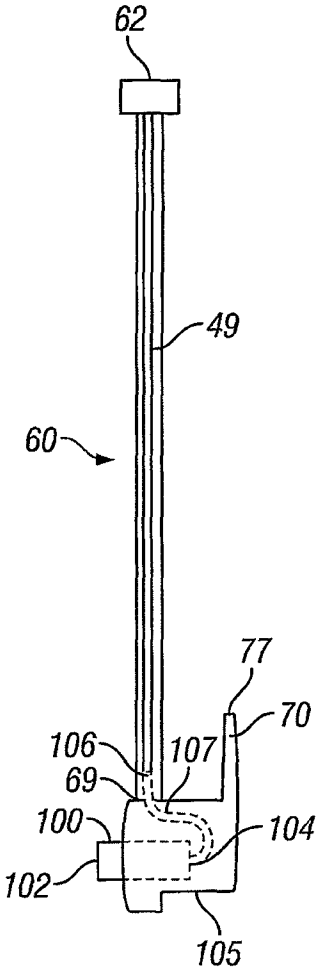
Figure 12A:
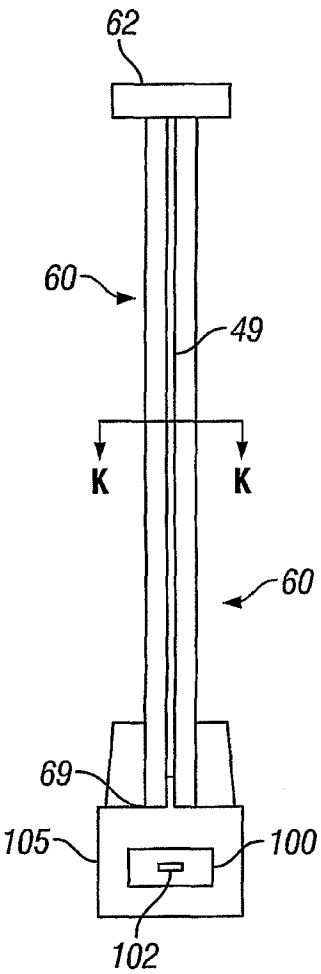

FIGS. 12A, 12B, 12C, 12D and 12E illustrate separate views of a further preferred embodiment of hanger means 60 according to certain embodiments of the invention. In these figures, the hanger means 60 understood as to be in a fully extended, flat type configuration as it is further to be understood that the represented hanger means 60 is at least partially flexible. With respect first to FIG. 12A, the hanger means 60 includes a proximal end 62, and a distal end 69 adjacent to the latter of which is positioned a fluid spray module 105 which comprises both the fluid spray means 100 and an integrally formed hook 70 at the rearward side thereof. In the embodiment depicted, the portion of the hanger means 60 between its proximal and 62 and its distal end 64 is flexible and deformable and further comprises a fluid conduit 49 integrally formed therewith. Turning now to FIG. 12B, therein is depicted a side view of the hanger means 60 illustrated on FIG. 12A. As is visible therefrom, the fluid spray means 100 is an element of a fluid spray module 105 which includes an inlet 106 which include connection with the fluid conduit 49 at the distal end 69, which inlet 106 extends into a fluid path 107 which terminates at the inlet 104 of the fluid spray means 100. The advantage of providing such a fluid spray module 105 is that all are part of said fluid spray module 105 may be injection molded or otherwise readily formed with and requires a minimum amounts of parts and minimal assembly. Furthermore, the provision of the fluid path 107 as an integral part of the fluid spray module 105 ensures good fluid coupling with the distal end 69 and proper placement of the fluid spray means 100 in relation thereto. Conveniently, as is also shown in the figure the fluid spray module 105 includes an integrally formed hook 70 at the rearward side thereof. This hook 70, terminates at an end 77, here seen to be a broad, flat end 77 which is spaced apart and forms a gap with the distal end 69. The dimensions of this gap or space may be suitably established so that said gap or space may be sufficiently wide or large enough to encompass the bottom interior bottom margin 208 of a toilet bowl rim 202. With respect now to the depiction according to FIG. 12C, therein is illustrated the rear side of the hanger means 60, the front side of which had been depicted on FIG. 12A. FIG. 12D provides a cross-sectional view of a portion of the hanger means 60 along line "k-k" of FIG. 12A. As is seen in this cross-sectional view, a major portion of the hanger means 60 is a tube A with two lateral wing sections B, B' all of which may be formed of a single material such as a thermoplastic polymer, a thermosetting polymer, or elastomeric material, such that the hanger means 60 between its proximal 62 and distal end 69 thereof are flexible and preferably, in the embodiment according to FIG. 12D is insufficiently rigid so as not to be self-supporting. An alternate but somewhat similar construction which does provide a degree of self-support is illustrated in FIG. 12E, which also provides a cross-sectional view of a portion of the hanger means 60 along line "k-k" of FIG. 12A. As is seen in this cross-sectional view, a major portion of the hanger means 60 is a tube A with two lateral wing sections B, B' all of which may be formed of a single material such as a thermoplastic polymer, a thermosetting polymer, or elastomeric material, and further within one or both of the wing sections B, B' is a flexible, shape retaining material such as may be provided by flexible wires, flexible rods, or other flexible materials which can be manually deformed by a user in order to provide a specific configuration to the hanger means 60 which can be further deformed to assume a different shape. Conveniently, such flexible wires, flexible rods or other flexible materials are one or more metal or metallic wires which provide such a function efficiently and at a low cost. Such can be conveniently coextruded within one or both of the two lateral wing sections B, B' or may be inserted after the formation of the a major portion of the hanger means 60. Additionally it should be readily appreciated that the tube A may conveniently fill the role of the fluid conduit 49.

Figure 13C:
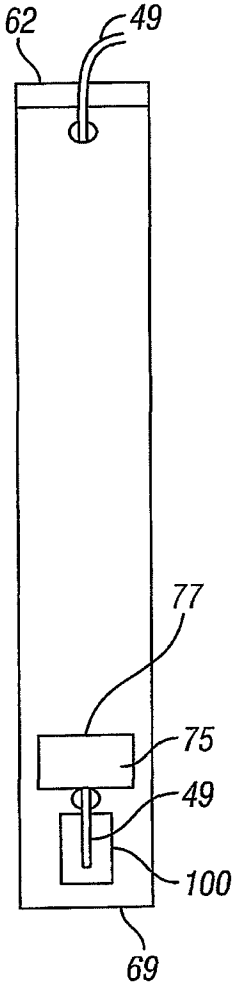
FIGS. 13A, 13B and 13C depict further views of an alternative embodiment of a hanger means of the invention.
Figure 13B:
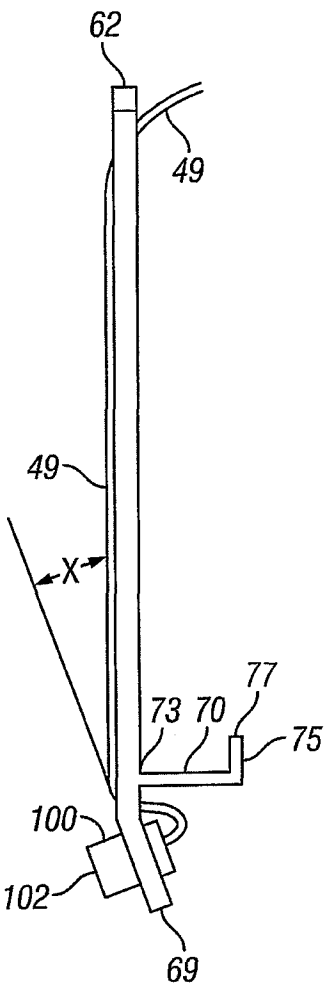
Figure 13A:
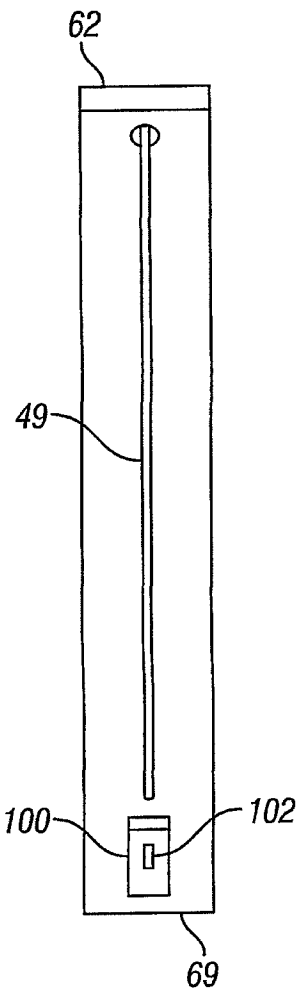

FIGS. 13A, 13B and 13C illustrate separate views of a further embodiment of hanger means 60 according to certain preferred embodiments of the invention. In these figures, the hanger means 60 understood as to be in a fully extended, flat type configuration as it is further to be understood that the represented hanger means 60 are at substantially flexible.

With respect first to FIG. 13A, the hanger means 60 includes a proximal end 62, and a distal end 69 adjacent to the latter of which is positioned and passing partially there through a fluid spray means 100 having an exit orifice 102. Adjacent to the hanger means 60 extends a fluid conduit 49 which runs along the top face of the hanger means 60. Turning now to FIG. 13B, therein is depicted a side view of the hanger means 60. As is visible from the figure, the fluid spray means 100 extends through a portion of the distal end 69 of the hanger means 60 and includes both an exit orifice 102 and an inlet 104, the latter of which is connected to the fluid conduit 49 which runs adjacent to the hanger means 60. Of note from FIG. 13B is that the distal end 69 of the hanger means 60 is a segment of the hanger means 60 which is however angled by an angle "x" with respect to the balance of the hanger means 60 which in the depiction is represented in a fully extended, flat type configuration. The angle, "x" is desirably established such that when the device according to the invention is suspended on a portion of the rim 202 of a toilet bowl 200, the direction of the exit orifice of the fluid spray means 100 is downwardly directed into the interior 206 of the toilet bowl 200. While the value of this angle, "x" may vary considerably and is largely a function of the operational characteristics of the fluid spray means 100 utilized, preferably the angle is established such that the direction of the spray pattern emanating from the fluid spray means is directed generally will lead and or downwardly such that fluid spray from the fluid spray 100 primarily impinges the interior sidewall of the toilet bowl below the bottom interior bottom margin 208 of the toilet bowl rim 202. Advantageously, the angle "x" may be from 0.5° to 60°, preferably from about 1° to about 45°, yet more preferably from about 1° to about 30°. As is further visible from the figure, depending from, and extending rearwardly outwardly from a portion of the hanger means 60 is a hook 70 which includes a proximal end 73 which is connected to and depends from the hanger means 60, which is connected to a distal end 75 at the end of which the hook 70 terminates. The configuration of the hook 70 and its proximal end 73 and distal end 75 may be configured such that the distal end 75 is spaced apart from the hanger means 60 and thereby forms a gap or space between the distal end 75 and the distal end 69 portion of the hanger means 60. The dimensions of this gap or space may be suitably established so that said gap or space may be sufficiently wide or large enough to encompass the bottom interior bottom margin 208 of the toilet bowl rim 202. With respect now to the depiction according to FIG. 13C, therein is illustrated the rear side of the hanger means 60, the front side of which had been depicted on FIG. 13A is more clearly depicted in this figure, the distal end 75 of the hook 70 is seen as extending to a flat end 77.

Figure 14A:
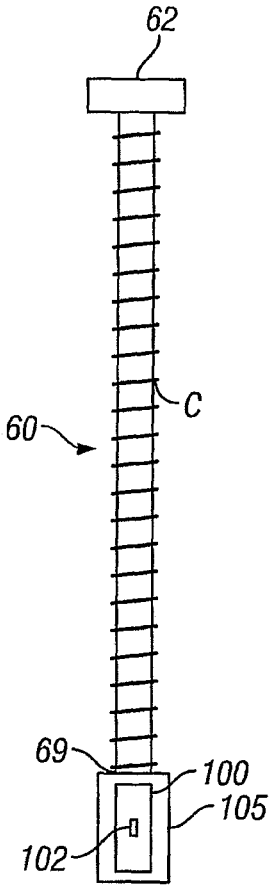
FIGS. 14A and 14B show in separate views a still further embodiment of a hanger means.
Figure 14B:
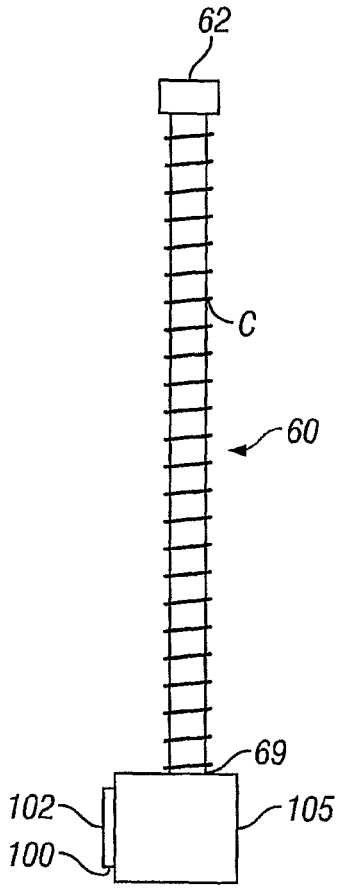

FIGS. 14A, and 14B illustrate separate views of a further embodiment of hanger means 60 according to certain preferred embodiments of the invention. In these figures, the hanger means 60 is understood as to be in a fully extended, flat type configuration and it is further to be understood that the represented hanger means 60 are at substantially flexible. While not specifically visible from these figures, it is to be understood that a fluid conduit 49 extends through the hanger means 60 and provides for fluid communication between a least a proximal end 62, past the distal end 69 to the fluid spray means 100 which in this depiction, it is enclosed within, or forms a part of a fluid spray module 105. The segment of the hanger means 60 intermediate the proximal end 62 and the distal ends 69 thereof is to be understood to include a flexible, shape retaining material such as may be provided by flexible wires, flexible rods, or other flexible materials which can be manually deformed by a user in order to provide a specific configuration to the hanger means 60 which can be further deformed to assume a different shape. Conveniently, such flexible wires, flexible rods or other flexible materials are one or more metal or metallic wires which provide such a function efficiently and at a low cost. In embodiment depicted in FIGS. 14A and 14B, a spirally wound flexible, shape retaining material "C", which may be as a bendable wire spiral, is illustrated. It is to be understood that provision of the shape retaining material C allows for the flexure of the hanger means 60 to assume any particular configuration and that such a configuration can be easily established by the user of the device according to the invention. Such is sometimes referred to as a "gooseneck" type article. A further benefit of the use of such a shape retaining material C as part of the hanger means 60 is it that once the hanger means 60 has been adapted to conform to a particular configuration of a particular toilet bowl, the need for a hook 70 can be dispensed with. Accordingly, in the depiction of a side view of the hanger means 60 as illustrated on FIG. 14B, a hook 70 is not included as part of the hanger means 60 as such is simply no longer required.

Figure 15A:
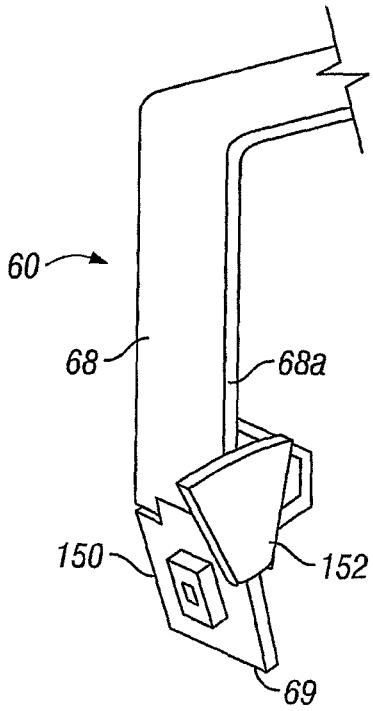
FIGS. 15A, 15B and 15C illustrate in several views an embodiment of a hanger means having a hinged end plate.
Figure 15B:
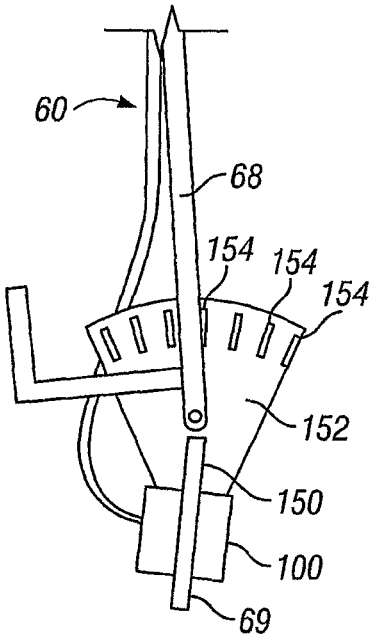
Figure 15C:
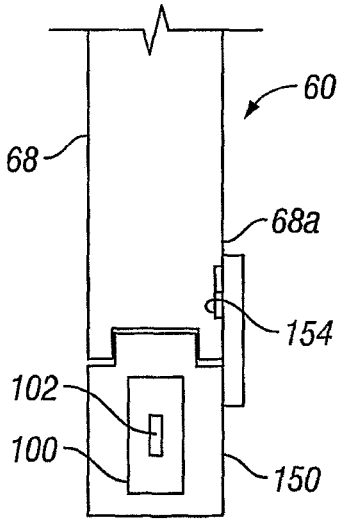

FIGS. 15A, 15B and 15C illustrate several views of the portion of a hanger means 60 of the invention having a repositionable hinged end plate 150 forming part of the distal end 69 of the hanger means 60. As is seen from the various figures the hinged end plate 150 is in a hinged, or flexible swinging relationship to the hanger means 60, and in particular to the third hanger segment 68. Extending through the hinged end plate 150 is the fluid spray means 100, having an exit orifice 102 direct outwardly from the front of the hinged end plate 150, and an inlet 104, the latter of which is connected to the fluid conduit 49 which runs adjacent to the hanger means 60 in opposite from the front therefrom so that it is hidden from view when the device 10 is installed on a toilet bowl. It is to be understood that the fluid conduit 49 is flexible. Further, affixed to, or alternately, integrally formed with the hinged end plate 150 is an indexing plate 152 which includes a plurality indexing elements 154 which they be used to establish a specific angular relationship between the hinged end plate 150 bearing the fluid spray means 100, and the remaining parts of the hanger means 60. Concurrently, wherein the device according to the invention is suspended upon a part on a toilet bowl 200 by means of the hanger means 60, the provision of the hinged end plate 150, and the indexing plate 152 which comprises a plurality of indexing elements 154 can also be used to established a specific angular relationship between the fluid spray means 100 and in particular the exit orifice 102 of the fluid spray means 100 with respect to the toilet bowl 200 and thereby provide a more controlled and directed orientation fn the fluid treatment composition being dispensed from the fluid spray means 100 with respect to the interior surfaces out of the toilet bowl 200. Thus, according to certain preferred embodiments of the invention such a hinged end plate 150 and indexing plate 152 are included as elements of the hanger means 60. Returning now to FIG. 15B, the interrelationship between the hinged end plate 150 and indexing plate 152 illustrates the interaction between the plurality of indexing elements 154 which are here, small raised elements rising outwardly from the indexing plate 152 and having gaps between adjacent indexing elements 154 which permit for the positioning of the side edge 68*a* the hanger means 60 therebetween. Such an interference-type fit which however can be readily changed by a user if necessary. A user would necessarily grasp one or more of the a hinged end plate 150 or indexing plate 152 and manually displaced and with respect to one another until a suitable positional relationship can be established. The retention of such a suitable positional relationship is facilitated by the interference-type fit between the adjacent indexing elements 154 and the side edge 68*a* the hanger means 60. Ideally, adjacent indexing elements 154 are uniformly spaced apart with respect to one another, so that desirably movement of the hinged end plate 150 between adjacent indexing elements 154 alters the angle of the hinged end plate 150 with respect to the side edge 68*a* the hanger means 60 by between 1°-7° of arc, preferably between 2°-5° of arc.

Figure 16A:
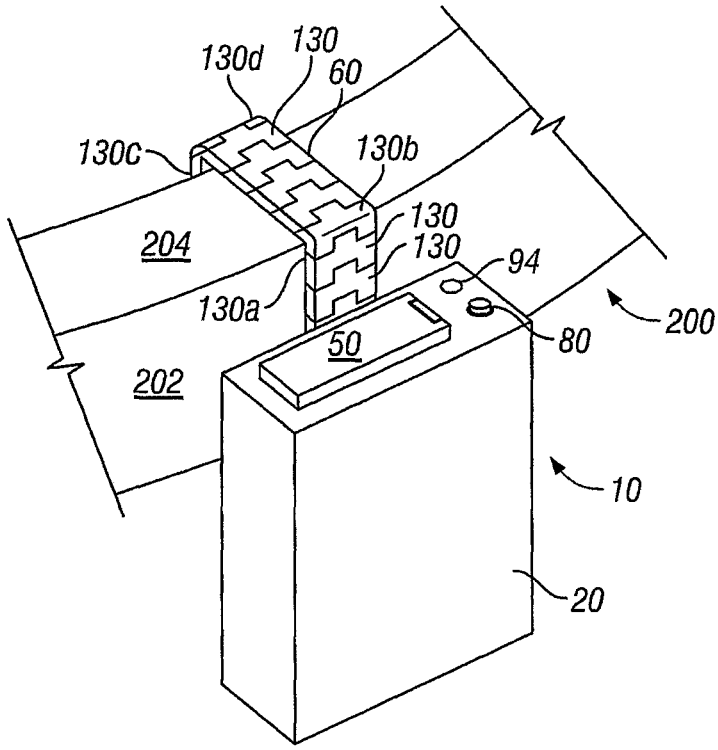
FIGS. 16A and 16B depict a further embodiment of an improved automatic toilet bowl device of the invention.
Figure 16B:
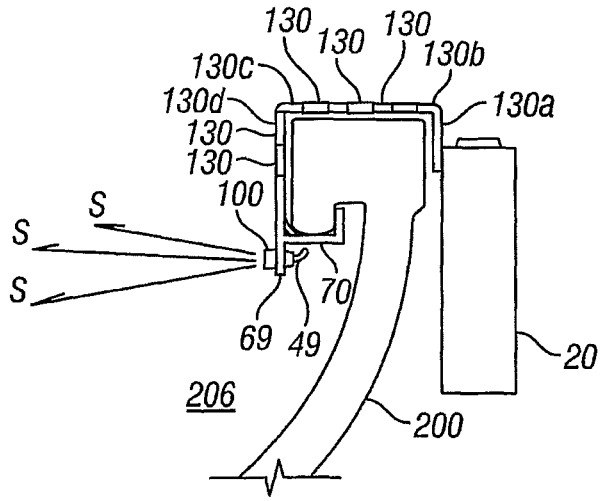

FIGS. 16A and 16B illustrate a further embodiment of a device 10 according to the present invention. Turning first to FIG. 16A, with respect to the device 10 according to the invention suspended a section of a toilet bowl rim 202 of a toilet bowl 200 by the hanger means 60. More specifically, the hanger means 60 provided is the hanger means as is depicted on FIGS. 10A, 10B and 10C. As is further illustrated, the hanger means 60 comprises a number of adjacent interconnected link segments 130 which allow for the rotational displacement of two adjacent links by least 45°, here the rotational displacement of two adjacent links by about 90° with respect to one another is illustrated by links 130*a*, 130*b* and by links 130*c*, 130*d*. As is visible from FIG. 16A, the body 20 of the device 10 is suspended from and supported by the proximal end of the hanger means 60, which hanger means extends upwardly, to the top surface 204 of the toilet bowl rim 202 forming a first approximately 90° bend between adjacent interconnected link segments 130*a*, 130*b*, then continues, spanning the top surface 204 of the toilet bowl rim 200, and forms a second approximately 90° bend between adjacent interconnected link segments 130*c*, 130*d* and thereafter the hanger means 60 extends downwardly towards the interior 206 of the toilet bowl 200 with it terminates at a distal end 69. As is further visible from the figures, and in particular as is better visible from FIG. 16B, the distal end 69 also includes the fluid spray means 100 which is mounted through a part of the distal end 69. The fluid spray means 100 is connected in the fluid conduit 49 which, although not clearly shown in the figure, is to be understood as extending into the body 20, from whence it draws a supply of the liquid treatment composition which is dispensed via the fluid spray means 100. The dispensed liquid treatment composition emanating from the fluid spray means 100 is represented by a series of arrows "s" such that the sprayed liquid treatment composition being delivered therethrough is directed at least partially laterally towards the opposite sidewall on the interior 206 of the toilet bowl 200 such that desirably, a major quantity on the liquid treatment composition being dispensed via the fluid spray means 100 impinges on the sidewall and/or the fluid into the sump (drain, outlet) of the toilet bowl 200. Further visible from FIG. 16B is a hook 70 extending rearwardly from the distal end of the hanger means 60.

Figure 17:
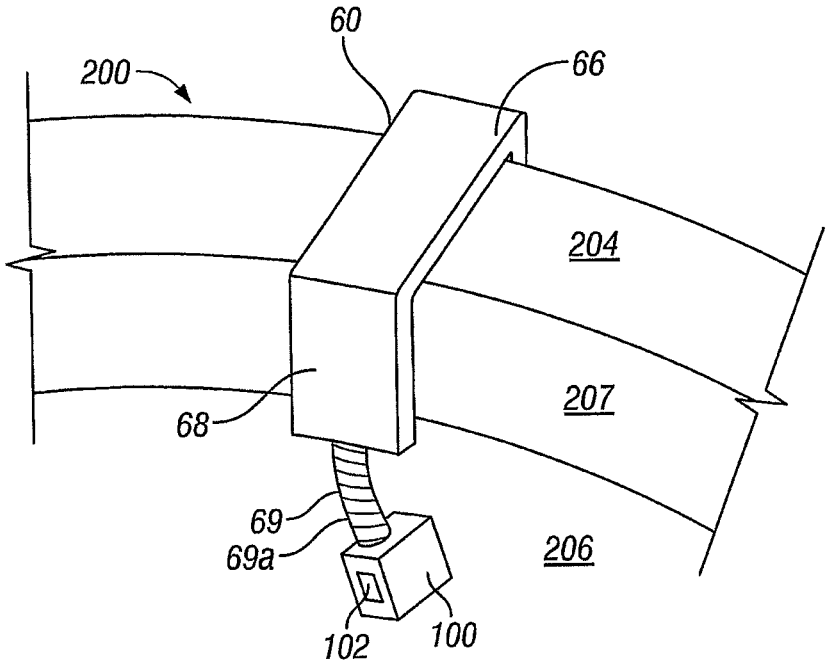
FIG. 17 depicts an embodiment of a hanger means having a flexible end part.

FIG. 17 illustrates in a perspective view a portion of a device 10 according to the invention, more particularly illustrating an embodiment of a hanger means 60 which incorporates a flexible distal end 69 which differs in construction from the remaining parts of the hanger means 60. More specifically, as is visible from FIG. 17 there is depicted a part of a hanger means 60 suspended upon a section of a toilet bowl rim 202 of a toilet bowl 200. While not visible, it is to be understood at that the hanger means 60 supports any body 20 which depends from the distal end of the hanger means 60. As it is visible from the figure, a part of the hanger means 60, namely a second hanger segment 66 spans the top surface 204 of the toilet bowl rim 202, and a further part of the hanger means, namely a third hanger segment 68 extends downwardly dare from and into the interior 206 of a toilet bowl 200. As is visible from the figure, the third hanger segment 68 either abuts, or it is generally parallel to the inner sidewall 207 of the toilet bowl rim 202. From the third hanger segment 68 the hanger means 60 continues to a distal end 69 now in the form of a conformable element which can be manually deformed or otherwise configured to assume a particular three-dimensional shape. The conformable element 69*a* is a bendable "gooseneck"-type segment which includes in its interior a portion of the fluid conduit 49. The conformable element 69*a* extends to the fluid spray means 100. As will be appreciated from a review of FIG. 17, the specific embodiment of the hanger means 60 depicts a preferred embodiment of the invention whereby, a major portion of the hanger means 60 is useful in suspending the body 20 of the device 10, yet at the same time the provision of the conformable element 69*a* from which the fluid spray means 100 depends provides for an easily installable device 10, which, by virtue of the conformable element 69*a* provides for convenient configuration of, and directional placement of the fluid spray means 100 with respect to the toilet bowl 200. Thus, the provision of the conformable element 69*a* provides for a convenient, easy to adjust device 10 which can be positioned in order to optimize the delivery of the liquid treatment composition via the fluid spray means 100.

Figure 18:
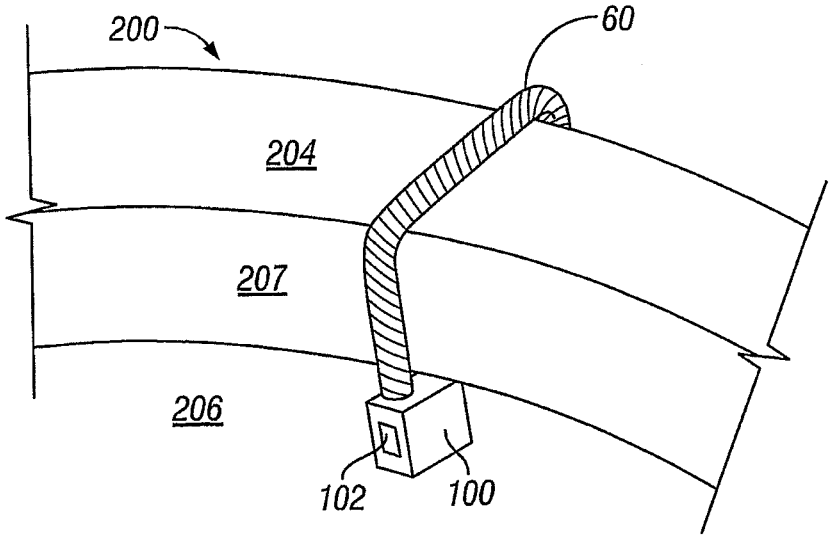
FIG. 18 illustrates an embodiment of a hanger means having a conformable element.

FIG. 18 depicts a further embodiment illustrates in a perspective view a portion of a device 10 according to the invention, more particularly illustrating an embodiment of a hanger means 60 which is primarily formed of a conformable element which has been manually deformed or otherwise configured to assume a shape useful in suspending the body 20 (not shown) from the toilet bowl rim 202 on the exterior of the toilet bowl 200, and concurrently to suspend the fluid spray means 100 within the interior 206 of the toilet bowl 200. The hanger means 60 illustrated in FIG. 18 is one substantially a described with reference to FIGS. 14A, 14B and is primarily a bendable "gooseneck"-type segment which includes in its interior a portion of the fluid conduit 49. The conformable hanger means 60 provides for convenient configuration of, and directional placement of the fluid spray means 100 with respect to the toilet bowl 200, which can be positioned in order to optimize the delivery of the liquid treatment composition via the fluid spray means 100.

Figure 19:
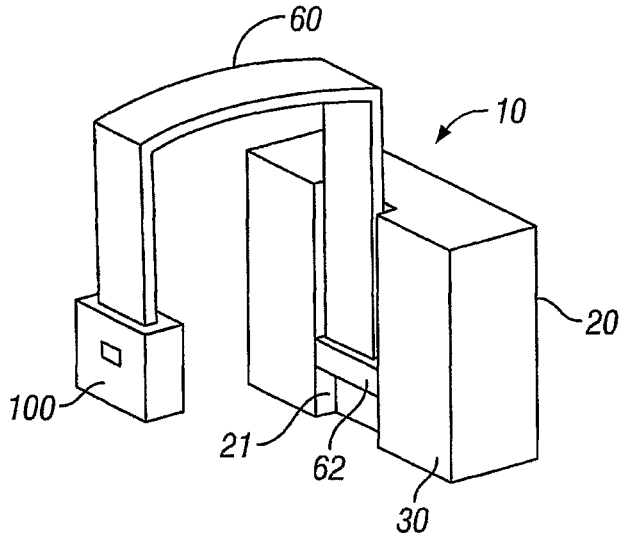
FIG. 19 depicts an embodiment of an improved automatic toilet bowl device of the invention having an adjustable/repositionable element.

FIG. 19 illustrates an embodiment of a device 10 according to the invention whereby the proximal end 62 of the hanger means 60 can be partly repositioned or adjusted with respect to the body 20. As is seen from the figure, the proximal end 62 of the hanger means 60 is moveable within a channel 21 which is recessed within rear sidewall 30 of the body 20. It is the understood that there exists an interference-type fit between the proximal end 62 of the hanger means 60 and parts of the channel 21, or alternately but preferably there exists a suitable form of engagement means between at least part of the proximal end 62 and the body 20, preferably with part of the channel 21. Such can be any suitable means, such as a spring element position within the interior of the proximal and 62 which urges its ends against parts of the channel 21, one or more leaf-type springs which are mounted either on the proximal and 62 and/or on the part of the hanger means 60 which is present in the channel 21, or alternately one or more leaf type springs which are mounted in the channel 21, which leaf type springs form a friction-fit contact between at least part of the hanger means 60 and at least part of the body, especially at least part of the channel 21. Still further means effective in providing useful retention between the hanger means 60 and the body 20, and particularly part of or all of the channel 21 although not described here may also be utilized. As is visible from the figure, the particular embodiment allows for vertical displacement of the body 20 with respect to the hanger means 60 which may be desirable in order to accommodate the geometries of different types of toilet bowls 200, and their toilet bowl rims 202.

Figure 20:
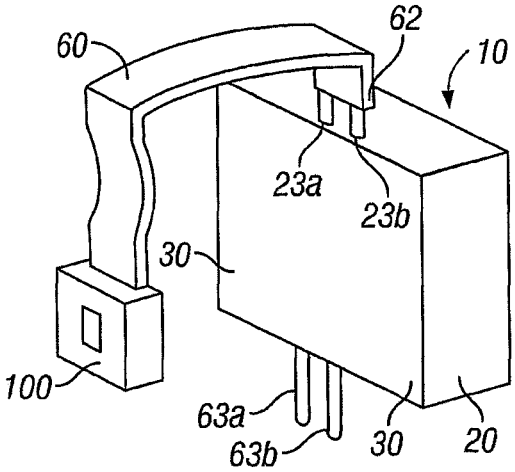
FIG. 20 shows an embodiment of an improved automatic toilet bowl device having a moveable hanger means.

FIG. 20 illustrates a further and body meant of a device 10 according to the invention which also includes a movable hanger means 60 which can be partly repositioned or adjusted with respect to the body 20. As is visible from the figure, extending downwardly from, and depending from the proximal end 62 of the hanger means 60 are a pair of spaced apart, generally parallel slideable rods 63*a*, 63*b* which extend downwardly through the body 30 through a pair of corresponding bores 23*a*, 23*b* which are positioned within the interior of the body 20 and are generally parallel to the rear sidewall 30 thereof. As will be appreciated from the figure, the slideable rods 63*a*, 63*b* maybe we repositioned within their corresponding bores 23*a*, 23*b* allowing for the vertical displacement of as the hanger means 60 with respect to the body 20 of the device 10. The slideable rods 63*a*, 63*b* may form a friction-type fit within their corresponding bores 23*a*, 23*b* or alternately, a further element such as one or more springs, including leaf-type springs may be advantageously provided. For example, although not shown, it is to be understood that one or both of the slidable rods 63*a*, 63*b* maybe provided with a leaf-type string somewhere along its length which spring, is urged against a portion of a bore 23*a*, 23*b* within which it may be located thereby providing an improved friction-type fit. Alternately, a part of one or both of bores 23*a*, 23*b* may also be provided with a spring, such as a leaf-type spring somewhere along its length which spring is urged against a portion of a slideable rod 63*a*, 63*b* present within the respective bore. In a still further embodiment, one or both of the slideable rods 63*a*, 63*b* may be partially arcuate or bowed, whereas their corresponding bores 23*a*, 23*b* would remain generally should remain straight, thus causing a frictional interference-type fit between the arcuate or bowed slideable rods 63*a*, 63*b* with the straight side walls of the bores 23*a*, 23*b*. Additionally, will not shown it is also contemplated that the body 20 may also include one or more elements which can be mounted to any part thereof which element or elements would be configured in order to provide corresponding bores 23*a*, 23*b*, which would obviate the need for the positioning of the corresponding bores 23*a*, 23*b* within the interior of the body 20.

Figure 21:
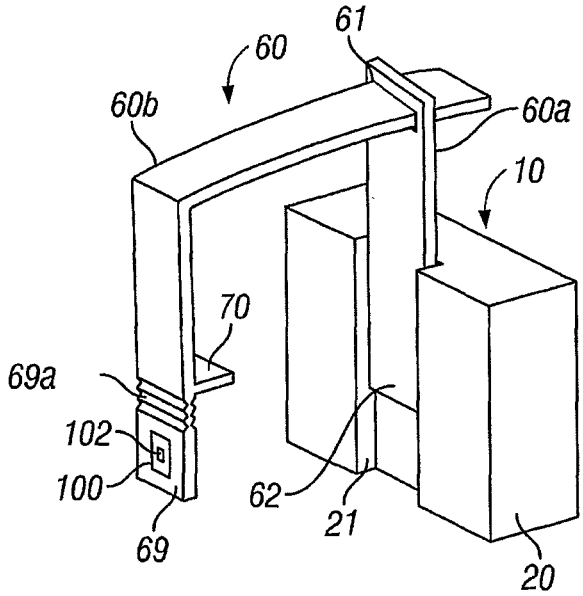
FIG. 21 depicts an embodiment of an improved automatic toilet bowl device of the invention having a two-part hanger means.

FIG. 21 illustrates an embodiment of a device 10 according to the invention whereby the proximal end 62 of the hanger means 60 can be partly repositioned or adjusted with respect to the body 20, and which further includes a two-part hanger means 60 which can also be repositioned in order to change the dimensions of the hanger means 60. As is visible from the figure, the hanger means 60 includes a proximal end 62 which is at least partially positioned within the channel 21 of the body 20 of the device 10, wherein it is to be understood that the proximal end 62 of the hanger means 60 is moveable within the channel 21. It is further to be understood that there exists an interference-type fit between the proximal end 62 of the hanger means 60 and parts of the channel 21, or alternately but preferably there exists a suitable form of engagement means between at least part of the proximal end 62 and the body 20, preferably with part of the channel 21. Such can be any suitable means, such as a spring element position within the interior of the proximal and 62 which urges its ends against parts of the channel 21, one or more leaf-type springs which are mounted either on the proximal and 62 and/or on the part of the hanger means 60 which is present in the channel 21, or alternately one or more leaf type springs which are mounted in the channel 21, which leaf type springs form a friction-fit contact between at least part of the hanger means 60 and at least part of the body, especially at least part of the channel 21. Still further means effective in providing useful retention between the hanger means 60 and the body 20, and particularly part of or all of the channel 21 although not described here may also be utilized. As is visible from FIG. 21, the particular embodiment allows for vertical displacement of the body 20 with respect to the hanger means 60 which may be desirable in order to accommodate the geometries of different types of toilet bowls 200, and their toilet bowl rims 202. The hanger means 60 depicted is a two-part type hanger which is comprised of a first hanger part 60*a* and a second hanger part 60*b* were in the relative positioning of each of these parts may be adjusted. As visible, the first hanger part 60*a* includes a slot 61 passing through a part of the first hanger part 60*a* which is positioned advantageously after a near the end there of which is opposite to the proximal end 62 of the hanger means 60. Inserted within the slot 61 is a portion of the second hanger part 60*b* which is understood to be in a slidable relationship therewith. Preferably, the second hanger part 60*b* present within the slot 61 forms an interference-type or friction-type fit which is useful in retaining the relative positioning of the first hanger part 60*a* with the second hanger part 60*b* and thereby establishing an overall configuration of the hanger means 60. If desired, there may also be present a suitable form of engagement means between the first hanger part 60*a* with the second hanger part 60*b* which may present in place of, or used in conjunction with the interference-type or friction-type fit which may be provided. For example, one or more springs such as one or more spring, such as one or more leaf springs may be provided as part of either or both of the first hanger part 60*a* and the second hanger part 60*b* whereby the action of the one or more springs may be used to retain the relative positioning of the first hanger part 60*a* with the second hanger part 60*b* and thereby establishing and retaining an overall configuration of the hanger means 60.

Additionally, while not shown it is to be understood that the hanger means 60 may be also formed of three component parts, a first hanger part, a second hanger part, and a third hanger part which would correspond generally with the first hanger section, second hanger section, and third hanger section which had been described previously. Again, any suitable means whereby there may be provided an adjustable interconnection between two or more of the three said component parts may also be provided and although not illustrated in the figures, are nonetheless contemplated to be within the scope of the present invention.

Yet again, with further reference to FIG. 21 depicted is a distal end 69 of the hanger means 60 which distal end 69 comprises both the fluid spray means 100 as well as a flexible segment 69*a* which is conformable and intermediate the fluid spray means 100 and the major portion of the hanger means 60. It is to be understood that the provision of such a conformable, flexible segment 69*a* provides a simple yet effective means for accurate positioning of the fluid orifice 102 with respect to the toilet bowl 200 upon which the device 10 is ultimately mounted.

Figure 22A:
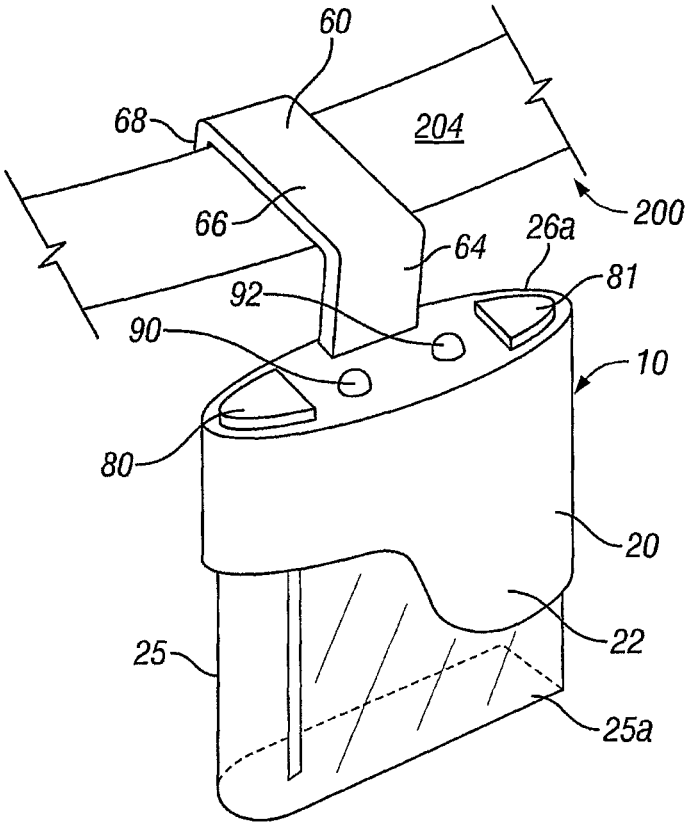
FIGS. 22A and 22B illustrate a further embodiment of an improved automatic toilet bowl device of the invention which includes a refill cartridge.
Figure 22B:
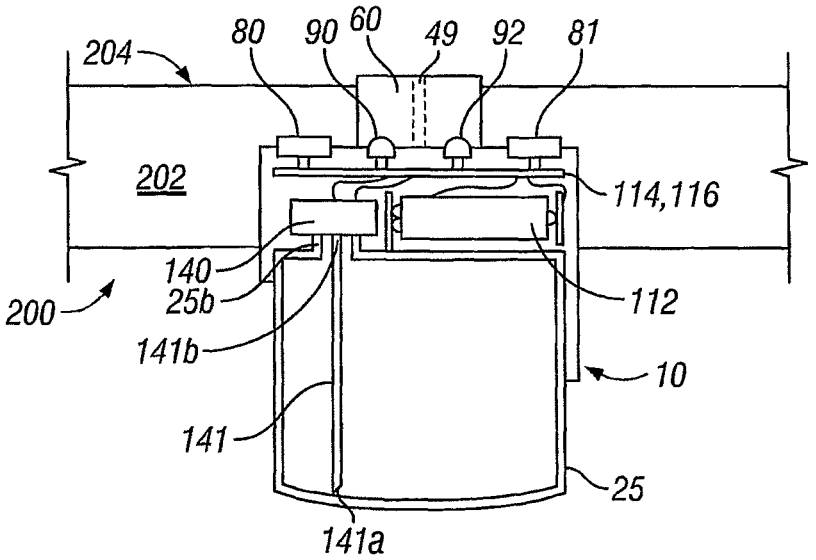

FIGS. 22A and 22B depict two views of a further preferred embodiment of a device 10 according to the present invention. In FIG. 22A, there is depicted in a device 10 which comprises a body 20 which includes a refill cartridge 25 which in combination depicts a body 20 according to a featured aspect of the invention. The body 20 includes a top face 26*a* through which extend two switches 80, 81 both here of the push-button or push-and-latch type, as well as a pair of a visual indicator means here a first LED 90 and a second LED 92. The body 20 further includes a refill cartridge 25 containing a quantity of the treatment composition which is removably affixable in the body such that a consumer may remove an exhausted or spent refill cartridge 25 and replace it with a fresh or replenished cartridge 25 as may be necessary or as desired during the operating life of the device 10. Thus the refill cartridge includes a fluid reservoir portion. As is visible from the figure, and as is readily understood therefrom, the refill cartridge 25 is insertable against or at least partially into the body 20 in an upward direction, that is to say the consumer may optionally unmount the device 10 from the toilet 200, and then separate to the refill cartridge 25 or the consumer may alternately pull the refill cartridge 25 in a downward direction thereby separating it from the body 20. In the current embodiment, the sidewall 25*a* of the refill cartridge 25 is made of a transparent material, such as glass or a transparent plastics material thereby permitting for the user to view the level of liquid treatment composition within the refill cartridge 25 in order to ascertain the amount of remaining liquid treatment composition. The refill cartridge 25 may be easily reinserted or attached to form part of the body 20 by reinsertion.

With respect now to FIG. 22B, there is illustrated a cross-sectional view of the device 10 illustrating certain interior details. Visible is the refill cartridge 25 which includes a neck portion 25*b* which is open, and which is also insertable within part of the pump 140 which is operated by the controller means 114 responsive to appropriate signals provided thereby. Further visible are one or more batteries 112, which may be one or more single use batteries or rechargeable batteries, which provide a power supply to operate the a controller means 114 which is used to control circuitry used to control the operation on the improved automatic toilet bowl treatment device 10. The controller means comprises a circuit board 116 upon which are mounted one or more electronic components 118, as well as switches 80, 81 and indicator means, LEDs 90, 92. The switches 80, 81 are used to provided appropriate signal inputs to the controller means 114 and may fulfill any variety of functions which require user interaction. For example, one or both of the switches 80, 81 can be utilized to turn the device 10 off and on; alternately one or both of the switches 80, 81 they be used to provide a program inputs to the controller means 114 whereas, for example, the time period between automatic dispensing of the liquid treatment composition through the fluid spray means 100 may be varied by interaction of the user with one or more of switches 80, 81. Additionally, or alternately thereto, one or more of switches 80, 81 may be used to initiate dispensing of the liquid treatment composition from the fluid spray means 100, which dispensing can be immediate or concurrent with the operation of one or both of switches 80, 81, which dispensing can be somewhat delayed subsequent to the operation of switches 80, 81 by a consumer or user. One or more of the LEDs can be programmed to operate responsive to certain conditions and thereby provide a visual indicator to a consumer or user. For example, the one more indicator means can provide an indicator of the status of the dispensing of the liquid treatment composition; the status of the level of liquid or fluid in the refill cartridge, an indication that the battery or other power source needs to be changed or replenished, or a fault condition indicating improper operation or malfunction of the device 10. Additionally while not shown in the figure, an audible sound source can also be provided to provide an audible sound or signal, which can be as simple "beep", or can be a song, tune, or melody to indicate the particular status of the device.

While not depicted in particular detail in FIG. 22B, it is to be understood that there is provided a suitable sealing means between the refill cartridge 25 and preferably the neck portion 25*b* thereof and the pump 140. Such machine be accomplished by use of any of the number of suitable operating elements including but not limited to: providing mating threads which couple the refill cartridge 25 to a part of the pump 140, providing one or more sealing gaskets or o-rings as part of either the pump 140 or the refill cartridge 25 or both which come into engagement when they refill cartridge 25 is installed as part of the body 20; as well as, the provision of a simple interference-type fit between part of the refill cartridge 25 and most preferably part of the neck portion 25*b* thereof, and the pump 140. In certain particularly preferred embodiments of the invention, the sealing means between the refill cartridge 25 is sufficient to provide both a means through which the liquid treatment composition may be removed from the interior of the refill cartridge 25 and supplied to the body 20, as well as the means for supporting the refill cartridge 25 when it is affixed as part of the body 20. Ideally, the sealing means provides fulfills both of these functions somewhat further or ancillary means or elements to provide a physical support to the cartridge 25 although, in certain embodiments such may be useful or necessary. Further visible extending downwardly from the pump 140 it is a pump supply tube 141 which at its distal end 141 a is dimensioned to extend downwardly into the interior of the refill cartridge 25, and at its proximal end 141*b* is in fluid communication with the pump 140. It is to be understood that the pump supply tube 141 provides a conduit through which the liquid treatment composition contained within the refill cartridge 25 may be withdrawn therefrom, and supplied to the pump. Further partially visible is the fluid conduit 49 which is represented in the figure as passing underneath the hanger means 60 so that it is obscured from view when the device 10 is mounted on the rim 202 of a toilet bowl 200. While not visible in the figure, it is understood that one end of the fluid conduit 49 is in fluid communication with an output of the pump 140, while the other end of the fluid conduit 49 is include the fluid spray means 100. Thus, in operation that the device 10 can be used to automatically, semi-automatically or manually supply a quantity of a liquid treatment composition present within the refill cartridge 25 to the interior of a toilet bowl.

Figure 23:
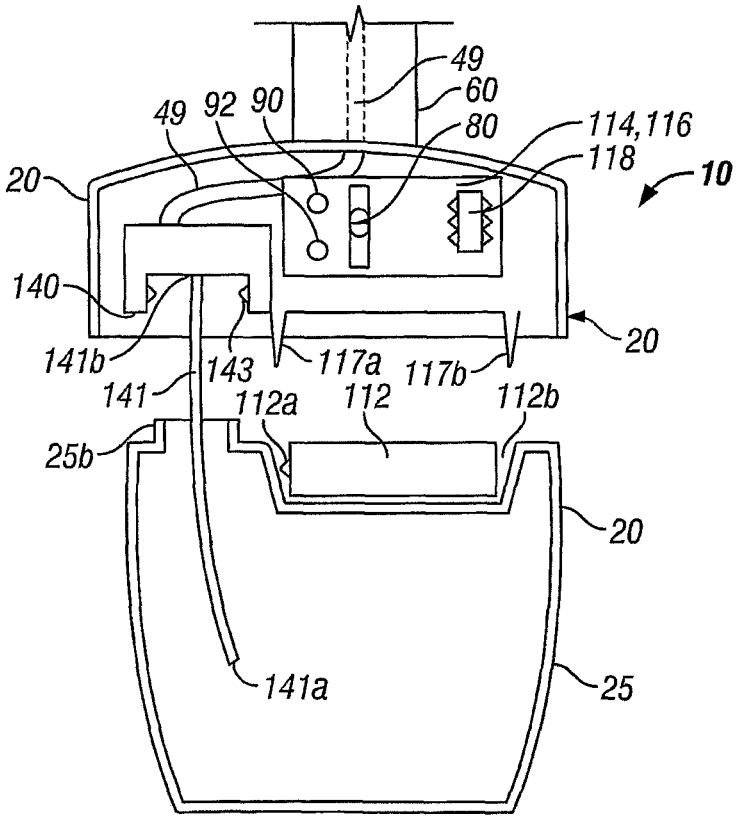
FIG. 23 depicts a still further embodiment of an improved automatic toilet bowl device of the invention which includes a refill cartridge.

FIG. 23 depicts in a cross-sectional view a further embodiment of a device 10 according to the present invention which includes many features common to the embodiment of the device 10 according to FIGS. 22A, 22B. The body part 20 of the device 10 is separated into two sections 20, 25 the latter being refill cartridge 25. The refill cartridge 25 comprises a neck portion 25*b* which is open, and which is also insertable within part of the pump 140 of the body 20 which is operated by the controller means 114 responsive to appropriate signals provided thereby. The refill cartridge 25 also includes one or more batteries 112 which are retained by the refill cartridge 25, which may be one or more single use batteries or rechargeable batteries, which provide a power supply to operate the a controller means 114 when the two sections 20, 25 are assembled. During insertion of the refill cartridge 25 into the body 20, the terminals 112*a* and 112*b* of the one or more batteries 112 coming to electrical contact with suitably dimensioned contacts 117*a*, 117*b* which come into contact with corresponding terminals 112*a* and 112*b* and are retained in contact with said corresponding terminals 112*a* and 112*b* while you refill cartridge 25 is connected to form a part of the body 20. Such provides for means for carrying current between the one or more batteries 112 and the controller means 114, thereby providing a power source for the controller means 114. A particular advantage of the embodiment illustrated in FIG. 23 is that replacement of the refill cartridge 25 simultaneously provides any new supply of the liquid treatment composition to the device 10, as well as a new battery or batteries 112 to the device 10. Such simultaneous supply of these components improves the likelihood that the device 10 will operate properly during the intended service life of the refill cartridge 25 as the size out of the one or more batteries 112 can be selected and provided to ensure that sufficient electrical power is supplied to the device 10 until the liquid treatment composition within the refill cartridge 10 is consumed.

Further visible on FIG. 23 is controller means 114 which comprises a circuit board 116 upon which are mounted one or more electronic components 118, as well as a sliding-type switch 80 and indicator means, LEDs 90, 92. The switch 80 and more specifically its state may be used to provided appropriate signal inputs to the controller means 114 and may fulfill any variety of functions which require user interaction. For example, in one position or state the switch 80 can be utilized to turn the device 10 off and on; alternately movement of the switch between two or more positions or states may be used to provide a program input to the controller means 114 whereas, for example, the time period between automatic dispensing of the liquid treatment composition through the fluid spray means 100 may be varied. Additionally, or alternately thereto, the switch 80 may be used to initiate dispensing of the liquid treatment composition from the fluid spray means 100, which dispensing can be immediate or concurrent with the operation of the switch, or which dispensing can be delayed subsequent to the operation of the switch by a consumer or user. The controller means 114 also controls the operation of the LEDs 90, 92. For example, one or more of the LEDs 90, 92 can be programmed to operate in response to certain conditions and thereby provide a visual indicator to a consumer or user. For example, the one more indicator means can provide an indicator of the status of the dispensing of the liquid treatment composition; the status of the level of liquid or fluid in the refill cartridge, an indication that the battery or other power source needs to be changed or replenished, or may be used to indicate a fault condition indicating improper operation or malfunction of the device 10. Additionally while not shown in the figure, an audible sound source can also be provided to provide an audible sound or signal, which can be as simple "beep", or can be a song, tune, or melody to indicate the particular status of the device.

Depicted in some detail in FIG. 23 is a suitable sealing means which is supplied as a suitably sized gasket, washer or o-ring 143 which forms a part of the pump 140. When the refill cartridge 25, more specifically the neck portion 25*b* thereof is inserted in the pump 140, the neck portion 25*b* comes into a sealing engagement with the o-ring 143 and forms a seal therebetween. Preferably this sealing means between the refill cartridge 25 and the pump 140 is sufficient to physically support the refill cartridge 25 when it is affixed as part of the body 20.

Further visible from FIG. 23 is a pump supply tube 141 extending downwardly from the pump 140 which at its distal end 141 a is dimensioned to extend downwardly into the interior of the refill cartridge 25 through the neck 25*b*, and at its proximal end 141*b* is in fluid communication with the pump 140. The pump supply tube 141 provides a conduit through which the liquid treatment composition contained within the refill cartridge 25 may be withdrawn therefrom, and supplied to the pump 140. Further partially visible is the fluid conduit 49 which is represented in the figure as passing underneath a part of the hanger means 60 so that it is obscured from view when the device 10 is mounted on the rim 202 of a toilet bowl 200. While not visible in the figure, it is understood that one end of the fluid conduit 49 is in fluid communication with an output of the pump 140, while the other end of the fluid conduit 49 is include the fluid spray means 100. Thus, in operation that the device 10 can be used to automatically, semi-automatically or manually supply a quantity of a liquid treatment composition present within the refill cartridge 25 to the interior of a toilet bowl.

Figure 24A:
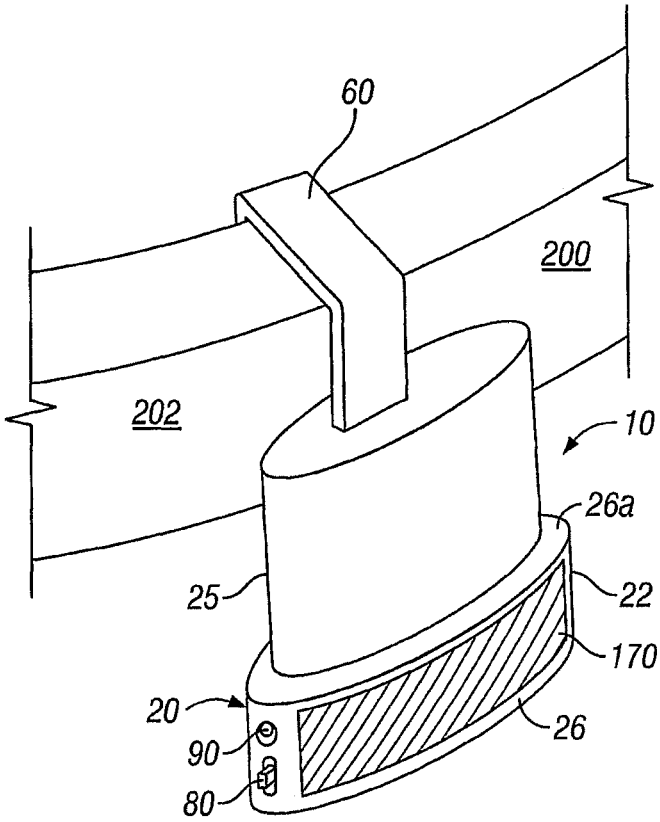
FIGS. 24A and 24B illustrates a yet further embodiment of an improved automatic toilet bowl device of the invention which includes a refill cartridge.
Figure 24B:
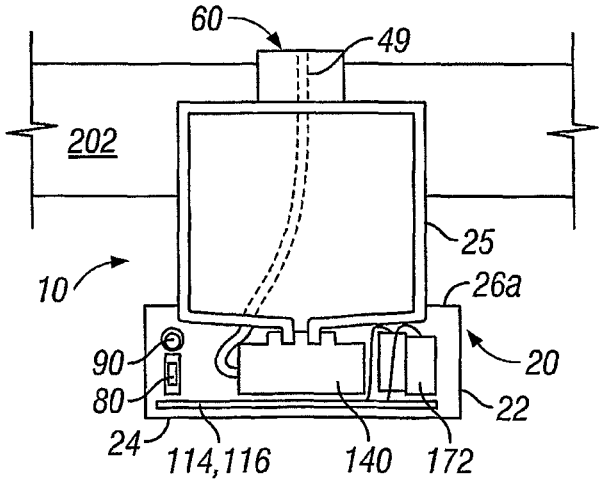

Turning now to FIGS. 24A, 24B they're presented in further views a yet further embodiment of the device 10 according to the present invention. The specific embodiment illustrated in these two figures comprises a top mounted refill cartridge 25 as part of the body 20 of the device, which device 10 is illustrated as being suspended from a section of a toilet bowl rim 202 of a toilet bowl 200. The specific embodiment illustrated in these two figures also comprises a photovoltaic power source.

With respect first to FIG. 24A, in a perspective view is visible the device 10 whose body 20 which includes a housing 22 having a bottom 24, and opposite thereto a top face 26*a*, and a front sidewall 26, upon which is mounted, or otherwise through which is visible a photovoltaic panel 170 which converts electromagnetic radiation, including but not limited to sunlight, visible light, or infrared energy into electrical current. Further visible as part of or extending through the front sidewall 26 are a switch 80, here depicted as a sliding-type switch which can be moved through several positions as well as a visual indicator means here a LED 90. Turning now to FIG. 24B, there is depicted in a partial cross-sectional view certain details within the interior of the housing 22. As is visible there from, the housing 22 contains a pump 140, and controller means 114 which comprises a circuit board 116 upon which are mounted one or more electronic components 118, and having in electrical contact therewith the switch 80 and visual indicator means, LED 90. Further visible within the interior of the housing 22 are one or more capacitors 172 and/or one or more rechargeable batteries 172 which may be used to store electrical power generated by the photovoltaic panel 170 for later use by the controller means 114. A particular advantage of using such a photovoltaic panel 170 is that when it is used in conjunction with a storage means for storing an electrical charge, i.e. a battery and or a capacitor, the need for any removable single-used a battery can be obviated. Additionally, the use of a photovoltaic panel 170 is also particularly desirable from a consumer standpoint as a such is the operative on the one hand, and does not require the replacement of the batteries whose disposal are a growing environmental concern. The controller means 114 may thus obtains its power from the one or more capacitors 172 and/or one or more rechargeable batteries 172, in order to control the operation of the device 10, and more particularly, control the operation of the pump 140 responsive to appropriate signals provided by the controller means 114.

FIGS. 25A, 25B, 25C and 25D presented different views of a further embodiment of a device 10 according to the present invention, wherein said device 10 includes a plurality of fluid reservoirs 27*a*, 27*b* in place of the single fluid reservoir 25 described with reference to prior figures and embodiments of the invention.

Figure 25A:
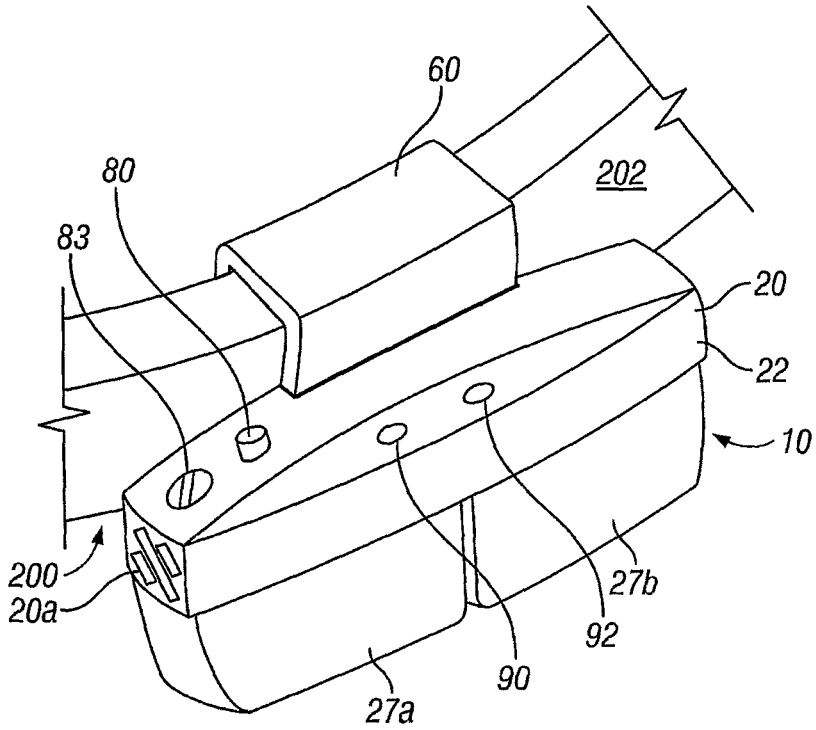
FIGS. 25A, 25B, 25C and 25D depict embodiments of an improved automatic toilet bowl device of the invention which include a refill cartridge(s) or a plurality of fluid reservoirs.

With regard to FIG. 25A therein is depicted in a perspective view a device 10 which includes a body 20, having as parts thereof a first removable fluid reservoir 27A, and a second removable fluid reservoir 27B, a hanger means 60 by which the body 20 is suspended on the rim 202 of a toilet bowl 200, a switch 80, here of the push-button type, and indicator means, LEDs 90, 92, a sensor means 83, and a grill 20*a* providing a series of apertures passing through the housing 22 of the body 20.

Figure 25B:
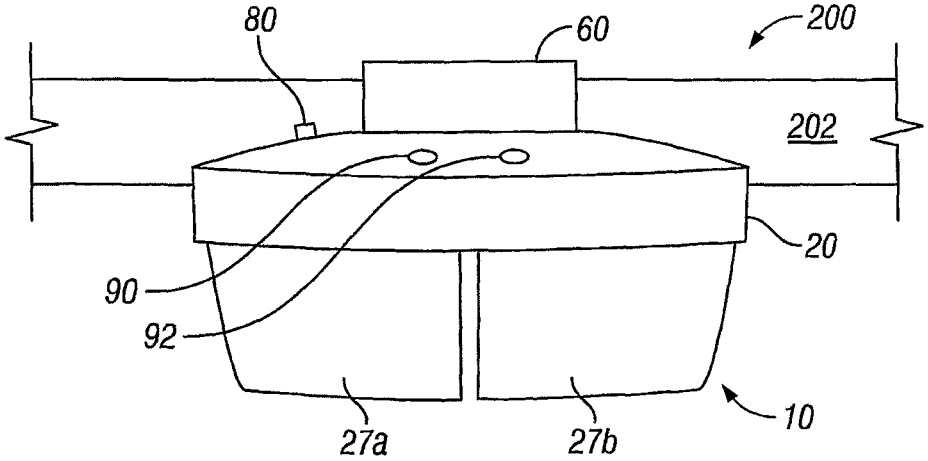

With regard to FIG. 25B, therein is depicted in a plan frontal view the device 10 illustrating the arrangement of the various elements thereof.

Figure 25C:
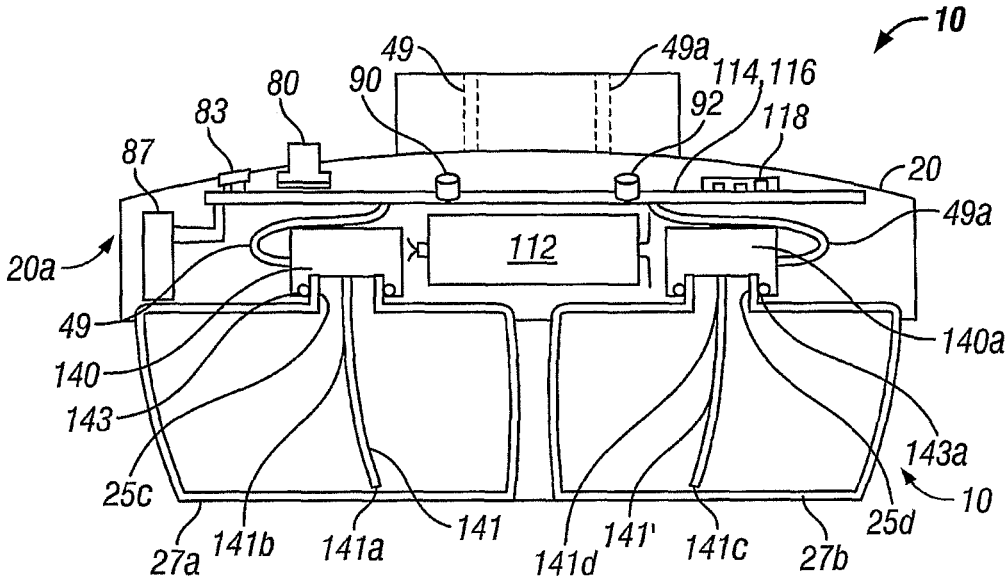

Turning now to FIG. 25C, there is illustrated a cross-sectional view of the device 10 illustrating certain interior details. Visible are the separate first removable fluid reservoir 27A, and a second removable fluid reservoir 27B, each of which respectively also provide a first refill cartridge 27A and a second refill cartridge 27B, each of which includes a respective neck portion 25*c*, 25*d* which is also insertable within part of a respective pump 140, 140*a* each of which is operated by the controller means 114 responsive to appropriate signals provided thereby. Further visible are one or more batteries 112, which may be one or more single use batteries or rechargeable batteries, which provide a power supply to operate the a controller means 114 which is used to control circuitry used to control the operation on the improved automatic toilet bowl treatment device 10. The controller means comprises a circuit board 116 upon which are mounted one or more electronic components 118, as well as switches 80, sensor 83, an audible sound source 87 and as visual indicator means, LEDs 90, 92. The switch 80 and/or sensor 83 may be used to provided appropriate signal inputs to the controller means 114 and may fulfill any variety of functions which require user interaction. For example, switch 80 can be utilized to turn the device 10 off and on; alternately it may be used to provide a program inputs to the controller means 114 whereas, for example, the time period between automatic dispensing of the liquid treatment composition through the fluid spray means 100 may be varied by interaction of the user with switch 80. Additionally, or alternately thereto, switch 80 may be used to initiate dispensing of the liquid treatment composition from the fluid spray means 100, which dispensing can be immediate or concurrent with the operation of switch 80, which dispensing can be somewhat delayed subsequent to the operation of switch 80 by a consumer or user. The sensor 83 may be any type of sensor which may be used to measure a condition in the ambient environment or a change in the status of a condition in the ambient environment within which the device 10 is located. By way of non-limiting example suitable sensors 83 may detect the near proximity of a human user to device 10, such as via a heat sensor, an infrared sensor, or a passive infrared sensor in order to control or modify the operating characteristics of the device 10. For example such a sensor which detects the near proximity of a human user to the device may send an appropriate output signal to the controller means 114 which they respond to thereto, such that, for example the dispensing of the liquid treatment composition is delayed until a specific sensor condition, such as the departure of the human user from the proximity of the lavatory appliance upon which the device 10 is mounted, is determined. In this manner, the use of such a sensor to cause a pause or delay in the programmed dispensing is advantageous in order to avoid undesirable or untimely spraying of the liquid composition so avoid contact of the same with the human user. A still further form of a sensor 83 may be an audible sensor, wherein the ambient sound level of the improved automatic toilet bowl treatment device is determined it on a continuous basis, or on a periodic basis, and to output an appropriate signal to the controller means 114 which may appropriately respond to thereto. The one or more of the LEDs 90, 92 can be programmed to operate responsive to certain conditions and thereby provide a visual indicator to a consumer or user. For example, the one more indicator means can provide an indicator of the status of the dispensing of the liquid treatment composition; the status of the level of liquid or fluid in the refill cartridge, an indication that the battery or other power source needs to be changed or replenished, or a fault condition indicating improper operation or malfunction of the device 10. The audible sound source 87 whose sound can be heard through the can also be provided to provide an audible sound or signal, which can be as simple "beep", pattern of such "beeps" or can be a melody to indicate a particular status of the device 10.

As depicted on FIG. 25C the device 10 includes a first refill cartridge 27*a* and a second refill cartridge 27*b*, each of which includes a respective neck portion 25*c*, 25*d* each of which is insertable within part of a respective pump 140, 140*a*. The first pump 140 includes as a sealing means an o-ring 143 which is suitably dimensioned to engage the neck portion 25*c* of the first refill cartridge 27*a* and to provide a liquid tight seal therewith. Preferably also, the sealing means also provide sufficient support whereby the first refill cartridge 27*a* can be physically retained as part of the body 20 of the device. Similarly the second pump 140*a* also includes as a sealing means an o-ring 143*b* as a part thereof, which is suitably dimensioned to engage the neck portion 25*d* of the second refill cartridge 27*b* and to provide a liquid tight seal therewith. Preferably also, this sealing means also provide sufficient support whereby the second refill cartridge 27*b* can be physically retained and mounted as part of the body 20 of the device 10.

Figure 25D:
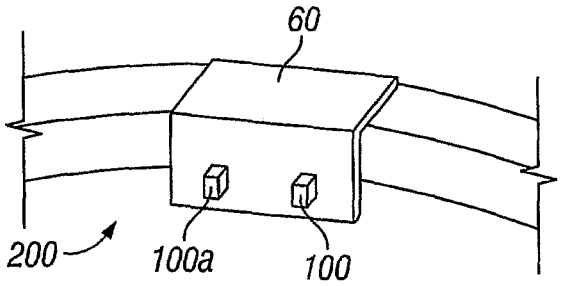

Extending downwardly from their respective first pump 140 and second pump 140*a* are respective pump supply tubes 141, 141' each of which is dimensioned to extend downwardly into the interior of a respective refill cartridge 27*a*, 27*b*. Each of the pump supply tubes 141, 141' respectively include a distal end, 141*a*, 141*c* and at the opposite end thereof a respective proximal end 141*b*, 141*d* which are in fluid communication with respective pumps 140, 140*a*. It is to be understood that the pump supply tubes 141, 141' each provides a conduit through which the liquid treatment composition contained within a respective refill cartridge 27*a*, 27*b* may be withdrawn therefrom, and supplied to respective pumps 140, 140*a*, from whence the liquid treatment composition is supplied via respective fluid conduits 49, 49*a* to corresponding respective fluid spray means 100, 100*a*. The relative positioning out of the fluid spray means 100 with respect to one another, as well as with respect to the inner sidewall 207 of the toilet bowl rim 202 is illustrated in FIG. 25D. As can be seen thereon, the respective fluid spray means 100, 100*a* which are understood to be separately supplied by liquid treatment compositions which are supplied via separate respective refill cartridges 27*a*, 27*b* are illustrated to be in a generally horizontal relationship, albeit slightly spaced apart with respect to one another. This is however to be understood as being an illustrative, but not a limiting relationship and other arrangements of the respective fluid spray means 100, 100*a* with respect to one another upon the hanger means 60 are contemplated. For example, it is clearly anticipated that the respective fluid spray means 100, 100*a* maybe be positioned abutting each other in a side-by-side arrangement, or may be placed either abutting one another or separated from one another in a diagonal arrangement, or maybe positioned either abutting one another or spaced apart from one another in a vertical arrangement.

The embodiment of the device 10 as is illustrated and described with reference to FIGS. 25A, 25B, 25C and 25D provides for certain unique characteristics, including certain unique operating characteristics which are not achievable by the use of a device 10 described in the prior figures. First, the provision of multiple, here as dual refill cartridges 27*a*, 27*b* allow for a degree of flexibility with respect to the nature of the liquid treatment compositions provided for use with the device 10. For example, it is contemplated that one of the liquid treatment compositions may be provided primarily for a cleaning and/or sanitization operation and may exclude one or more constituents, such as colorants and/or perfumes, which such constituents are included primarily only for providing an aesthetic benefit, while the other of the liquid treatment compositions may be provided primarily for imparting such an aesthetic benefit and maybe formulated to provide one or more constituents such as colorants and/or perfumes which are primarily used to impart an aesthetic benefit, and include little or no constituents which are provided primarily for a cleaning and/or sanitization operation. Alternately, the provision of multiple, here depicted as dual refill cartridges 27*a*, 27*b* also permits for the use of a liquid treatment composition which may be characterized as being a "two-part" treatment composition wherein one or more constituents or components of the first liquid treatment composition react on contact with certain other constituents or components of the second liquid treatment composition in order to provide a specific technical and/or aesthetic benefits. For example, it is known that many oxidizing agents, including peroxides, bleaches and precursors thereof may be unstoppable in the presence of certain surfactants, which surfactants might providing improved cleaning benefits. Thus, it is contemplated that a first liquid treatment composition comprising an oxidizing agent, such as a peroxide, bleach or precursor thereof is provided to a first refill cartridge 27*a*, while a second liquid treatment composition comprising one or more constituents, such as one or more surfactants which may induce or cause instability of the oxidizing agent when placed in a mixture containing the oxidizing agent is provided to a second refill cartridge 27*b*. The respective first refill cartridge 27*a* and second refill cartridge 27*b* thereby providing means for keeping these constituents separate up until they are dispensed via the respective fluid spray means 100, 100*a* into the interior of a toilet bowl 206 within which they come into contact with one another. In such a manner, he separate parts of the aforesaid two-part treatment composition may be stably provided and stored until actual use. Further examples of "two-part" treatment compositions which may be supplied by the device 10, and dispensed therefrom include compositions which include constituents which are reactive when combined with each other, but did not react when isolated from one another. For example, such a reaction may cause the generation of a gas, the generation of a foam, or cause an evolution of heat from the mixed reactants, e.g., an exothermic reaction. The reactive constituents may be isolated from one another, until just prior to make sink, by separately providing them into one or more refill cartridges, such as a first refill cartridge 27*a* and second refill cartridge 27*b* wherein they may be stably stored, and only brought into contact upon mixing. An exemplary two-part composition which generates copious amounts of a foam upon mixing of its separate parts, and also provides a good cleaning benefit is disclosed in published US 2006-0276366 A1, the contents of which are herein incorporated in its entirety by reference thereto.

A still further advantage of the use of multiple refill cartridges in a device according to the invention is in that a user may selectively refill only those cartridges present on the device which require refilling or replenishment.

A yet further advantage of the use of multiple refill cartridges in a device according to the invention is that via appropriate configuration of the controller means 114 various modes of fluid delivery may be achieved. In its simplest form, the controller means 114 may be configured to simultaneously deliver equal amounts of the various liquid treatment compositions present in the multiple refill cartridges present in the device. Alternately, the controller means may be configured to non-simultaneously deliver equal amounts of the various liquid treatment compositions present in the multiple refill cartridges present in the device, i.e., in a sequential mode wherein a first liquid treatment composition is dispensed and immediately subsequently thereto, or shortly (e.g. within 0.1-60 seconds) subsequently thereto dispense a second or a further liquid treatment composition is dispensed from the device. Still further, the controller means may be configured to independently deliver various liquid treatment compositions present in the multiple refill cartridges present in the device in accordance to independent periods or schedules which have been programmed or otherwise provided to the controller means 114. Yet further, the controller means may be configured to independently deliver various liquid treatment compositions present in one or more of the multiple refill cartridges present in the device responsive to a signal input. For example, the device may be configured in that dispensing of a liquid treatment composition which is primarily intended to provide a cleaning benefit present in the device is delivered only according to a programmed periodic interval which has been provided to the controller means, while the dispensing of a liquid treatment composition present in the device which is primarily intended to provide an aesthetic benefit, such as providing the release of a fragrance or order masking composition may be cause to occur at any time due to manual intervention by user, such as by depressing a switch provided as part of the device. Other modes of operation, albeit not specifically recited herein, are nonetheless contemplated to be useful in conjunction with a device according to the invention having at least two liquid treatment compositions which may be conveniently, although not necessarily provided by two (or more) refill cartridges.

Although not illustrated in any of the figures, it is to be noted as well as to be understood that whereas the embodiment according to FIGS. 25A, 25B, 25C and 25D illustrated device 10 which includes dual, separate fluid spray means 100, 110*a* which are separately supplied by separate fluid conduits 49, 49*a*, it is to be understood that prior to, or upstream of any fluid spray means 100 the separate fluid provided by the separate fluid conduits 49, 49*a* may be combined, such as by the use of a conventional "Y"-type connector such that the separate liquid treatment compositions are intermixed prior to entry into the fluid spray means 100. In such a manner, a single fluid spray means 100 may be provided to dispense the mixture of two, or more different liquid treatment compositions through a single fluid spray means 100.

Depicted in FIGS. 26A1 and 26A2 respectively illustrate a cross-sectional view of a further embodiment of an improved dispensing device 10 according to the invention, as well as a perspective view of a part of the said device 10. As illustrated, the device 10 includes a rigid hanger means 60 which further includes an adjustably moveable stabilizer means 121 which device 10 is adapted to be suspended from a section of a toilet bowl rim of a toilet bowl (not shown.) The device 10 comprises a body 20 depending from a hanger means 60 which is adapted engaged upon a section of the toilet bowl rim, and thereby suspending the body 20 on the exterior of the toilet bowl rim and the entire device 10 from the toilet bowl rim. With respect to the body 20, the body 20 includes a housing 22 which includes a housing base plate 22*a* beneath which is removably affixed a refill cartridge 25, and a portion through which passes a neck portion 25*b* of said refill cartridge 25 which is covered by a suitable, breachable sealing means 25*j*, which when breached provides for a suitable liquid tight seal between the pump 140 and the neck portion 25*b* of the refill cartridge 25, but prior to being opened or breached, provides a liquid tight seal such that the contents of the interior of the refill cartridge are not spilled. As visible from the figure, the hanger means 60 has a proximal end 62 which is affixed to a part of the body 20, a first hanger segment 64 which extends from the body 20 and continues to a second hanger segment 66, which second segment which in adapted to lie atop of or alternately extend generally parallel to the top surface of the toilet bowl rim, which segment extends to a third hanger segment 68 which extends downwardly towards the interior of the toilet bowl when the device 10 is mounted thereon. The fluid spray means 100 is also illustrated as extending from the distal end 69 of the hanger means and is directed away from the body 20, so that in operation, the fluid spray means 100 provides the liquid treatment composition to the interior of a toilet bowl.

The adjustably moveable stabilizer means 121 includes a central bore 123 which surrounds a part of the third hanger segment 68 and which is movable with respect to thereto, such that stabilizer means 121 may be moved toward, or away from the distal end 69 of the hanger 20. The stabilizer means 121 includes a retention means, here depicted as a pawl 125 which cooperates with, and engages a part of the hanger 20, and in particular with at least a part of the third hanger segment 68 in order to provide a movable, but fixable position of the stabilizer means 121 with respect to the third hanger segment 68. In the depicted embodiment, the pawl 125 engages part of a toothed rack 127 which his forums or a fixed part of the third hanger segment 68 and which extends along at least a part of the length of the third hanger segment 68. The dimensions of the stabilizer means 121 and its various elements, as well as the third hanger segment 68 and its corresponding various elements are advantageously dimensioned such that a user of the device can easily position and/or relocate the relative position of the stabilizer means 121 with respect to the hanger 20, and in particular with respect to the third hanger segment 68. Thereby, one more hooks 70 which depends from the stabilizer means 121 may be moved towards or away from the second hanger segment 66 and when installed upon the rim of a 12 bowl, the one or more hooks 70 may be engaged beneath the portion of the rim of a toilet bowl and thereby provide a more stable mounting of the device 10 thereon. Further depicted as extending from a part of the stabilizer means 121 are two extended metal or metallic pins 78A, 78B, herein the form of each independently connected to conductors (not shown) which may conduct an electrical signal or current suitable controller means (not shown). As can be seen from their relative position, the pins 78A, 78B are intended to be placed within the path of flushing water which is released from beneath the rim of a toilet bowl, and which can be used to sense the presence of said flushing water during the flush cycle of a toilet bowl, such that when the device of the invention is suspended on a lavatory appliance, during a flush cycle, flush water comes into simultaneous contact with both of the conducting terminals 78A, 78B. Such contact with water provides for a pathway for electrons across the conducting terminals 78A, 78B and may be used to sense or provide a current or circuit between the two conducting terminals 78A, 78B or a reduction in the resistance between the two conducting terminals 78A, 78B can be sensed as a condition and used by the controller means to control one or more further functions of the device of the invention and/or processes for operating the device according to the invention. This signal can be used to control a portion of the operation of the device 10 as described elsewhere herein, e.g. with respect to the embodiments of FIGS. 11F, 11G.

FIGS. 26B1, 26B2 and 26B3 illustrate various views of a still further embodiment of an improved dispensing device 10 according to the present invention. As best seen from the cross-sectional representation of FIG. 26B1, the device 10 includes a rigid hanger means 60 a portion of which is telescoping in order to provide a means for adjusting the overall length of the hanger means 60 as maybe desired or required in order to suitably amounted the device 10 upon a portion of the rim 202 of a toilet bowl 200. The device 10 comprises a body 20 depending from a hanger means 60 which is adapted engaged upon a section of the toilet bowl rim, and thereby suspending the body 20 on the exterior of the toilet bowl rim and the entire device 10 from the toilet bowl rim. With respect to the body 20, the body 20 includes a housing 22 which includes a housing base plate 22*a* beneath which is removably affixed a refill cartridge 25, a part of which extends partially thereto, namely the neck portion 25*b* of said refill cartridge, and sealing means 25*j*. As visible from these figures, the hanger means 60 has a proximal end 62 which is affixed to a part of the body 20, a first hanger segment 64 which extends from the body 20 and continues to a second hanger segment 66, which second segment which in adapted to lie atop of or alternately extend generally parallel to the top surface of the toilet bowl rim, which segment extends to a third hanger segment 68 comprised of two segments 68*a* and 68*b* which extends downwardly towards the interior of the toilet bowl when the device 10 is mounted thereon. The fluid spray means 100 is also illustrated as extending from the distal end 69 of the hanger means and is directed away from the body 20, so that in operation, the fluid spray means 100 provides the liquid treatment composition to the interior of a toilet bowl. As is visible from the figure, the lower third hanger segment 68*b* is slideable with respect to the upper third hanger segment 68*a* and these two respective third hanger segments 68*a*, 68*b* can be virally positioned with respect to one another. Thus, the overall length of the third hanger segment 68 of the hanger 60 can be modified. As is readily seen from the perspective view presented in FIG. 26B2, the lower third hanger segment 68*b* includes a retention means, here depicted as a pawl 125 which cooperates with, and engages a part of the upper third hanger segment 68 in order to provide a movable, but fixable position of the lower third hanger segment 68*b* with respect to the upper third hanger segment 68*a*, and concurrently also establishing an overall length of the third hanger segment 68. In the depicted embodiment, the pawl 125 engages part of a toothed rack 127 which is formed within or is affixed to a portion of the upper third hanger segment 68*a* and which extends along at least a part of the length of the upper third hanger segment 68*a*. The dimensions of these various elements, are such that a user of the device can easily position and/or relocate the relative position hooks 70 which depend from the lower third hanger segment 68*b* with respect to the hanger 20, and in particular with respect to the second hanger segment 66. Thereby, one more hooks 70 which depends from the lower third hanger segment 68*b* may be moved towards or away from the second hanger segment 66 and when installed upon the rim of a 12 bowl, the one or more hooks 70 may be engaged beneath the portion of the rim of a toilet bowl and thereby provide a more stable mounting of the device 10 thereon With respect to the interior details, as is visible from FIG. 26B1, a lower tube 129 is present within the interior of the lower third hanger segment 68*b*, which lower tube 129 is in fluid communication with the a fluid conduit 49 which extends from the body 20 and through which the liquid treatment composition is propelled. Advantageously, a lip seal 129*a* provides for a slidable, yet to liquid tight seal between the exterior of the lower tube 129 and the a fluid conduit 49. Other a27C1ngements for providing such a flexible fluid connection may also be used, and are considered as falling within the scope of the currently disclosed invention.

FIG. 26B3 illustrates a cross-sectional view of a part of the second hanger segment 66 along the plane defined by line aa-bb of FIG. 26B 1. As is visible thereon, the second hanger segment 66 includes at least one channel 66*a* within which said channel passes the a fluid conduit 49 through which the liquid treatment composition is transported between the body 20 and the fluid spray means 100. In the specific embodiments depicted on the figure, three such channels are illustrated and the a fluid conduit 49 is positioned within that the centermost of these channels 66*a*

FIG. 27B4 illustrates a partial plan view of the lower third hanger segment 68*b* from the forward direction. As illustrated in the figure, a fluid spray means 100 is directed forwardly, and in this embodiment, the lower third hanger segment 68*b* includes two rearwardly directed hooks 70 which extend outwardly and curve rearwardly from the lower third hanger segment 68*b*. As is seen in FIG. 27B4, each of the two rearwardly directed hooks 70 are substantially identical with respect to one another, and are symmetrically positioned to extend perpendicularly from opposite sides of the lower third hanger segment 68*b*. This relative positioning is better depicted in the a cross-sectional view along line cc-dd of FIG. 27B4, which is presented in FIG. 27B5.

FIG. 27B6 illustrates a schematic side view of the device 10 as mounted upon a portion of the rim 202 of a toilet bowl. As is visible there from, the device 10 is suspended therefrom, with the body 20 on the exterior of the toilet bowl 200 and is adjacent to a portion of the rim 202, the hanger means 60 spanning the top of the rim 202, and the third hanger segment 68 (comprised of upper third hanger segment 68*a*, and lower third hanger segment 68*b*) suitably dimensioned such that the hook(s) 70 extends just beneath the bottom interior bottom margin 208 of the toilet bowl rim 202 and rests against, abuts, or otherwise at least partially comes into contact with the bottom interior bottom margin 208 of the toilet bowl rim 202.

Various illustrative embodiments of anti-counterfeiting elements and means are disclosed in the following figures. It is to be understood that such are provided as illustrative, but non-limiting examples of useful embodiments of the dispensing devices which provide an anti-counterfeiting feature.

FIGS. 27A1, 27A2, and 27A3 illustrate an embodiment of a refill cartridge 25 adapted to be installed in the improved automatic toilet bowl treatment device according to the invention, which refill cartridge 25 includes elements which form part of an anti-counterfeit detection means, and wherein the said device also includes a complementary part(s) of the anti-counterfeit detection means. Depicted on FIG. 27A1 is a perspective view of a part of a refill cartridge 25 which comprises a neck portion 25*b* of said refill cartridge 25 which is covered by a suitable, breachable sealing means 25*j*, which when breached provides for a suitable liquid tight seal between the pump (not shown) and the neck portion 25*b* of the refill cartridge 25, but prior to being opened or breached, provides a liquid tight seal such that the contents of the interior of the refill cartridge 25 are not spilled. The sealing means 25*j* includes a portion, here depicted as a lateral extension 25*r* which includes on an outer surface thereof an electrical conductor element 25*m*. In the depicted embodiment, the electrical conductor element 25*m* is a metallic or metal strip which enrobes a least a part of the outer surface of the lateral extension 25*r*. FIG. 27A2 presents a top plan view of a portion of the refill cartridge 25 mounted beneath a housing base plate 22*a* of a portion of a body 20 (not shown) of a device 10 according to the invention. Visible in the figure is an aperture 22*b* passing through the housing base plate 22*a* which is dimensioned similar to a "keyhole" in order to permit for the pa27B1ge of their through of a least a portion of the neck portion 25*b* of said refill cartridge 25 the sealing means 25*j*, and the electrical conductor element 25*m* which extends at least partially into the interior of the body 20 (not shown). The housing base plate 22*a* includes a pair of spaced-apart, opposing metal leaf springs 29*a*, 29*b* which are configured such that, when a genuine refill cartridge 25 which includes the sealing means 25*j* having a properly configured the electrical conductor element 25*m*, when properly inserted said genuine refill cartridge 25 causes the electrical conductor element 25*m* to come into contact with both of the metal leaf springs 29*a*, 29*b*. Such a mechanical connection also provides a potential to provide an electrical connection whereby, an electrical circuit may be closed by the electrical conductor element 25*m* providing electrical connection between the pair of spaced-apart, opposing metal leaf springs 29*a*, 29*b*. Such an electrical circuit, that is to say the absence or alternately, the presence thereof, can be used by the controller means in order to validate the presence of a properly inserted and genuine refill cartridge 25 which is installed within the device 10, and to permit for the proper operation or for a specific mode of operation of the dispensing device 10 according to the invention. Alternately, where a counterfeit refill cartridges attempted to be used in conjunction with the device 10, the lack of a closed electrical circuit between the pair of spaced-apart, opposing metal leaf springs 29*a*, 29*b* can be sensed by the controller means, and denying the proper operation of the dispensing device 10, and/or provide a signal to the user that a counterfeit refill cartridge has attempted to be installed and used.

FIGS. 27B1, 27B2 and 27B3 illustrate a further embodiment of a refill cartridge 25 adapted to be installed in the improved automatic toilet bowl treatment device according to the invention, which refill cartridge 25 includes elements which form part of an anti-counterfeit detection means, and wherein the said device also includes a complementary part (s) of the anti-counterfeit detection means. Depicted on FIG. 27B1 is a perspective view of a part of a refill cartridge 25 which comprises a neck portion 25*b* of said refill cartridge 25 which is covered by a suitable, breachable sealing means 25*j*, which when breached provides for a suitable liquid tight seal between the pump (not shown) and the neck portion 25*b* of the refill cartridge 25, but prior to being opened or breached, provides a liquid tight seal such that the contents of the interior of the refill cartridge 25 are not spilled. The sealing means 25*j* includes a portion, here depicted as a lateral extension 25*r* which includes a metal or metallic pin 25*p* which extends upwardly therefrom. FIG. 27B2 depicts his side, partial cross-sectional view of portions of a dispensing device 10 according to the invention including the refill cartridge 25 mounted against the housing base plate 22*a* forming part of a body 20, through which housing base plate 22*a* extends the neck portion 25*b* of the refill cartridge 25, sealing means 25*j*, and metal or metallic pin 25*p*. The sealing means 25*j* is to be understood as having been breached which provides for fluid communication of the contents of the refill cartridge 25 with the pump 140. Further, as is better viewed with respect to the perspective view of FIG. 27B3 depicts part of the mounted refill cartridge 25 and part of the body 10, there is now more clearly visible that a portion of the metal or metallic pin 25*p* extends through a part of the housing base plate 22*a* and comes into contact with each of a pair of spaced-apart, opposing metal leaf springs 29*a*, 29*b*. As described previously, such a mechanical connection also provides a potential to provide an electrical connection whereby, an electrical circuit may be closed by the pin 25*p* providing electrical connection between the pair of spaced-apart, opposing metal leaf springs 29*a*, 29*b*. Such an electrical circuit, that is to say the absence or presence thereof, can be used by the controller means in order to validate the presence of a properly inserted and genuine refill cartridge 25 which is installed within the device 10, and to permit for the proper operation or for a specific mode of operation of the dispensing device 10 according to the invention. Alternately, where a counterfeit refill cartridges attempted to be used in conjunction with the device 10, the lack of a closed electrical circuit between the pair of spaced-apart, opposing metal leaf springs 29*a*, 29*b* can be sensed by the controller means, and denying the proper operation of the dispensing device 10, and/or provide a signal to the user that a counterfeit refill cartridge has attempted to be installed and used.

FIGS. 27C1, 27C2, 27C3 and 27C4 illustrate a further embodiment of a refill cartridge 25 adapted to be installed in the improved automatic toilet bowl treatment device according to the invention, which refill cartridge 25 includes elements which form part of an anti-counterfeit detection means, and wherein the said device also includes a complementary part(s) of the anti-counterfeit detection means. FIG. 27C1 depicts in a perspective view a refill cartridge 25 which comprises a neck portion 25*b* which is covered by a suitable, breachable sealing means 25*j*, which when breached provides for a suitable liquid tight seal between the pump (not shown) and the neck portion 25*b* of the refill cartridge 25, but prior to being opened or breached, provides a liquid tight seal such that the contents of the interior of the refill cartridge 25 are not released. Separate from the neck portion 25*b* and the sealing means 25*j* is a key means, here a post 25*x* which is spaced apart from the neck portion 25*b* and extends upwardly from the refill cartridge 25 in the same direction as the neck portion 25*b*. The post 25*x* need not be electrically conductive but can be formed to any material, e.g. may be an in integrally formed element are part of the refill cartridge 25. FIG. 27C2 presents a top plan view of a portion of the refill cartridge 25 mounted beneath a housing base plate 22*a* of a portion of a body 20 (not shown) of a device 10 according to the invention. Visible in the figure is an aperture 22*b* passing through the housing base plate 22*a* which is dimensioned in order to permit for the pa27B1ge of therethrough of a least a portion of the neck portion 25*b* of said refill cartridge 25 and the sealing means 25*j*. While not visible in the figure, a second aperture passing through a part of the housing base plate is also present and is positioned with us to accommodate the post 25*x* which passes their through beneath a pair of spaced-apart, opposing metal leaf springs 29*a*, 29*b* which are configured such that, when a genuine refill cartridge 25 which includes the post 25*x* is properly inserted, said genuine refill cartridge 25 urges the normally space-apart metal leaf springs 29*a*, 29*b* together. Such a mechanical connection between the metal leaf springs 29*a*, 29*b* also provides a potential to provide an electrical connection whereby, an electrical circuit may formed. Such an electrical circuit, that is to say, the absence or the presence thereof, can be used by the controller means in order to validate the presence of a properly inserted and genuine refill cartridge 25 which is installed within the device 10, and to permit for the proper operation or for a specific mode of operation of the dispensing device 10 according to the invention. Alternately, where a counterfeit refill cartridges attempted to be used in conjunction with the device 10, the lack of a closed electrical circuit between the pair of spaced-apart metal leaf springs 29*a*, 29*b* can be sensed by the controller means, and denying the proper operation of the dispensing device 10, and/or provide a signal to the user that a counterfeit refill cartridge has attempted to be installed and used. FIGS. 27C3 and 27C4 respectively illustrate a side cross-sectional view of a part of a dispensing device 10 according to the invention, and an end cross-sectional view of a part of the dispensing device illustrating the placement of the various elements of the elements which form part of the anti-counterfeit detection means described with reference to FIGS. 27C1 and 27C2, with respect to a body 20 of the dispensing device 10 further illustrating that the post 25*x* may be spatially isolated and separate from the neck portion 25*b* of the refill cartridge.

FIGS. 27D1 and 27D2 provide a still further embodiment of a refill cartridge 25 adapted to be installed in the improved automatic toilet bowl treatment device according to the invention, which refill cartridge 25 includes elements which form part of an anti-counterfeit detection means, and wherein the said device also includes a complementary part(s) of the anti-counterfeit detection means. FIG. 27D1 depicts in a perspective view a refill cartridge 25 which comprises a neck portion 25*b* which is covered by a suitable, breachable sealing means 25*j*, which when breached provides for a suitable liquid tight seal between the pump (not shown) and the neck portion 25*b* of the refill cartridge 25, but prior to being opened or breached, provides a liquid tight seal such that the contents of the interior of the refill cartridge 25 are not released. Further present as part of the refill cartridge 25 is a magnet 25*z* which is also present; although he are depicted as being adjacent to a part of the sealing means 25*j*, the specific positioning of the magnet 25*z* is not critical and may be placed elsewhere on or within part of the refill cartridge 25. FIG. 27D2 presents a top plan view of a portion of the refill cartridge 25 mounted beneath a housing base plate 22*a* of a portion of a body 20 (not shown) of a device 10 according to the invention. Visible in the figure is an aperture 22*b* passing through the housing base plate 22*a* which is dimensioned in order to permit for the pa27B1ge of therethrough of a least a portion of the neck portion 25*b* of said refill cartridge 25 and the sealing means 25*j*, as well as the magnet 25*z*. Also present as part of the body 20 (not shown) of the dispensing device 10 is a magnetically operable reed switch 29*c* which is mounted upon the housing base plate 22*a* in a position to such that, when that the refill cartridge 25 is properly inserted within the body of the dispensing device, the position of the magnet causes the reed switch 29*c* to operate and close. Such provides a potential to provide an electrical connection whereby, an electrical circuit may formed. Such an electrical circuit, that is to say, the absence or the presence thereof, can be used by the controller means in order to validate the presence of a properly inserted and genuine refill cartridge 25 which is installed within the device 10, and to permit for the proper operation and/or for a specific mode of operation of the dispensing device 10 according to the invention. Alternately, where a counterfeit refill cartridges attempted to be used in conjunction with the device 10, the lack of a closed electrical circuit within the reed switch 29*c* can be sensed by the controller means, and denying the proper operation of the dispensing device 10, and/or provide a signal to the user that a counterfeit refill cartridge has attempted to be installed and used.

It is to be understood in any of the foregoing embodiments of anti-counterfeit detection means they be incorporated into any of the various depicted as well as potential embodiments of the dispensing device according to the present invention.

Various embodiments of fluid spray means 100 are disclosed in the following figures. One embodiment, and a preferred embodiment of a fluid spray means 100 is depicted in a perspective view on FIG. 28. Therein is represented a fluidic oscillator. In contrast to conventional fluid spray nozzles which are directed to primarily provide a stream of fluid, preferably a liquid exiting the nozzle, or which alternately provide a spray which is caused by one or more elements forward of the liquid exiting the nozzle which causes the said liquid to disperse when exiting the nozzle but without oscillation of the liquid, the fluidic oscillator can be distinguished in that as the liquid exits the nozzle, the construction of the fluidic oscillator causes the oscillation of the liquid of the liquid exiting the nozzle, which oscillating liquid may impart a spray type pattern or a fan type pattern, or for that matter a different pattern. Preferably the fluidic oscillator in one which provides for the cyclical change of the fluid directions as fluid exits from the fluidic oscillator. Many fluidic oscillators which may be used as the fluid spray means are per se, known in the art. By way of non-limiting example such include those described in U.S. Pat. No. 3,185,166 to Horton, U.S. Pat. No. 3,563,462 and U.S. Pat. No. 4,157,161 to Bauer, U.S. Pat. No. 4,463,904 to Bray, U.S. Pat. No. 4,052,002, US RE 33158, U.S. Pat. No. 4,508,267, U.S. Pat. No. 4,151,955, U.S. Pat. No. 5,035,361, U.S. Pat. No. 5,213,269, and U.S. Pat. No. 5,971,301 to Stouffer, U.S. Pat. No. 5,213,270 and U.S. Pat. No. 6,186,409 to Srinath, U.S. Pat. No. 6,253,782 to Raghu, U.S. Pat. No. 711,800 to Berning, as well as those described in published patent applications US 2007-0063076 A1 to Gopalan, and US 2006-0065765 A1 to Hester the contents of which are herein incorporated in their entirety by reference.

A further embodiment of a fluid spray means 100 is depicted in the perspective view of FIG. 29. Therein is depicted a fan-type spray head which includes a fluid inlet 100*e*, a widening body portion 100*f* which has an angle of "y" which terminates at a face wall 100*g* through which extend a plurality of nozzles 100*h*. A liquid or a fluid, such as a liquid treatment composition useful with the device 10 according to the invention entering the fluid inlet 100*e* fills the widening body portion 100*f* and ultimately exits through the plurality of nozzles 100*h* in a generally planar, fan-type pattern, wherein the angle of the exiting liquid treatment composition it is primarily dictated by the angle "y". According to preferred embodiments, the angle "y" is preferably between about 30° and about 270° of arc, more preferably is at least between about 60° and about 190° of arc.

A further embodiment of a fluid spray means 100 is depicted in FIG. 30. There is depicted a fluid spray means 100 having a fluid inlet 100*j* which extends to a circular body 100*k* which extends outward radially to terminate at a circular sidewall 100*l* through which extend the plurality of perforations or nozzles 100*m*. In operation, a liquid or a fluid, such as a liquid treatment composition useful with the device according to the invention entering in the fluid inlet 100*j* passes to the circular body 100*k* and exiting radially outwardly via the plurality of perforations or nozzles 100*m* of the circular sidewall 100*l*. The exiting liquid treatment composition exits as a generally planar, circular pattern wherein the perforations or nozzles 100*m* extend completely around the periphery of the circular body 100*k* thereby defining a circular spray pattern having 360° of arc, unless the perforations or nozzles 100*m* do not extend completely around the periphery of the circular body 100*k* thereby defining a different non-circular spray pattern having less than 360° of arc.

A further embodiment of a fluid spray means 100 is illustrated on FIGS. 31A and 31B. As is visible there from, the fluid spray means 100 includes a curved body 100*s* which may freely rotate completely around a bearing shaft 100*p*, such that any fluid, such as a liquid treatment composition useful with the device 10 of the invention directed via the fluid conduit 49 to entering into the curved trough 100*r* courses downwardly in the curved trough 100*r* until it exits laterally from the trough outlet 100*n*. Such also simultaneously causes the curved body 100*s* to spin around in the bearing shaft 100*p*, which thus redirects the directional flow of the liquid exiting the fluid conduit 49 by 90° of arc. Thus, wherein the fluid spray means 100 and the fluid conduit 49 are oriented vertically as is illustrated in FIGS. 31A and 31B, the downward flow of the liquid exiting the fluid conduit 49 would exit the fluid spray means 100 via the trough outlet 100*n* as generally circular, and horizontal spray pattern.

A still further embodiment of fluid spray means 100 according to the invention is depicted on FIGS. 32A, 32B and 32C. FIG. 32A depicts a rotatable fluid deflector 100*t* and a top plan view. The rotatable fluid deflector 100*t* is generally circular and configuration, and includes a central axial post 100*w* about which the rotatable fluid deflector 100*t* may rotate, and extending outwardly from said post 100*w* and depending their from a plurality of curved wings 100*v*, which extend upwardly from a base 100*u*. The arrangement of in the placement of the rotatable fluid deflector 100*t* with respect to the fluid conduit 49 is depicted on FIG. 32B, wherein is seen that the central axial post 100*w* is desirably placed beneath the fluid conduit 49 and coincident with the central axis thereof. The arrangement of the placement of the rotatable fluid deflector 100*t* with respect to the fluid conduit 49 and part of the hanger means 60 is depicted on FIG. 32C. With reference to FIGS. 32B and 32C, it is to be understood that any fluid, such as a liquid treatment composition useful with the device according to the invention exiting the fluid conduit 49 passes downwardly, and is divided between the plurality of curved wings 100*v*, and above the base 100*u*, which due to their curvature clause the rotatable fluid deflector 100*t* to rotate, thereby diverting in fluid laterally and outwardly therefrom in a generally circular, and horizontal spray pattern, extending 360° of arc.

Exemplary and preferred spray patterns provided by preferred embodiments of devices 10 according to the invention are described with reference to FIGS. 33, 34 and 35.

Turning first to FIG. 33, it is depicted in a top, plan view a toilet bowl 200 having mounted on a part of the rim 202 a device 10 according to the invention. As is visible thereon, the fluid spray means 100 is within the interior 206 of the toilet bowl and is directed laterally across the toilet bowl 200, such that the liquid treatment composition being dispensed from the fluid spray means 100 is directed in a generally horizontal and preferably, generally planar direction transversely from the exit orifice of the fluid spray means 100 and towards the distal inner sidewall 209 of the toilet bowl 200. As will be understood, the generally horizontal spray pattern will have a specific arc as measured with reference to the exit orifice of the fluid spray means 100 which is indicated by the angle "Z" of the figure. In preferred embodiments, the angle "Z" is the least 60° of arc, and in order of increasing preference is at least 70°, 80°, 90°, 100°, 110°, 120°, 130°, 140°, 150°, 160°, 170°, 180°, 190°, 200°, 210°, 220°, 230°, 240°, 250°, 260°, 270°, 280°, 209°, 300°, 310°, 320°, 330°, 340°, 350°, and most preferably about 360° of arc. In this manner, effective distribution along the interior sidewall of the toilet bowl 200 can be achieved in a single dispensing process. Also preferably, the direction that the liquid treatment composition being dispensed from the fluid spray means 100 is also preferably directed to be substantially within the interior confines of the toilet bowl 200, that is to say at or below, but preferably below the rim 202 thereof Still more preferably, the direction that the liquid treatment composition being dispensed from the fluid spray means 100 is preferably also directed to be substantially below the rim 202 of the toilet 200, but above the level of the water in the bottom or sump (drain) of the toilet such that a consumer viewing of the application the liquid treatment composition would see that a large proportion, namely at least 75% by volume or mass of the liquid treatment composition would be initially applied to the inner sidewalls of the toilet bowl 200 and below the rim 202 thereof, and above the water level present in the sump of the toilet bowl 200.

Turning now to FIG. 34, it is depicted in a top, plan view a toilet bowl 200 having mounted on a part of the rim 202 a device 10 according to the invention, which device includes two fluid spray means 100, 100*a* which are spaced apart from one another in a horizontal plane. As is visible thereon, both of fluid spray means 100, 100*a* are within the interior 206 of the toilet bowl and are both directed laterally across the toilet bowl 200, such that the liquid treatment composition being dispensed from each of fluid spray means 100, 100*a* are independently directed in a generally horizontal and preferably, generally planar direction transversely from the exit orifice of the fluid spray means 100, 100*a* and towards the distal inner sidewall 209 of the toilet bowl 200. The direction of the fluid spray is illustrated as arrows labeled "s" which are dispensed from the fluid spray means 100, and as arrows labeled "s'" which are dispensed from a second fluid spray means 100*a*. As will be understood, the generally horizontal spray patterns will have a specific arc as measured with reference to the exit orifice of the fluid spray means 100 which is indicated by the angle "Z" of the figure. In preferred embodiments, for each of these independent spray patterns dispensed respectively from the first spray means 100 and the second spray means 100*a* are at an angle "Z" which is the least 60° of arc, and in order of increasing preference is at least 70°, 80°, 90°, 100°, 110°, 120°, 130°, 140°, 150°, 160°, 170°, 180°, 109°, 200°, 210°, 220°, 230°, 240°, 250°, 260°, 270°, 280°, 209°, 300°, 310°, 320°, 330°, 340°, 350°, and most preferably about 360° of arc. In this manner, effective distribution along the interior sidewall of the toilet bowl 200 can be achieved in a single dispensing process by both of the separate spray means 100, 100*a*. Simultaneously, mixing of the liquid treatment compositions being dispensed from the separate spray means 100, 100*a* may also be achieved. Also preferably, the direction that the liquid treatment composition being dispensed from each of the fluid spray means 100, 100*a* is also preferably directed to be substantially within the interior 206 of the toilet bowl 200, that is to say at or below, but preferably below the rim 202 thereof. Still more preferably, the direction that the liquid treatment composition being dispensed from each of the fluid spray means 100, 100*a* is preferably also directed to be substantially below the rim 202 of the toilet 200, but above the level of the water in the bottom or sump (drain) of the toilet such that a consumer viewing of the application the liquid treatment composition would see that a large proportion, namely at least 75% by volume or mass of the liquid treatment composition would be initially applied to the inner sidewalls of the toilet bowl 200 and below the rim 202 thereof, and above the water level present in the sump of the toilet bowl 200.

With respect now to FIG. 35, there is depicted in a cross-sectional view a further embodiment of a preferred spray pattern which may be delivered by a device 10 according to the invention. In this cross-sectional view is visible a toilet 100 having mounted on part of its rim 202 a device 10, which device includes two fluid spray means 100, 100*a* which are positioned with respect to one another in a vertical relationship, and which are oriented to separately provide a spray of a respective liquid treatment composition independently provided by each fluid spray means 100, 100*a* laterally and downwardly within the interior 206 of the toilet bowl 200, that is to say at or below, but preferably below the rim 202 thereof. Still more preferably, the direction that the liquid treatment composition being dispensed from each of the fluid spray means 100, 100*a* is preferably also directed to be substantially below the rim 202 of the toilet 200, but preferably also above the level of the water in the bottom or sump (drain) of the toilet. While not visible in this cross-sectional view the spray patterns provided by each fluid spray means 100, 100*a* from a vertical perspective, that is to say from the views depicted in FIG. 33 and FIG. 34 are preferably also in accordance with the angle "Z" of those figures.

FIGS. 36A and 36B illustrating two views a further preferred embodiment of the device 10 according to the present invention. With reference to FIG. 36A, there is depicted a device 10 of the invention which is mounted on the section of the rim 202 of a toilet 200 by a hanger means 60, depicting on the exterior of the rim 202 the body 20 which includes a replaceable cartridge 25 for containing a quantity of a liquid treatment composition which can be dispensed via the liquid spray means (not visible). The housing 22 of the body 20 includes a sensor means 83, here a passive infrared detector which may be used to determine radiate heat and/or motion which is in the near proximity of the device 10, were in the sensor means 83 provides a signal outputs to the controller means of the device 10 which may alter the motor of dispensing of the device 10 depending upon the status of the device 10 within the ambient environment within which it is found and in particular, the near proximity of a user or human being. For example, wherein a user or human being is in immediate proximity to the sensor means 83, such may output a signal to the controller means which would interrupt dispensing of a liquid composition from the device 10 while the user or human being remains in immediate proximity to the sensor means 83. With reference now to FIG. 36B, there is depicted a top view of the device 10 mounted upon the toilet bowl 200, illustrating the positioning of the device 10, and in particular the placement of the fluid spray means 100 with respect to the interior 206 of the toilet bowl 200. The placement of arrows labeled "s" illustrates the direction of the liquid treatment composition directed towards the distal inner sidewall 209 of the toilet bowl 200 as being dispensed from the fluid spray means 100 within the interior 206 of the toilet bowl and the arc "Z" illustrates the angular disbursement of the liquid treatment composition being dispensed from the fluid spray means 100 as being measured from the fluid orifice thereof. In preferred embodiments, for each of these independent spray patterns dispensed respectively from the first spray means 100 and the second spray means 100*a* are at an angle "Z" which is the least 60° of arc, and in order of increasing preference is at least 70°, 80°, 90°, 100°, 110°, 120°, 130°, 140°, 150°, 160°, 170°, 180°, 109°, 200°, 210°, 220°, 230°, 240°, 250°, 260°, 270°, 280°, 209°, 300°, 310°, 320°, 330°, 340°, 350°, and most preferably about 360° of arc. In this manner, effective distribution along the interior sidewall of the toilet bowl 200 can be achieved in a single dispensing process. Also preferably, the direction that the liquid treatment composition being dispensed from the fluid spray means 100 is also preferably directed to be substantially within the interior confines of the toilet bowl 200, that is to say at or below, but preferably below the rim 202 thereof Still more preferably, the direction that the liquid treatment composition being dispensed from the fluid spray means 100 is preferably also directed to be substantially below the rim 202 of the toilet 200, but above the level of the water in the bottom or sump (drain) of the toilet such that a consumer viewing of the application the liquid treatment composition would see that a large proportion, namely at least 25%, preferably at least 50%, yet more preferably at least 75% by volume or mass of the liquid treatment composition would be initially applied to the inner sidewalls of the toilet bowl 200 and below the rim 202 thereof, and above the water level present in the sump of the toilet bowl 200.

While the liquid treatment compositions useful in the devices according to the invention may include one or more constituents which provide an air treatment benefit, such as a perfuming, fragrancing, malodor counteracting, or odor masking benefit to the ambient environment, and certain embodiments an air treatment means is further provided in the devices of the invention. Such may be the sole source of an air treatment benefit provided by the device, or may be an ancillary source of an air treatment benefit which may be used in conjunction with one or more constituents which are provided as part of the liquid treatment composition(s) dispensed by the device.

FIG. 37 depicts an embodiment of a device 10 according to the invention which is similar in many respects to the device discussed with reference to FIGS. 1A and 9. The device 10 includes a body 20 which is suspended from a section of the rim 202 of a toilet bowl 200 by a hanger means 60. Depending from the front sidewall 26 is a perforated cage 230 having an open top 232 and at least extending through a part thereof a series of perforations 234, which expose the interior of the cage 230 two the ambient environment. Insertable within the perforated cage 230 may be provided in a reservoir comprising a quantity of an air treatment composition. Such a reservoir can take any shape or suitable form. By way of nonlimiting examples, such a reservoir may include a porous material such as a pad or tablet which is impregnated with, or upon which is absorbed a volatile composition useful in providing an air treatment benefit, a gel or a solid composition which also contains a volatile air treatment composition which may emanate from the interior of the perforated cage 230, and preferably via the open top 232 and/or one or more of the perforations 234 into the ambient environment.

Additionally, FIG. 37 depicts in the left sidewall 26*b* of the housing 237 a window, here in the shape of a vertical slot passing through the left sidewall 26*b* through which a user may observe the level of liquid treatment composition present within the interior of the housing 22 of the device 10.

FIG. 38 depicts a further embodiment of a device 10 according to the invention which is similar in many respects to the embodiment discussed with reference to FIG. 1A. the device 10 includes a body 20 having a housing 22, which depends from any hanger means 60 which suspends the device 10 from a portion of the rim 202 of a toilet bowl 200. Extending outwardly from the bottom of the housing 22 is the actuator nozzle 239 of a small pressurized aerosol canister 238 which is placed within a part of the housing 22. The aerosol canister 238 contains a quantity of an air treatment composition, as well as a propellant. When necessary or when desired, a user may discreetly actuate the release of at least part of the contents of the pressurized aerosol canister 238 into the ambient environment by operating the actuator nozzle 239.

FIGS. 39A and 39B illustrate an embodiment of the device 10 according to the invention which utilizes a refill cartridge 25 which incorporates a quantity of an air treatment composition in the form of a gel 240. As is visible from FIG. 39A, the device 10 includes anybody 20 depending from a hanger means 60. The body 20 includes a fluid reservoir refill cartridge 25 which on an outer face thereof includes a cavity 240 which comprises a quantity of gel 242 which incorporates in its composition a volatile air treatment constituent. FIG. 39B illustrates in a cross-sectional view the fluid reservoir refill cartridge 25 which on an outer face thereof includes a cavity 240 comprising a quantity of gel 242 which incorporates a volatile air treatment constituent, further illustrating that the gel 242 is exposed to the ambient environment of the device 10. Further illustrated in this view is a quantity of the liquid treatment composition 270 within the interior of the fluid reservoir refill cartridge 25. Such gel compositions are, per se, known to the art.

FIGS. 40 and 40B illustrate an embodiment of the device 10 according to the invention which utilizes a refill cartridge 25 which incorporates a quantity of an air treatment composition in the form of a particulate material 241, such as a plurality of spheres, or beads which function as a reservoir for an air treatment composition, and from whence they may be delivered to the ambient environment. Advantageously, such particulate materials, particularly beads may be based on a polymer or alternately, on an inner gimmick material which has absorbed therein, and/or adsorbed thereon a quantity of the second air treatment composition. Non-limiting examples of such materials include those currently marketed under the tradename Auracell® (ex. Rotuba Extruders) which are based on fragranced cellulosic polymers, as well as PolyIFF® (ex. International Flavors and Fragrances Inc.), as well as Tenite® (ex. Eastman Chemical Co.). As is further visible from FIG. 40A, the device 10 includes a body 20 depending from a hanger means 60, which is suspended from part of a toilet bowl rim. The body 20 includes a fluid reservoir refill cartridge 25 which includes a holder 243 which comprises a quantity of the particulate material 241 which incorporates in its composition an air treatment constituent, which may emanate into the ambient environment through one or more passages 243*a* passing through the holder 243. FIG. 40B illustrates in a cross-sectional view the fluid reservoir refill cartridge 25 which includes a holder 243 having passages 243*a* which holder 243 comprises a quantity of the particulate material 241 which incorporates in its composition an air treatment constituent, as well as Further illustrated in this view is a quantity of the liquid treatment composition 270 within the interior of the fluid reservoir refill cartridge 25.

Figure 41C:
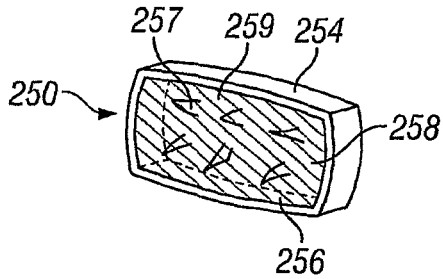

FIGS. 41A, 41B and 41C illustrates a still further embodiment of a device 10 according to the invention which incorporates a "passive" air treatment means. The device 10 includes the same elements as described with reference to the device of FIGS. 1A, 1B and 1C, but additionally includes a removable air treatment composition dispenser means 250 removably affixed to part of the hanger means 60, here affixed by a clip means 254, here affixed to part of the third hanger segment 68 which extends downwardly towards the interior of the toilet bowl. The clip means 254 provides suitable means for detaching and/or affixing the removable air treatment composition dispenser means 250 to a part of the device of the invention so that the consumer may provide a specific air treatment benefit to the ambient environment of the device 10. While a mechanical clip 254 is illustrated as the embodiment of the clip means which form a part of the removable air treatment composition dispenser means 250 and is used to affix the body part 254 of the removable air treatment composition dispenser means 250 to a part of the device, here the hangar means is 60, it is to be understood that any other means article, or composition including adhesive compositions may be used to provide the function of the clip means 254. Turning now to FIG. 41B, therein is depicted in a perspective view the front of a body part 254 of an air treatment composition dispenser means 250 illustrating a generally sealed elements which however includes a pair of slots 256 open to the ambient environment. While not shown in the figure, it is to be understood that a quantity of an air treatment composition is contained within the body part 254, and when an air treatment constituent contained within is volatilized, it may pass from the interior of the body part 254 to the ambient environment. With respect now to FIG. 41C, there is depicted in a perspective view the front of a further body part 254 of an air treatment composition dispenser means 250 which includes a cavity 256 which contains a quantity of an air treatment composition 258 which includes at least one of volatile air treatment constituent. In the particular embodiment shown, the air treatment composition 258 is in the form of a gel or a polymer from which may emanate the air treatment constituent, such as a fragrance or perfume. Such he gels containing a significant proportion of a fragrance are known to the art. Optionally, but advantageously the air treatment composition dispenser means 250 includes within its cavity 250 one or more anchor elements 257 which extend upwardly from the base 259 of the cavity 256. Providing one or more such anchor elements 257 may advantageously improve the retention of the fragranced polymer or the fragrance the gel within the cavity 256 during the service life of the air treatment composition dispenser means 250, inhibiting the premature loss, such as by falling out from the cavity, of the air treatment composition 258.

While not illustrated with respect to any of the figures presented herein, any of the dispensing devices 10 according to the present invention may include an air treatment composition which is provided via a fragrancing substrate which does not require a reservoir or quantity of a liquid or gel of a fragrancing composition, such as a fragrancing oil as a supply source for the fragrancing substrate or to replenish the fragrancing substrate. A fragrancing substrate comprises a porous material which provides for both the retention of, as well as the diffusion of an air treatment composition from within said material. Thus, such a fragrancing substrate acts both as a reservoir for an air treatment composition as well as a dispenser for the inner treatment composition contained therein. Thus, the fragrancing substrate permits for the diffusion of an air treatment composition, typically in liquid form, from within the interior of the fragrancing substrate to pass to the exposed surfaces, typically planar surfaces of the fragrancing substrate and to volatilize into the ambient environment from said surfaces. At the same time, such volatilization of the air treatment composition from said surfaces causes a negative diffusion or capillary gradient within the interior of the fragrancing substrate, thereby inducing a further quantity of the air treatment composition contained within the interior of the fragrancing device to move such as by migration, such as capillary migration or diffusive migration to one or more surfaces of the porous fragrancing substrate and to thereby emitted or delivered to the ambient environment of the porous fragrancing substrate.

Exemplary useful fragrancing substrates are preferably made from or include one or more polymer materials which also include one or more inorganic materials, particularly one or inorganic materials in particulate form, such as silica and/or carbon, e.g. in powder form. Nonlimiting examples of suitable polymer materials include, but are not limited to polyamides, polyolefins (e.g., polypropylene, polyethylene) as well as polyalkyleneterephalates (i.e., polyethylene terephthalate, polybutylene terephthalate), polystyrenes, polysulfones, polycarbonates as well as copolymers formed from monomers of one or more of the foregoing synthetic polymers. Other naturally occurring or synthetic polymers but it will also be used although not specifically described herein, it is only required that he selected polymer or copolymer be fabricable into a fragrancing substrate as described herein. Of these, polyolefins are particularly preferred.

The fragrancing substrates also include one or inorganic materials in particulate form, such as silica and/or carbon which are preferably provided in a comminuted, i.e., powder form, whereby the inorganic materials may be mixed into, or compounded into the polymer material. Advantageously, the inorganic materials are generally uniformly dispersed within the polymer material such that they are present at a relatively homogenous concentration within the bulk of the polymer material used to form the fragrancing substrates. The size of the energetic materials is usually expressed in terms of average particle size, and generally average particle sizes on the order of from about 0.001 microns to about 1000 microns, preferably from about 10 microns to about 500 microns may be used. Of course, depending upon the nature of the specific fragrancing substrate desired to be produced, and/or the chemical nature of the air treatment material to be contained within said fragrancing substrate, and/or the desired release rates of the air treatment material contained within the said fragrancing substrate, a specific average particle size or range of average particle sizes within, or even outside of the above specified ranges may be utilized. The proportion of the inorganic materials present within the fragrancing substrate may vary significantly, and typically comprises between 5-95% wt, preferably 10-90% wt., more preferably between 25-80% wt. and still more preferably between 40-70% wt. of the mass of the fragrance substrate, prior to the addition of or incorporation into, of any air treatment composition thereto.

The polymer materials may also include one or more for the additive constituents thereto in effective amounts. By way of nonlimiting example these include one or more of: fillers, plasticizers, antioxidants, lubricants, antistatic agents, pigments, dies, stabilizers, light stabilizers, and the like.

By way of non-limiting examples, suitable polymer materials include those described in U.S. Pat. No. 3,351,495, and U.S. Pat. No. 6,139,795 the contents of which are herein incorporated by reference. Further examples of suitable polymer materials are disclosed in WO 03/086490 A1. Particularly preferred suitable polymer materials for use in the fragrancing substrate are those currently marketed as "DARAMIC polyethylene battery separator material", which is described to be a porous filled polymer comprising 54-67% wt. of an amorphous silica, 8-22% wt. of an oil, and 20-26% wt. of a polyethylene polymer, which is currently commercially available from Daramic LLC (Owensboro, Ky., USA).

The thickness of the fragrancing substrate, is preferably on the order of between 0.01 mm and 10 mm, more preferably between 0.05-5 mm, still more preferably between 0.1-3 mm, yet more preferably between 0.1-2 mm. The fragrancing substrate may be formed of a single piece or layer of material, or may be formed by lamination of two or more materials, one of which is necessarily the fragrancing substrate which he is capable of containing and releasing an air treatment composition therefrom for example, it is contemplated that a laminated form of a fragrancing substrate may be formed of two or more layers each of which are materials which are capable of containing and releasing an air treatment composition therefrom. Alternately, is contemplated that a laminated form of a fragrancing substrate can be formed of two or more layers, at least one of which are materials which are capable of containing and releasing an air treatment composition therefrom, with a least one further layer which does not provide such a function, i.e., can be a barrier layer such as an impervious foil layer, metallized plastic layer, or any other material which retards or denies absorption off the air treatment material within. In the case of the latter, such provides for a contraction of the fragrancing substrate which essentially emanates the air treatment composition substantially from one surface face.

The fragrancing substrate of the invention includes a porous material which provides for both the retention of, as well as the diffusion of an air treatment composition from within said material. This porous material is advantageously and most preferably the polymer material containing one or inorganic materials in particulate form. The porous material may absorb and/or adsorb the air treatment composition, desirably provided as a fluid or liquid, e.g., a fragrancing oil, in a relatively high weight proportion relative to the weight (mass) of the porous material itself. Advantageously the weight (mass) ratio of the porous material of the fragrancing substrate to the absorbed or adsorbed fluid or liquid is 1:0.75-2.5; preferably 1:0.8-2, and still more preferably 1:1-1.6 on a weight:weight basis.

It is to be understood that virtually any material which can be dispensed from the fragrancing substrate into the ambient environment can be utilized and still be considered a fragrancing substrate for the purposes of the present invention. Such are also referred to as air treatment materials or air treatment compositions. Thus, a wide variety of volatile materials can be utilized including but not limited to: fragrance materials, air treatment materials which provide an air sanitization benefit, air treatment materials which provide an odor masking or odor counteracting benefit, fragrances, disinfectants, bactericides, fungicides, medicaments, as well as details which provide an insecticidal or other insect controlling benefit. Such volatile materials can be used singly, one combinations of two or more of the above.

In a particularly preferred embodiments, the fragrancing substrate includes a fragrance. Preferably, the fragrance or air freshener is a fragrance comprising one or more volatile organic compounds which are available from perfumery suppliers such as Firmenich Inc., Takasago Inc., Noville Inc., Quest Co., International Flavors & Fragrances, and Givaudan Corp.

The fragrancing substrates are readily easily formed merely by at least partially, but preferably wholly immersing the polymer material within an air treatment composition, typically in a liquid form at room temperature and atmospheric pressure, such that a quantity of the air treatment composition is absorbed or impregnated into the interior of the polymer material. Advantageously, the fragrancing material is retained within the air treatment composition for sufficient time such that it is at least 85% saturated, preferably at least 90% by weight saturated, still more preferably is at least 95% by weight saturated and most preferably is completely saturated. Higher degrees of saturation provide for more effective loading of the air treatment composition within the fragrancing substrates, and are believed also to provide for a maximum useful service life of the fragrancing substrate.

Conveniently, the polymer material may be provided to a bath containing a quantity of the air treatment composition, typically in liquid form, and is retained immersed therein until a desired degree of saturation of the polymer material is achieved. Such may be practiced by using, for example, a roll or sheet(s) of the polymer material which is, subsequent to the immersion and later withdrawal from the quantity of the air treatment composition, is subsequently formed such as by cutting or stamping into the ultimately desired shape of the fragrancing substrate. Alternately, the polymer material can be formed into the ultimately desired shape of the fragrancing substrate prior to the immersion into or contact with the air treatment composition, typically in liquid form part again, such a process can be performed via dipping, or immersing the polymer material into the air treatment composition for sufficient time such that a desired degree of saturation of the polymer material is attained.

Thereafter, of the fragrancing substrate can be used such as for example by insertion into an appropriately shaped cavity of a part of a dispensing device according to the present invention from whence the air treatment composition can be delivered from within the fragrancing substrate into the ambient environment. For example, such a porous polymeric fragrancing substrate may be used in of the various embodiments as disclosed in this specification and discuss with reference to one or more of the figures. For example, a suitably dimensioned fragrancing substrate containing a quantity of an air treatment composition or material can be placed within a part of a dispensing device described herein, e.g, within a perforated cage 230 of the device 10 depicted on FIG. 37, or in place of the gel 240 in the embodiments shown on FIGS. 39A, 39B, or within the holder 243 of the embodiments illustrated on FIGS. 40A, 40B, as well as within an air treatment composition dispenser means 250 illustrating a generally sealed housing which however includes a pair of slots 256 open to the ambient environment. Such a fragrancing substrate can be provided as part of a refill cartridge 25, or as part of a dispensing device 10 such as part of the body 20 thereof, or can be provided as parts of both of the aforesaid.

An important technical feature of these fragrancing substrates resides in the fact that it has been surprisingly and unexpectedly observed to that the fragrancing substrates are effective in providing a satisfactory amount of an air treatment composition, especially where such as a fragrancing composition such as a fragrance oil, to an ambient environment for a period of several weeks without a significant reduction in the perceived levels of the air treatment benefit, viz., fragrancing benefit provided over several weeks by an ordinary consumer. This is particularly surprising as not withstanding ever increasing depletion of the air treatment composition from within the fragrancing substrate, that, a satisfactory level of perceived delivery of said air treatment composition occurs, with less than a 75% degree of diminishment, preferably less than a 50% degree of diminishment of the perceived level of delivery of the air treatment composition, especially where such as a fragrance, between the perceived level of delivery said air treatment composition following one week of use, and the fourth or fifth successive week of use of the fragrancing substrate.

A further surprising technical effect discovered by the inventor was that the fragrancing substrates, in certain embodiments, exhibited a reduced level of loss of the air treatment material, e.g., fragrance oil, between the $1^{st}$ week of use of the fragrancing substrate, and later weeks of use of the fragrancing substrate, especially in the $3^{rd}$ and/or $4^{th}$ and/or $5^{th}$ week of use of the fragrancing substrate. Such may be responsible for the perceived satisfactory fragrancing benefit provided over several weeks by an ordinary consumer.

This particular feature is particularly surprising considering also that the fragrancing substrate according to the invention is advantageously used without any replenishing source, such as being periodically contacted with a further amount of an air treatment composition, such as by inversion of a vessel containing a quantity of the same where it comes into contact with the polymer material of the fragrancing substrate, or by direct application of a further quantity of the air treatment composition to a part of the fragrancing substrate, or by the transmission of a quantity of an air treatment composition from a supply source such as a vessel or bottle, via a wick, to a part of the fragrancing substrate.

Advantageously, also these fragrancing substrates operate without the need of any power, viz., may operate without the need of an electric fan, electric blower, heating element such as the heating plate or mantle.

The fragrancing substrates may take any of variety of forms, and may be essentially two-dimensional in configuration, e.g., in the form of a flat plate, sheet, film, ribbon or tape, or may be formed into a three-dimensional configuration such as by folding into a shape or form which has three dimensions, e.g., providing a series of folds or bends such as to provide a corrugated shape or configuration, or wherein the fragrancing substrate may be formed into a three-dimensional article, such as a cube, coil or virtually any other shape. The fragrancing substrates may also be thermoformed as well. For example, wherein the fragrancing substrate is to be provided within the interior of a cavity, such as within the interior of a part of a refill cartridge 25, and/or air treatment composition dispenser such as a generally sealed housing which however includes a one or more openings providing passages or airways to the ambient environment, it may be desirable to fold, or crimp the fragrancing substrate so that it has 3-dimensional configuration.

FIGS. 42A and 42B illustrate a yet further embodiment of a device 10 according to the invention which incorporates a "passive" air treatment means. With reference to FIG. 42A, therein is depicted a device 10 suspended by a hanger means 60 from a portion of the rim at 202 of a toilet bowl 200. The device 10 includes a body 20 which comprises a housing 22, and a refill cartridge 25 removable he affixed to one another. At one end of the housing 22 are provided a series of vent passages 280 passing through part of the housing 22. With reference now to FIG. 42B, there is depicted in a partial cross sectional view portions of the interior of the device 10 illustrating the refill cartridge 25 as containing at least two chambers, a first reservoir chamber 25*e* containing a quantity of a liquid treatment composition 270, and a second chamber 25*f* which contains a vessel 281 including a quantity of an air treatment composition 281*a*, and a porous wick 282 having an exposed end 284 extending outwardly from the vessel 280 wherein the exposed end 284 is positioned within the housing 22 in the near proximity of the vent passages 280. When the device 10 is mounted onto a toilet bowl 10 and used, the air treatment composition 281*a* is continuously released into the ambient environment of the device 10 by evaporation from the exposed and 284 of the porous wick 282, whereby the air treatment composition exits the housing 22 via the vent passages 280.

FIG. 43 illustrates a still further embodiment of a device 10 according to the invention which incorporates a combination "active/passive" air treatment means. In the partial cross sectional view portions of the device 10 reveals that there is provided a refill cartridge 25 as containing at least two chambers, a first reservoir chamber 25*e* containing a quantity of a liquid treatment composition 270, and a second chamber 25*f* which contains a vessel 281 including a quantity of an air treatment composition (not visible) and a porous wick 282 having an exposed end 284 extending outwardly from the vessel 280, wherein the exposed end 284 is positioned within the housing 22 preferably in the near proximity of the vent passages 280 which not shown in the figure, may be similar to those disclosed on FIG. 41A or which may take an alternate configuration. Further illustrated is an electrically operated fan 288 which is controlled by the controller means 114. In its "passive" mode of operation, when the device 10 is mounted onto a toilet bowl 10 and used in its normal manner, the air treatment composition 281*a* is continuously released into the ambient environment of the device 10 by evaporation from the exposed end 284 of the porous wick 282, whereby the air treatment composition exits the housing 22. In its "active" mode of operation, responsive to a signal from the controller means it which may be either automatic, or which may be initiated by a user such as by actuating a switch provided with the device 10, the controller means 114 provides electrical currents to the finish 288, causing it to spin for a predetermined duration of time, preferably between 0.1-30 seconds, although shorter durations on the order of 1-7 seconds are usually sufficient in order to force the evaporation of the fragrance in composition from the exposed end 284 of the porous wick 282 and enter the ambient environment of the device 10.

FIG. 44 illustrates a yet further embodiment of a device 10 according to the invention suspended from the rim 202 of a toilet bowl. As is visible from the figure, the device 10 includes a body 20, having a fluid reservoir attached thereto 25, wherein the body incorporates into its construction the fluid spray means 100. Further visible is that the body 20 is suspended on the interior of a toilet bowl rim via a hanger means 60, such that the a fluid reservoir, a pump means, and a fluid spray means are positioned on the interior of the toilet bowl, with only a portion of the hanger means 60 extending to the exterior of the toilet bowl 200.

FIG. 45 illustrates a yet further embodiment of a device 10 according to the invention suspended from the rim 202 of a toilet bowl. As is visible from the figure, the device 10 includes a body 20, having a fluid reservoir attached thereto 25, wherein the body incorporates into its construction a plurality of fluid spray means 100. the plurality of fluid spray means 100 may be spaced apart such that, he chaired the individual fluid spray means 100 only provides coverage for a limited degree of arc as measured from the front of the individual fluid spray means 100. For example, wherein the four or fluid spray means a 100 are provided as shown in the figure, each need only provide a fluid spray having at most, about 90° of arc as a slight overlapping at the margins of the direction of the fluid spray being delivered by a particular fluid spray means 100 should ensure coverage of the interior surfaces of the toilet bowl. Further, while not depicted it is to be understood is that still further fluid spray means may be provided which are directed to the portion of the toilet bowl immediately adjacent to the position of the device 10 so that the portion of the toilet bowl rearward may also be effectively treated. The fluid reservoir refill cartridge 25 includes on an outer face thereof includes a cavity 240 comprising a quantity of gel 242 which incorporates a volatile air treatment constituent, further illustrating that the gel 242 is exposed to the ambient environment of the device 10, here towards the interior of the toilet bowl. Further visible is that the body 20 is suspended on the interior of a toilet bowl rim via a hanger means 60, such that the a fluid reservoir, a pump means, and a fluid spray means are positioned on the interior of the toilet bowl, with only a portion of the hanger means 60 extending to the exterior of the toilet bowl 200.

FIG. 46 illustrates a still further embodiment of a device 10 according to the invention suspended from the rim 202 of a toilet bowl. As depicted the device 10 includes a body 20 which incorporates into its construction the fluid spray means 100. While the body 20 is within the interior of a toilet bowl 200, device also has a fluid reservoir attached thereto 25, albeit on the exterior of the toilet bowl 200, wherein the hanger means 60 spans the top surface of the rim 202 of the toilet bowl 200. In the depicted embodiment a consumer may conveniently supply a new fluid reservoir refill cartridge 25 at the exterior of the toilet bowl, without requiring the consumer to venture into the interior of the toilet bowl in order to replenish the device 10. alternately, a fluid reservoir 160 may be provided in place of the fluid reservoir refill cartridge 25 at the exterior of the toilet bowl which could be conveniently refilled by a consumer through a suitable opening.

A further form of an air treatment means, although not depicted in any of the figures, may be provided by using polymer which comprises a significant proportion of a fragrance and one or more elements or parts of the devices according to the invention. Such materials are per se, it known to the art and include by way of example which 5% or more by weight of one or more fragrancing, perfuming, or other odor treatment compounds, as well as materials previously are presently commercially available as POLYIFF (ex. International Flavors and Fragrances Inc.) and TENITE (ex. Eastman Chemical Co.) polymers. The formation of one more elements or parts of the devices according to the invention utilizing such a material may provide a continuous, and durable air treatment benefit. Advantageously when used, all or part of a refill cartridge useful in the devices of the invention may be formed of such a material, or alternately, all or part of one or more of the fluid reservoir, pump means, hanger means, and/or a fluid spray means of the devices of the invention can include such materials. Preferably any element of the devices formed utilizing such material would an element expected to be exposed to the ambient environment such that the air treatment benefit provided therefrom can be perceived by a consumer or user.

The improved devices taught herein may be fabricated from any suitable materials of construction which fulfill their required function. Advantageously one or more elements or parts of the improved devices are fabricated from or using one or more naturally occurring or synthetic polymers provide excellent materials of construction as they are readily molded or otherwise formed into appropriate shapes and configurations. Additionally such polymers are often resistant to the treatment compositions, and particularly with respect to the bottle are resilient and flexible, and thus provide for compressible flasks or bottles. Such are known to the art and include, e.g., any of a number of thermosettable or thermoformable synthetic polymers such as are widely used in casting or injection molding. Exemplary synthetic polymers such as polyamides, polyolefins (e.g., polypropylene, polyethylene) as well as polyalkyleneterephalates (i.e., polyethylene terephthalate, polybutylene terephthalate), polystyrenes, polysulfones, polycarbonates as well as copolymers formed from monomers of one or more of the foregoing being several nonlimiting examples of useful synthetic polymers. Other materials which may be used include metals, glass, elastomeric polymers both naturally occurring and synthetic, as well as any other material which can be suitably shaped or formed may also be used as well.

The controller means may be used to provide any of a variety of operational protocols or methods of operation for the device according to the invention. Darius operating parameters may be varied for adjusted either independently of conditions within the environment, or responsive to conditions within the environment of the device according to the invention such as the presence of light, sound, or flush water. The use of flush sensing means provides a convenient inputs of a condition of the environment of the device according to the invention whereby the controller may come or responsive to such a condition control the initial and worthy for the operation of the inventive device. One more steps may be executed responsive to such a condition, i.e. a flush cycle.

Two exemplary series of process steps for controlling the operation of a device according to the invention are outlined on the flowcharts provided on FIGS. 47A and 47B. It is at the outset to be understood that such flowcharts identified to useful and in certain cases preferred embodiments of processes for controlling the device of the invention but are not to be interpreted as a being limiting in any manner or form asked to the types of process steps, or the sequence of process steps which may be practiced with devices according to the invention.

Turning first to FIG. 47A, a general process 300 is depicted which includes a series of discrete process steps. It is presumed that the configuration of the device (not shown) includes appropriate components or elements which can be used to practice the process outlined on the figure. The initial step of the process 302 is the initial step or in the system is "primed". Such a process step is conveniently executed when the device is either initially installed upon a lavatory appliance, or may be performed when the power supply such as one or more batteries are replaced within the device according to the invention. Such a "power on" state may be used to reset the controller means (not shown) and reset any memory counters which may be present and included as part of the controller means. Memory means, such as memory registers can be used to "count" various environmental conditions or signals, such as for example the sensing of a "flush cycle" while the devices installed upon a lavatory appliance. Such memory means can also be used to store in an appropriate memory space or register user-definable conditions, such as for example one or more user definable settings. Such a user definable setting may be for example the number of calm or frequency of flush cycles which are desired to be permitted between dispensing of a treatment compositions via the spray means from the device and onto the side walls or into the interior of the lavatory appliance. Further, the use of such memory means such as memory registers are also conveniently used as they are typically frequently easy to increment or otherwise update in response to a condition, such as the sensing of a flush cycle of the lavatory appliance. Thus, the initial step 302 of "Prime system" is advantageously conveniently used to restart or reset such memory means, and may be used to reinitiate or restart the controller means itself if so desired.

In the next process step 304 a memory means which is used to store the number of flush cycles it is reset, preferably to zero. In the next process step 306, the controller means may be used to check the status of any users settable conditions, such as the desired frequency or number of flush cycles between operation on the spray means. Such a condition may be set either by manual intervention, such as mighty setting of a slider switch, which switch means may be used to output or establish a suitable signal which can be properly interpreted by the controller means to identify such a user defined condition.

In the next process step 308 the controller sense is a flush cycle of the lavatory appliance with which the device of the invention is associated, preferably mounted at least partially thereon. In the next process step, 310 the flush counter is incremented in order to reflect the flush cycle which is occurring, or which has previously occurred.

In the next conditional process step, the controller means determines if the value of the flush counter meets the requirements of any users settable condition which may have been established by the user. Examples of such users settable conditions may be the number of flush cycles which are to occur prior to the dispensing of the liquid treatment compositions via the spray means and onto or into the lavatory appliance. Advantageously, such flush cycles may be any number, but conveniently are a digit between 1-12, preferably a digit between 1-8. The device may be responsive to a plurality of users settable conditions, for example the user may be provided with several preset alternates such as ordering the dispensing of the liquid treatment compositions via the spray means and onto or into the lavatory appliance at 3, 4, 6, or 8 flush cycles. It is to be understood that such users settable conditions may be reset by the user at any desired time and that the controller means is advantageously responsive thereto. In this process step 312 if it is determined that the user settable condition has been satisfied, the branch 'yes' passes control to the next process step 314 wherein the pump, and the spray means a are used to deliver a quantity of the liquid treatment composition to the interior of the toilet bowl. Such a delivery may take place at any time during, or after a flush cycle, but preferably occurs at a time interval when the majority of the flush water has been passed to prove the lavatory appliance, e.g., a toilet bowl and exits such that an undue amount of the liquid treatment composition is not prematurely or inadvertently flushed away. Conveniently, the controller means, maybe operated to allow a time delay of between 0.1-30 seconds, more advantageously 0.1-15 seconds following the sensing of the flush cycle prior to delivering the liquid treatment composition to the interior of the lavatory appliance in step 314. However, in this process step 312 if it is determined that the user settable condition has not been satisfied, then the branch "no" returns the process to prior step 306 or to any other point prior to the step 308 where the delivery of flush water in the lavatory appliance is sensed.

Turning now to FIG. 47B, a variant of the process outlined on prior FIG. 47A is depicted, and like process steps are identified using identical numerals. The process according to FIG. 47B differs in the inclusion of an additional process step 311 and a variation on process step 314.

A main feature which differentiates the process depicted on the present figure from that of the prior figure lies in the fact that the present inventors have found that in order to improve the perceived foaming behavior of the liquid treatment compositions, it may be advantageous to dispense quantities of the liquid treatment compositions from the device according to two distinct modes. The first mode, which provides a primary cleaning benefit is as described above particularly with reference to step 314 of FIG. 47A. according to such a step, sufficient pressure is generated by the pump such that a larger quantity of the liquid treatment composition is dispensed from the spray means, and advantageously both the quantity and the pressure on the liquid treatment composition being delivered according to such a step are such that the spray patterns described with reference to FIG. 33-35 and/or FIG. 36B are provided during this step. Such is intended to provide for sufficient quantity of the liquid treatment composition to be provided to interior surfaces of the lavatory appliance, particularly in a direction sideways from, and/or transverse the spray means. For example, according to a certain preferred embodiment between about 3-8 ml of a liquid treatment composition are dispensed in such a first mode. The second mode is intended to provide a substantially reduced amount of the liquid treatment composition via the spray means, which is generally less than ½, and more generally is not more than ¼ of the amount of the liquid treatment composition when it is dispensed according to the first mode. The purpose of this second mode is to provide for a reduced amount of liquid treatment composition at one or more time intervals or one or more periods between intervals or periods during which dispensing according to the first mode occurs. The provision of such reduced amounts, possibly at a greater frequency then the frequency of the first mode of delivery of the liquid treatment composition, provides for the delivery of the liquid composition into the flush water, such that a consumer perceived benefit of increased foaming can occur. This is the case as it has been observed that even minor amounts of the liquid treatment composition, when supplied to the circulating flush water, may provide a reasonable, and in some cases a copious amount of foam due to the presence of one or more surfactants in the liquid treatment composition coupled with the turbulent flow characteristics of the flush water. Such provides for a degree of air entrainment or cavitation, and/or the formation of bubbles and/or foam. Thus, at desired or preestablished frequency intervals, the first mode of delivery of the liquid treatment composition may be practiced, and intermediate such intervals, the second mode of delivery of the liquid treatment composition may be practiced.

Returning to FIG. 47B, at process step 311 the device according to the invention, via the control provided by the controller means, may dispense a quantity of the liquid treatment composition in the form of a "microburst" or according to the second mode as described above. This may occur at a time "T1" which may be at any point during the flush cycle and may be concurrent therewith, but is advantageously at least 0.5 seconds following the initial sensing of the flush water by the flush sensing means. Yet more advantageously, dispensing of the quantity of the liquid according to this process step occurs at a time between 0.5-5 seconds following sensing of the flush cycle as this increases the probability that the reduced amount of the liquid treatment composition will be supplied to the moving flush water and thereby likely impart a perceived foaming benefit discernible by a consumer. Following this step, control is passed to process step 312 which operates as described previously; if a "yes" condition is satisfied, control is passed to process step 314 which is essentially the same as described with reference to the same process step 314 of FIG. 47A, wherein the liquid treatment composition is delivered according to the first mode of delivery. Additionally in this process step 314, a second time "T2" may be established to initiate the delivery of the liquid treatment composition according to the first mode of delivery as described above. And advantageously, dispensing of the quantity of the liquid treatment composition according to this step occurs near or following the conclusion of the flush away of the flush water within the lavatory appliance. Conveniently, the controller means, maybe operated to allow a time delay of between 0.1-30 seconds, more advantageously 0.1-15 seconds following the sensing of the flush cycle.

While not depicted with reference to the process described on FIG. 47B, it is to be understood that further conditions may be provided by the controller means which modifies the process described in that figure. For example, it is particularly feasible and indeed foreseen that the controller means may be used to determine when the flush counter has a value which has account of one flush cycle "less" then the user established setting and, upon the initiation and sensing of the next flush cycle may cause control of the process to skip process step 311 and force the process to process step 314, thereby conserving the amount of liquid treatment composition by omitting the "microburst" spray of step 311.

In a still further embodiment of the present invention, the operation of the dispensing device may be controlled such that, periodically a "microburst" such as described with reference to step 311 of FIG. 47B is practiced. Such may for example may be processed as an additional step or steps within the process described on FIG. 47A, and/or within the process described on FIG. 47B. The present inventors have found that the provision of a "microburst" spray step prior to, or intermediate one or more successive normal spraying steps, e.g., step 314 of FIG. 47A, 47B may be useful in clearing any undesired dry deposits from the exit nozzle of the spray means 100. Advantageously, such microburst spray step 311 may be practiced following any spray step 314 however, is it is advantageously practiced so that it occurs between 1-15 spraying steps 314, and/or alternately may be practiced in response to a user input, such as by the depression of a switch on the dispensing device 10 such as by a consumer. The control means of the dispensing device 10 of the invention can be suitably programmed in order to provide such an additional "microburst" spray step intermediate several successive normal spraying steps if so desired.

A further process (alternately sub-process) according to the present invention is that described on accompanying FIG. 47C. According to that process, during the normal operation of the dispensing device according to the invention, prior to the normal dispensing of the liquid treatment composition by the trigger pump, one or more "microburst" spray operations may be performed. Advantageously, the "microburst" spray operation is performed prior to the normal spraying step. The reference now to FIG. 47C, a sequence of operation is depicted as any "combined" spraying step 314, and a thus it is to be understood that this "combined" spraying step 314 may be substituted into the foregoing step 314 of processes described with reference to FIG. 47A and 47B, or alternately, the "combined" spraying step 314 new practiced with any other process which is found useful with the dispensing device according to the present invention. The advantage of the "combined" spraying step 314 may in certain cases provide for improved reliability and dispensing of the treatment composition from the spray means 100 under certain circumstances. With regard to the "combined" spraying step 314 of FIG. 47C, the device according to the invention, via the control provided by the controller means, may dispense a quantity of the liquid treatment composition in the form of one or more, preferably one or two "microburst" of the liquid treatment composition. At such a "microburst", approximately 0.01-0.5, preferably 0.01-0.1 and still more preferably between 0.01-0.07 ml of the liquid treatment composition is dispensed by the device at a time T1 which may be at any point during the flush cycle, e.g, and may be concurrent therewith, but is advantageously at least 0.5 seconds following the initial sensing of the flush water by flush sensing means or any other means. Yet more advantageously, dispensing of the quantity of the liquid according to this process step occurs at a time between 0.5-5 seconds following sensing of the flush cycle as this increases the probability that the reduced amount of the liquid treatment composition will be supplied to the moving flush water and thereby likely in part any perceived foaming benefit discernible by a consumer. Where two or more individual "microbursts" of the liquid treatment composition occurs during this step, advantageously, any second "microburst" occurs at a time interval of T1+0.5-10 seconds, and preferably any further successive "microburst" occurs at 0.5-15 seconds following any immediately prior "microburst". Thus, a sequence of two or more "microbursts" may occur and according to certain preferred embodiments of the invention, at lease to such "microbursts" occur during step 314A. Subsequently, at a later time "T2" which is advantageously at least 2-20 subsequent to any final "microburst" which occurred during step 314A the controller passes to a next process step 314B wherein the pump, and the spray means a are used to deliver a quantity of the liquid treatment composition to the interior of the toilet bowl. Such a delivery may take place at any time during, or after a flush cycle, but preferably occurs at a time interval T2 which is subsequent to T1, and subsequent to the final "microburst" delivered in process step 314A. Advantageously T2 is 7-120 seconds, preferably 10-60 seconds following the following the initial sensing of the flush water by flush sensing means or any means. Advantageously, 0.2-10 ml, preferably 0.25-5 ml of the liquid treatment composition is dispensed via the spray means 100 and into the interior of the toilet bowl. The practice of such as "combined" spraying step 314 first ensures that the "microburst" or "microbursts" clear any potential debris present within the supply conduit 49 but especially the spray means 100 prior to the delivery of the more substantial volume of the liquid treatment composition during the latter part of the "combined" spraying step 314, and ensures that any uniform and broad spray pattern is provided during the latter part. The timings of the "combined" spraying step which may be controlled by the controller means also ensures that when the majority of the flush water has been passed through the lavatory appliance, e.g., a toilet bowl, and exits, that an undue amount of the liquid treatment composition is not prematurely or inadvertently flushed away.

Other variations and arrangements of process steps may also be practice utilizing the device according to the invention, although not necessarily expressly described herein.

It is to be understood that the present disclosure is to be interpreted as by way of illustration, and not by way of limitation, and that various modifications and alterations apparent to one skilled in the art may be made without departing from the scope and spirit of the present invention.

The invention claimed is:

1. An automatic toilet bowl treatment device, wherein said device comprises:

a fluid reservoir, a pump means, a hanger means, a fluid spray means which is a fluidic oscillator, a controller means, a flush sensing means which is at least two metallic or semi-metallic conducting terminals which extend into a cavity present as part of the hanger means, and which cavity is adapted to at least temporarily retain a quantity of flush water and which flush water may thereafter drain out of the cavity, which conducting terminals conduct an electrical signal or current over conductors to the controller means, and, wherein the entire device is configured so that it can be suspended from, a part of a toilet bowl and further wherein the automatic toilet bowl treatment device delivers a quantity of fluid to the interior of a toilet bowl through the fluid spray means responsive to the flush sensing means and the controller means.

2. An automatic toilet bowl treatment device according to claim 1 wherein the fluid reservoir is a refillable fluid reservoir, or is a fluid reservoir refill cartridge.

3. An automatic toilet bowl treatment device according to claim 2 wherein the fluid reservoir refill cartridge includes a power source.

4. An automatic toilet bowl treatment device according to claim 1 wherein the fluid reservoir is a plurality of fluid reservoirs.

5. An automatic toilet bowl treatment device according to claim 1 wherein the fluid reservoir is non-pressurized.

6. An automatic toilet bowl treatment device according to claim 1, wherein the flush sensing means is at least two conducting terminals which, when immersed in water provided to the toilet bowl, sense or provide a circuit between the conducting terminals, or a reduction in the resistance between the conducting terminals, which are sensed as a condition and used by the controller means to control one or more functions of the said device.

7. An automatic toilet bowl treatment device according to claim 1 wherein the device includes an air treatment means.

8. An automatic toilet bowl treatment device according to claim 1, wherein the said device is wholly suspended from the rim of the toilet bowl.

9. An automatic toilet bowl treatment device according to claim 1 which comprises at least two separate fluidic oscillators.

10. A process for the automatic treatment of the interior surfaces of a toilet bowl which process comprises the steps of:

installing an automatic toilet bowl treatment device according to claim 1, and operating the device to provide a quantity of a treatment composition at periodic intervals to one or more of the interior surfaces of a toilet bowl.

11. A process according to claim 10, wherein the process of operating the automatic toilet bowl treatment device to provide a quantity of a treatment composition at periodic intervals to one or more of the interior surfaces of a toilet bowl includes the process steps of:

a) resetting a memory means of the device, b) sensing the flush cycle of the lavatory appliance and in response thereto, incrementing a flush counter value and storing it in the memory means;

c) determining the value of the flush counter means and if the value of the flush counter meets any user settable condition established by a user, then causing the controller means to operate the device to dispense a quantity of the treatment from the fluid reservoir through the fluidic oscillator.

12. A process according to claim 11, wherein the user settable condition is a number of flush cycles.

13. A process according to claim 10, wherein the automatic toilet bowl treatment device is operated such that the controller means allows for a time delay of between 0.1 and 30 seconds following the sensing of a flush cycle, prior to delivering the liquid treatment composition to the interior of the lavatory appliance.

14. A process according to claim 13, wherein the time delay is between 0.1 and 15 seconds.

15. A process according to claim 10, wherein the automatic toilet bowl treatment device is operated to dispense a quantity of a liquid treatment composition on a time delay wherein the dispensing of the treatment composition initiates after the majority of the flush water has passed through the lavatory appliance.

16. A process according to claim 10, wherein 3-8 ml of the liquid treatment composition are dispensed by the device in a dispensing cycle.

17. A process for the automatic treatment of the interior surfaces of a toilet bowl which process comprises the steps of:

installing an automatic toilet bowl treatment device according to claim 1 which further includes a fluidic oscillator as the fluid spray means, and operating the device to provide a quantity of a treatment composition at periodic intervals to one or more of the interior surfaces of a toilet bowl.

18. A process for the automatic treatment of the interior surfaces of a toilet bowl which process comprises the steps of:

installing an automatic toilet bowl treatment device according to claim 6, and operating the device to provide a quantity of a treatment composition at periodic intervals to one or more of the interior surfaces of a toilet bowl.

* * * * *